US012745867B2

(12) United States Patent
Pyle et al.

(10) Patent No.: US 12,745,867 B2
(45) Date of Patent: Sep. 29, 2026

(54) FRAME KIT AND RELATED METHODS

(71) Applicant: MCS Industries, Inc., Easton, PA (US)

(72) Inventors: Michael Lee Pyle, Sugar Grove, IL (US); Robert Terry Coyle, Jr., Palmer, PA (US); Matthew Scott Kressin, Allentown, PA (US); Jill Christine Heck, Nazareth, PA (US); Weisha Yu, Belvidere, NJ (US); Isabel Kathleen Case, Easton, PA (US); Ariane Ebba Boli, Delaware Water Gap, PA (US); Brad William Huff, Nazareth, PA (US)

(73) Assignee: MCS Industries, Inc.

( * ) Notice: Subject to any disclaimer, the term of this patent is extended or adjusted under 35 U.S.C. 154(b) by 116 days.

(21) Appl. No.: 18/943,769

(22) Filed: Nov. 11, 2024

(65) Prior Publication Data

US 2025/0064228 A1 Feb. 27, 2025

Related U.S. Application Data

(62) Division of application No. 18/113,375, filed on Feb. 23, 2023, now Pat. No. 12,167,806.

(51) Int. Cl.
*A47G 1/06* (2006.01)
*A47G 1/16* (2006.01)

(52) U.S. Cl.
CPC ..... *A47G 1/06* (2013.01); *A47G 1/1653* (2013.01)

(58) Field of Classification Search
CPC ..... A47G 1/0611; A47G 2001/0666; A47G 2001/0677; A47G 2001/0694; G09F 11/06; G09F 11/34; G09F 9/40
See application file for complete search history.

(56) References Cited

U.S. PATENT DOCUMENTS 2,885,166 A 5/1959 Lehn et al.
3,681,867 A 8/1972 Bilodeau
(Continued)

FOREIGN PATENT DOCUMENTS

DE 19900723 A1 9/1999
WO 2018222708 A1 12/2018

OTHER PUBLICATIONS

Amazon website "MCS Format Frame, Black, 4×6 in, 12 pk", https://www.amazon.com/MCS-Format-Frame-12-Pack-65471/dp/B008JC329C, Retrieved Jan. 18, 2023, pp. 1-13.
(Continued)

*Primary Examiner* — Shin H Kim
(74) *Attorney, Agent, or Firm* — BELLES KATZ LLC

(57) ABSTRACT

A frame apparatus, a kit of parts which includes multiple frames and a connector bracket for connecting the frames together, and a method of interconnecting a plurality of frames and hanging the same from a support surface. The frame apparatus may be a front-loading frame whereby display items are inserted into a display cavity of the frame through an opening in the front surface of the frame through which the display cavity is viewed. The frame may include an outer annular wall that defines the display cavity, an inner annular wall that is spaced apart from the outer annular wall, and a floor that extends between the inner and outer annular walls. The floor may comprise a plurality of apertures to allow for attachment of the frame to various accessories including hanging brackets, connector brackets, trays, and the like.

19 Claims, 62 Drawing Sheets

(56) References Cited

U.S. PATENT DOCUMENTS

| | | | | |
|---|---|---|---|---|
| 4,216,597 | A | 8/1980 | Kocina | |
| 4,428,135 | A | 1/1984 | Sobel | |
| 4,571,866 | A | 2/1986 | Cole et al. | |
| 4,790,089 | A | 12/1988 | Astolfi | |
| 5,335,434 | A | 8/1994 | Shultz et al. | |
| 6,298,593 | B1 | 10/2001 | Vilims et al. | |
| 6,634,127 | B2 | 10/2003 | Bauer | |
| 6,962,016 | B1 | 11/2005 | Meyer | |
| 7,587,850 | B2 | 9/2009 | Vineyard | |
| 8,534,627 | B2 | 9/2013 | Kressin | |
| 8,746,644 | B2 | 6/2014 | Kressin | |
| 9,060,627 | B2 | 6/2015 | Kressin | |
| 9,386,867 | B2 | 7/2016 | Kressin | |
| 9,480,350 | B2 | 11/2016 | Kressin et al. | |
| 9,622,600 | B2 | 4/2017 | Kressin et al. | |
| 9,801,478 | B1 | 10/2017 | Kressin et al. | |
| 10,080,448 | B2 | 9/2018 | Kressin et al. | |
| 10,238,221 | B2 | 3/2019 | Kressin et al. | |
| 10,835,061 | B2 | 11/2020 | Kressin | |
| 10,939,774 | B2 | 3/2021 | Coyle, Jr. et al. | |
| 10,952,552 | B2 | 3/2021 | Hernandez et al. | |
| 10,959,546 | B2 * | 3/2021 | Kressin | A47G 1/1653 |
| 11,033,125 | B2 * | 6/2021 | Kressin | F16M 13/02 |
| 11,178,985 | B2 | 11/2021 | Bastian | |
| 11,330,919 | B2 * | 5/2022 | Coyle, Jr. | A47G 1/143 |
| 11,419,437 | B2 * | 8/2022 | Kressin | A47G 1/1653 |
| 11,744,390 | B2 * | 9/2023 | Kressin | A47G 1/1653 248/475.1 |
| 11,771,245 | B1 * | 10/2023 | Kressin | A47G 1/1653 248/475.1 |
| 2007/0204500 | A1 | 9/2007 | Splittgerber | |
| 2020/0268181 | A1 | 8/2020 | Kressin et al. | |

OTHER PUBLICATIONS

Amazon website "MCS Format Frame, Black, 11×14 in, Single", https://www.amazon.com/MCS-11x14-Format-Frame-40960/dp/B00AWGIB6M, Retrieved Jan. 18, 2023, pp. 1-12.

* cited by examiner

FRAME KIT AND RELATED METHODS

CROSS-REFERENCE TO RELATED APPLICATIONS

The present application is a divisional of U.S. patent application Ser. No. 18/113,375, filed on Feb. 23, 2023, the entirety of which is incorporated herein by reference.

BACKGROUND OF THE INVENTION

Frames are used as a structural support for displaying photographs and artistic works. Frames may also be used as a support structure for holding function items, such as mirrors, corkboards, pegboards, whiteboards, and the like. Such frames are conventionally made from wood, metal, plastic, or other materials depending on the desired aesthetic and price-point. However, frames are often difficult for people to hang from a wall or other support surface, especially people who are inept at such tasks. And when such frames are hung, there tends to be damage to the underlying support surface which requires remediation, at least once the frame is permanently removed from the support surface. Thus, a need exists for a frame apparatus that is easy to hang and provides additional conveniences.

SUMMARY OF THE INVENTION

The present invention is directed to a frame apparatus, a kit of parts which includes multiple frames and a connector bracket for connecting the frames together, and a method of interconnecting a plurality of frames and hanging the same from a support surface. The frame apparatus may be a front-loading frame whereby display items are inserted into a display cavity of the frame through an opening in the front surface of the frame through which the display cavity is viewed. The frame may include an outer annular wall that defines the display cavity, an inner annular wall that is spaced apart from the outer annular wall, and a floor that extends between the inner and outer annular walls. The floor may comprise a plurality of apertures to allow for attachment of the frame to various accessories including hanging brackets, connector brackets, trays, and the like.

In one aspect, the invention may be a frame apparatus comprising: a display item; a frame comprising: an outer annular wall comprising an outer surface defining a periphery of the frame, an inner surface defining a display cavity, a rear edge, and a front edge that defines a display opening configured to allow the display item to pass therethrough into the display cavity; an inner annular wall comprising a front edge, a rear edge, and an inner surface that faces the inner surface of the outer annular wall in a spaced apart manner; and a floor extending between the rear edges of the inner and outer annular walls, the floor comprising a front surface that faces the display cavity, a rear surface that defines a rear of the frame, and a plurality of linear floor sections, each of the plurality of linear floor sections comprising an aperture that extends from the front surface of the floor to the rear surface of the floor.

In another aspect, the invention may be a kit of parts for interconnecting a plurality of frames, the kit of parts comprising: a first frame comprising an outer annular wall defining a display cavity configured to retain a first display item, an inner annular wall that is spaced apart from the outer annular wall, and a floor extending between the outer and inner annular walls, at least one first connector element located along the floor of the first frame; a second frame comprising an outer annular wall defining a display cavity configured to receive a second display item, an inner annular wall that is spaced apart from the outer annular wall, and a floor extending between the outer and inner annular walls, at least one second connector element located along the floor of the second frame; and a connector bracket comprising an elongated body portion having a plurality of mounting elements, wherein a first one of the plurality of mounting elements of the connector bracket is configured to mate with the at least one first connector element of the first frame and a second one of the plurality of mounting elements of the connector bracket is configured to mate with the at least one second connector element of the second frame to couple the first and second frames to one another so that upon hanging the first frame from a support surface, the second frame hangs from the first frame by the connector bracket.

In yet another aspect, the invention may be a kit of parts for interconnecting a plurality of frames, the kit of parts comprising: a first frame comprising a display cavity configured to retain a first display item and at least one first connector element; a second frame comprising a display cavity configured to receive a second display item and at least one second connector element; and a connector bracket comprising an elongated body portion having a plurality of mounting elements, wherein a first one of the plurality of mounting elements of the connector bracket is configured to mate with the at least one first connector element of the first frame and a second one of the plurality of mounting elements of the connector bracket is configured to mate with the at least one second connector element of the second frame to couple the first and second frames to one another so that upon hanging the first frame from a support surface, the second frame hangs from the first frame.

In a further aspect, the invention may be a method of interconnecting a plurality of frames and hanging the plurality of frames from a support surface, the method comprising: mating a first mounting element of a connector bracket to a first connector element of a first frame to attach the connector bracket to the first frame; mating a second mounting element of the connector bracket to a connector element of a second frame to attach the connector bracket to the second frame; and hanging the first frame from the support surface, the second frame hanging from the first frame via the connector bracket.

In a still further aspect, the invention may be a frame apparatus comprising: a display item; a frame comprising: an outer annular wall comprising an inner surface defining a display cavity, a front edge that defines a display opening configured to allow the display item to pass therethrough into the display cavity, and a rear edge; an inner annular wall that is spaced apart from the outer annular wall, the inner annular wall comprising a rear edge; and a floor extending between the rear edges of the inner and outer annular walls, the floor comprising a front surface that faces the display cavity, a rear surface that defines a rear of the frame, and a plurality of linear floor sections that intersect at corner portions of the frame; each of the plurality of linear floor sections comprising at least two apertures that extend from the front surface of the floor to the rear surface of the floor, the at least two apertures comprising a first aperture located adjacent to a first one of the corner portions of the frame and a second aperture located adjacent to a second one of the corner portions of the frame that is an adjacent corner relative to the first one of the corner portions of the frame.

In another aspect, the invention may be a frame apparatus comprising: a display item; a frame comprising: an outer annular wall comprising an outer surface defining a periphery of the frame, an inner surface defining a display cavity, a rear edge, and a front edge that defines a display opening configured to allow the display item to pass therethrough into the display cavity; an inner annular wall comprising a front edge, a rear edge, and an inner surface that faces the inner surface of the outer annular wall in a spaced apart manner; and a floor extending between the rear edges of the inner and outer annular walls, the floor comprising a front surface that faces the display cavity, a rear surface that defines a rear of the frame, and a plurality of linear floor sections, each of the plurality of linear floor sections comprising at least one mounting element located on the rear surface of the floor for engagement with an accessory item.

In yet another aspect, the invention may be a frame comprising: an outer annular wall comprising an outer surface defining a periphery of the frame, an inner surface defining a display cavity, a rear edge, and a front edge that defines a display opening configured to allow a display item to pass therethrough into the display cavity; an inner annular wall comprising a front edge, a rear edge, and an inner surface that faces the inner surface of the outer annular wall in a spaced apart manner; and a floor extending between the rear edges of the inner and outer annular walls, the floor comprising a front surface that faces the display cavity and a rear surface that defines a rear of the frame; wherein the frame comprises a first linear frame section, a second linear frame section that is parallel to the first linear frame section, a third linear frame section, and a fourth linear frame section that is parallel to the third linear frame section, the third and fourth linear frame sections extending between the first and second linear frame sections; wherein the frame comprises a longitudinal axis that intersects the third and fourth linear frame sections and a transverse axis that intersects the first and second linear frame sections; wherein along each of the first and second linear frame sections, the frame comprises a first aperture and a second aperture that extend through the floor of the frame and are located on opposite sides of the transverse axis; and wherein along each of the third and fourth linear frame sections, the frame comprises a third aperture and a fourth aperture that extend through the floor of the frame and are located on opposite sides of the longitudinal axis.

In still another aspect, the invention may be a kit of parts comprising: a frame comprising: an outer annular wall comprising an inner surface defining a display cavity and a front edge that defines a display opening configured to allow a display item to pass therethrough into the display cavity; an inner annular wall that is spaced apart from the outer annular wall; and a floor extending between the inner and outer annular walls, the floor comprising a plurality of linear floor sections, each of the plurality of linear floor sections comprising at least one mounting element; and a hanging assembly comprising: a first hanging bracket comprising an elongated body portion, a first bracket configured for engagement with a top edge of a structure to hang the first hanging bracket from the structure, and at least one mounting element located on the elongated body portion, wherein the first hanging bracket is configured to be coupled to the frame via mating between the at least one mounting element of the first hanging bracket and one or more of the at least one mounting elements located along a first one of the plurality of linear floor sections; and a second hanging bracket comprising an elongated body portion, a second bracket configured for engagement with the top edge of the structure to hang the second hanging bracket from the structure, and at least one mounting element located on the elongated body portion, wherein the second hanging bracket is configured to be coupled to the frame via mating between the at least one mounting element of the second hanging bracket and one or more of the at least one mounting elements located along a second one of the plurality of linear floor sections that is parallel to the first one of the plurality of linear floor sections.

In yet another aspect, the invention may be a product line of frames, said product line comprising: a first frame comprising an outer annular wall defining a display cavity configured to retain a first display item, an inner annular wall that is spaced apart from the outer annular wall, and a floor extending between the outer and inner annular walls, the first frame having a first length and a first width; a second frame comprising an outer annular wall defining a display cavity configured to receive a second display item, an inner annular wall that is spaced apart from the outer annular wall, and a floor extending between the outer and inner annular walls, the second frame having a second length and a second width, wherein at least one of the second length is different than the first length and the second width is different than the first width; wherein each of the first and second frames comprises a plurality of linear sections, each of the linear sections comprising a first mounting element and a second mounting element located on the floor, and wherein the first and second mounting elements located on each of the plurality of linear sections of each of the first and second frames are spaced apart by the same distance.

In another embodiment, the invention may be a product line of frames, said product line comprising: a first frame comprising an outer annular wall defining a display cavity configured to retain a first display item, an inner annular wall that is spaced apart from the outer annular wall, and a floor extending between the outer and inner annular walls, the floor comprising a first plurality of linear floor sections, and the first frame having a first length and a first width; a second frame comprising an outer annular wall defining a display cavity configured to receive a second display item, an inner annular wall that is spaced apart from the outer annular wall, and a floor extending between the outer and inner annular walls, the floor comprising a second plurality of linear floor sections, and the second frame having a second length and a second width, wherein at least one of the second length is different than the first length and the second width is different than the first width; wherein each of the first plurality of linear floor sections of the first frame comprises a first mounting element and a second mounting element that are spaced apart by a first distance; and wherein each of the second plurality of linear floor sections of the second frame comprises a third mounting element and a fourth mounting element that are spaced apart by a second distance that is equal to the first distance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 15:
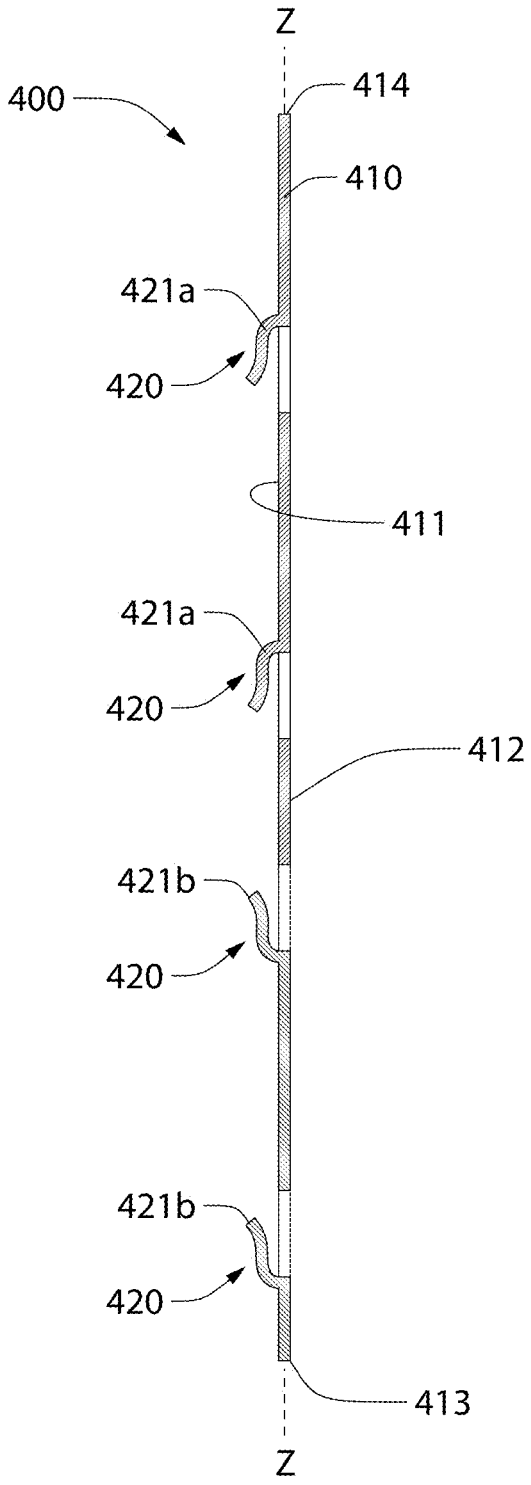
FIG. 15 is a side view of a connector bracket in accordance with an embodiment of the present invention
Figure 16A:
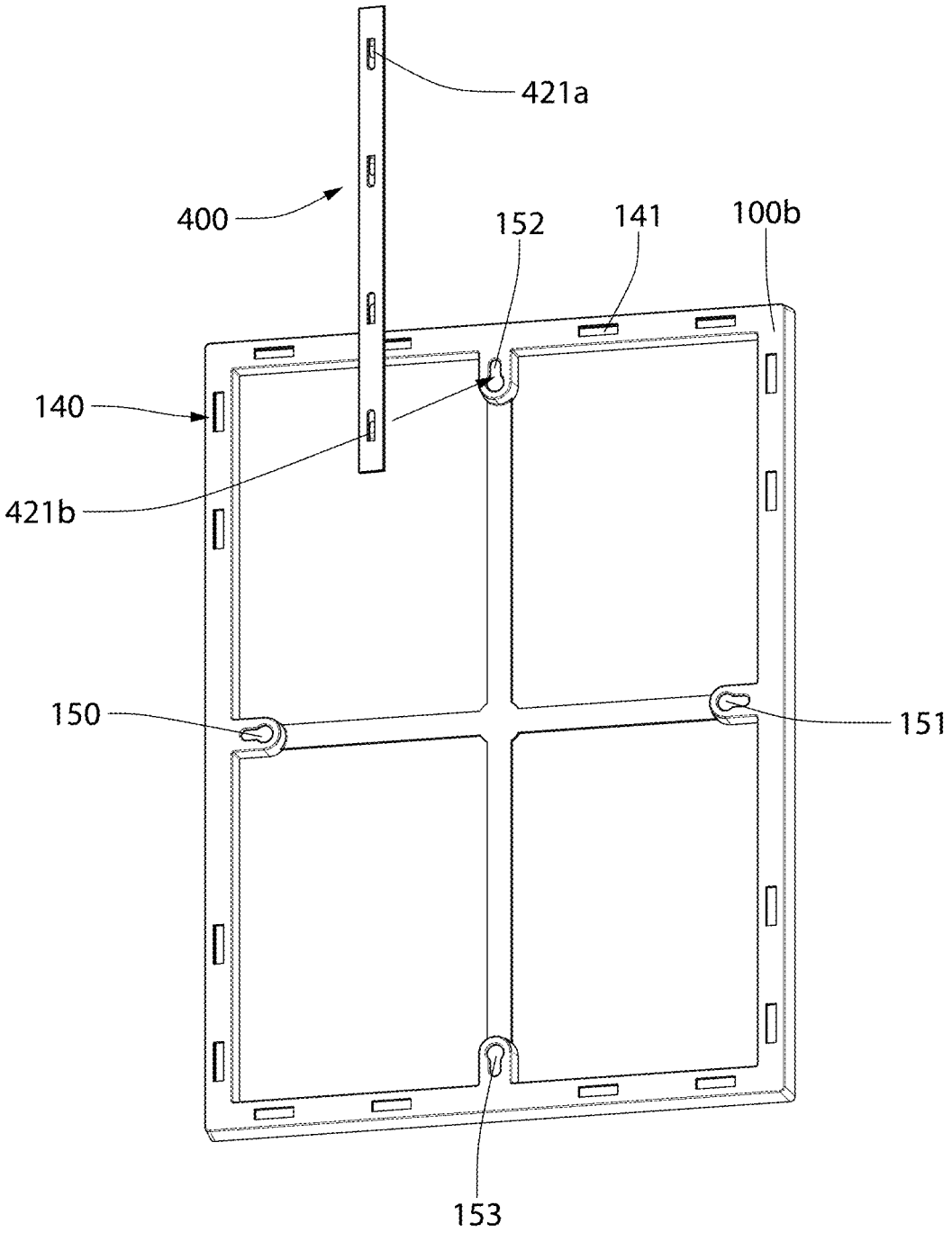
Figure 16B:
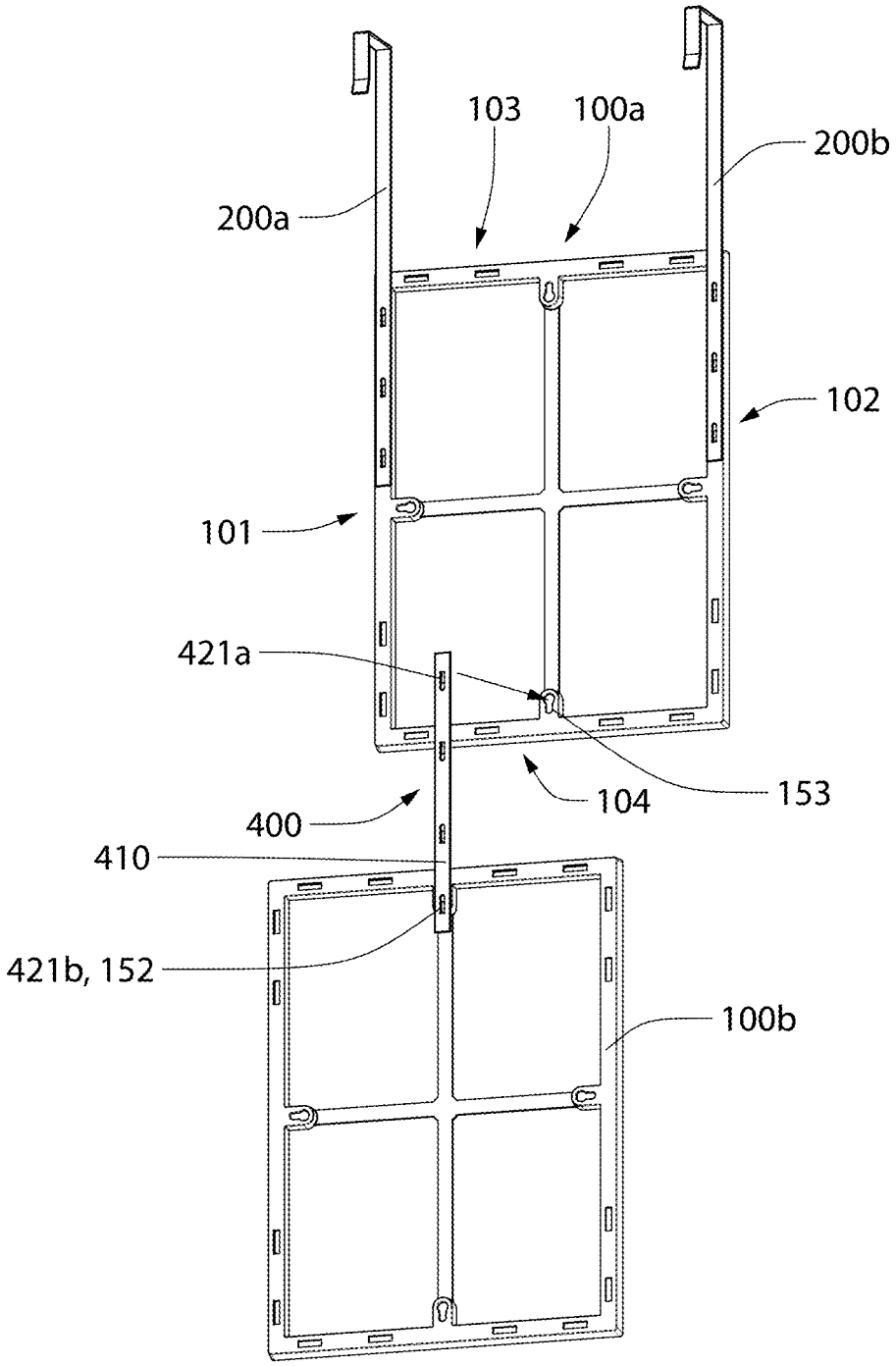
Figure 16C:
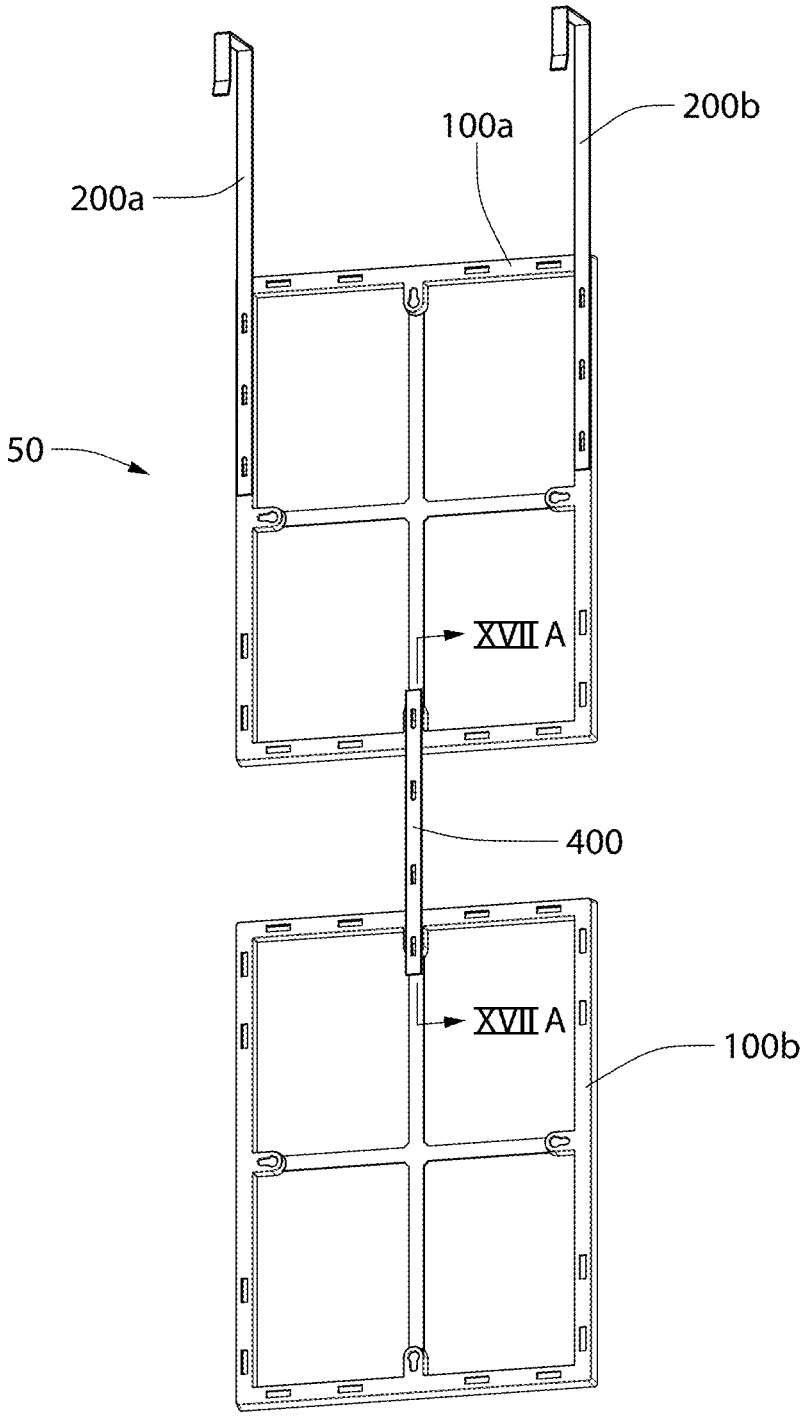
Figure 17A:
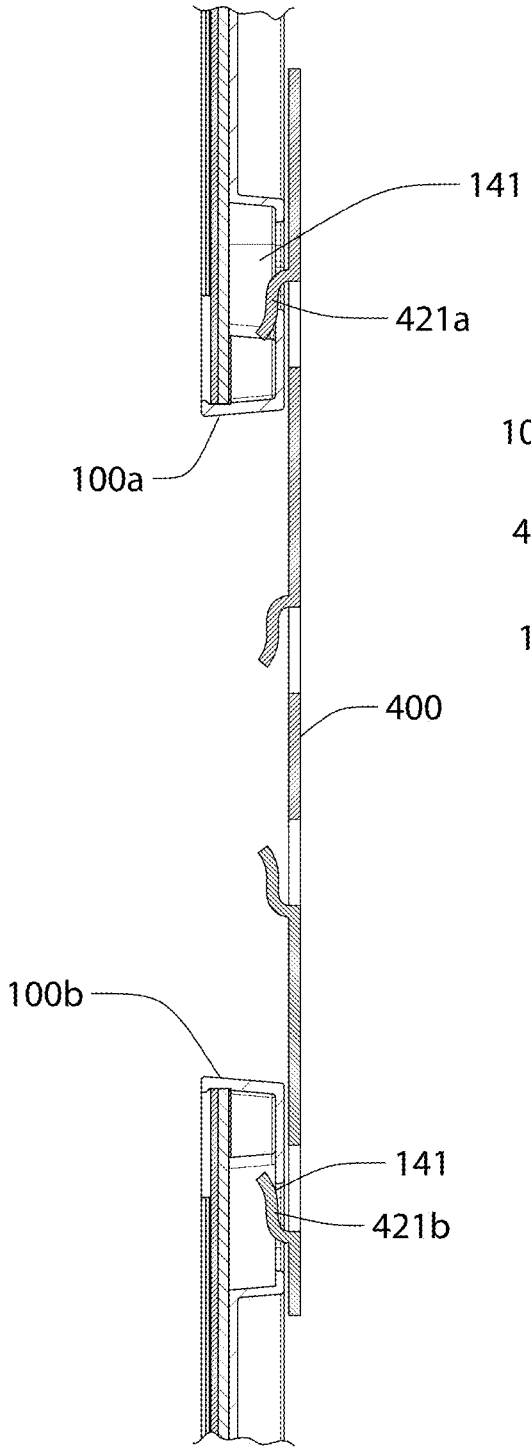
Figure 17B:
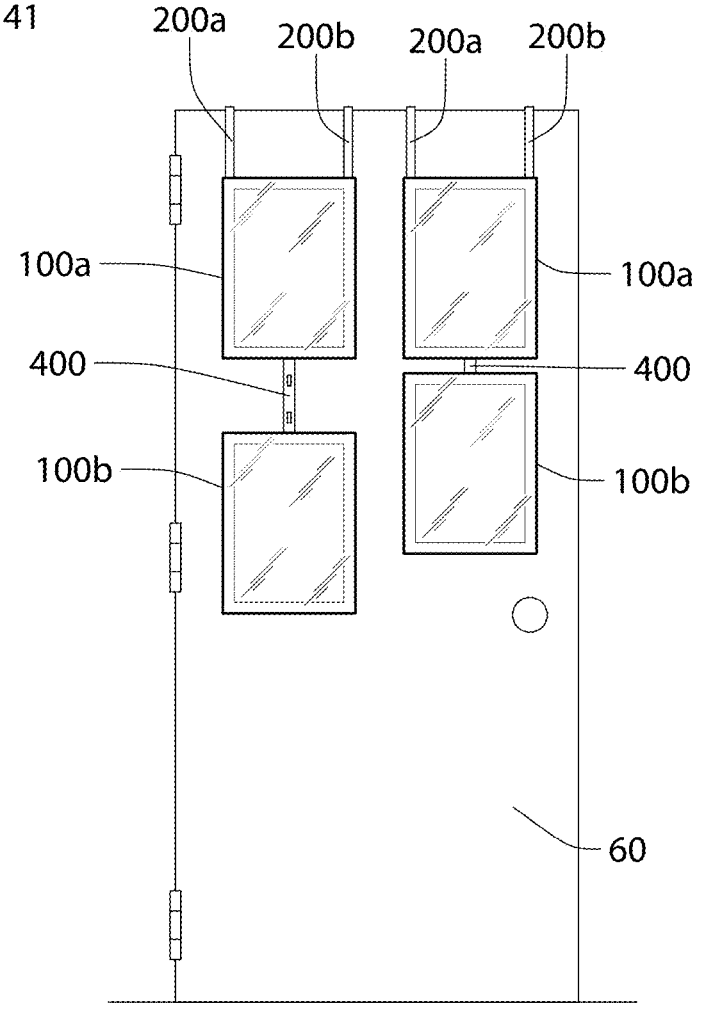
Figure 17C:
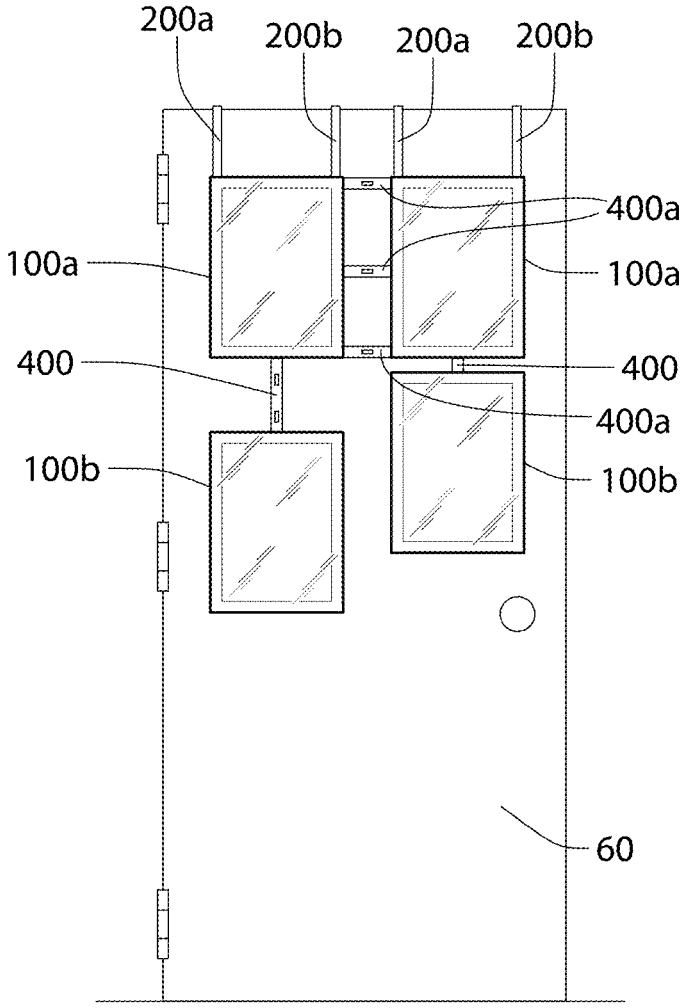
Figure 18A:
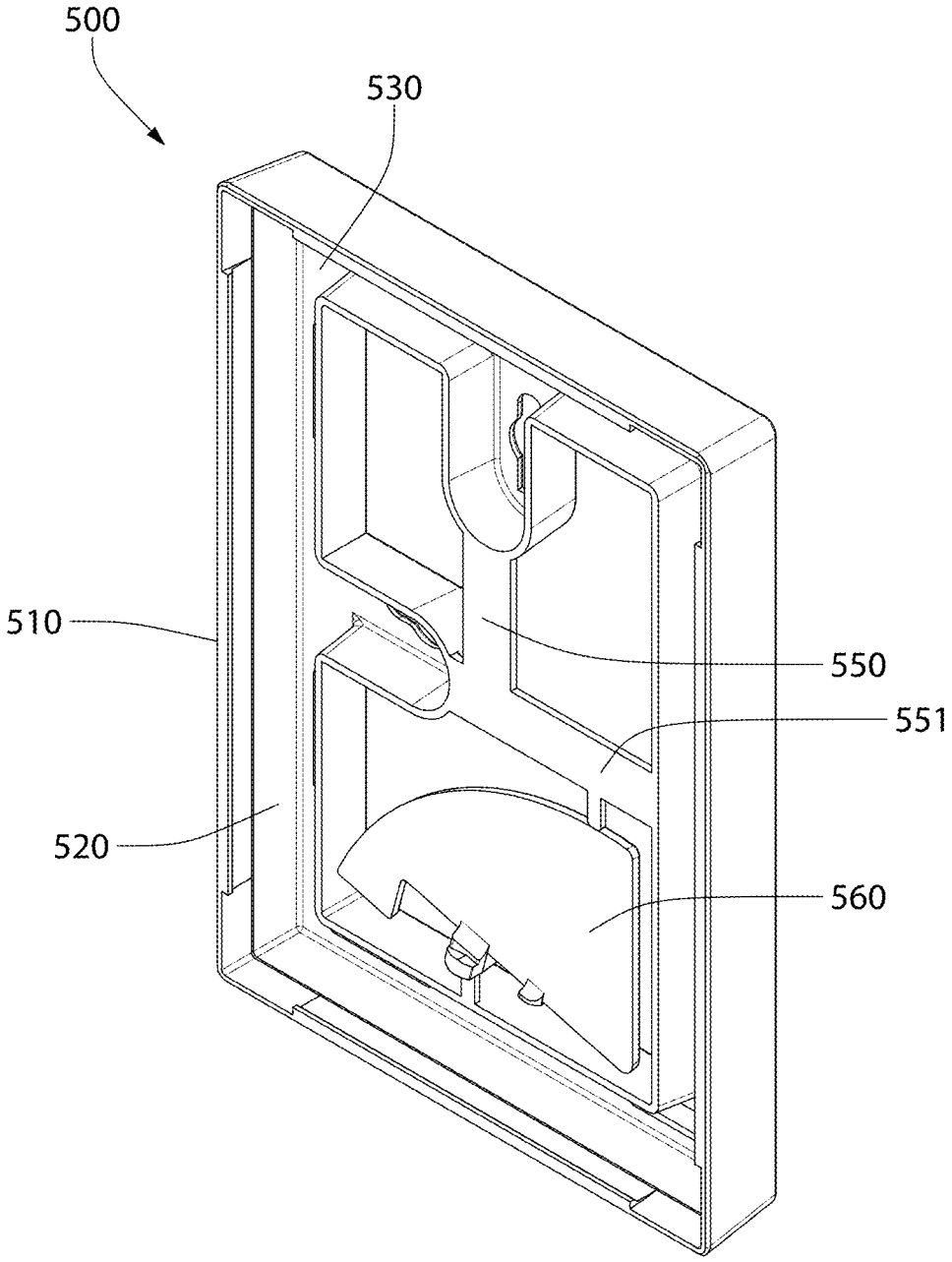
Figure 18B:
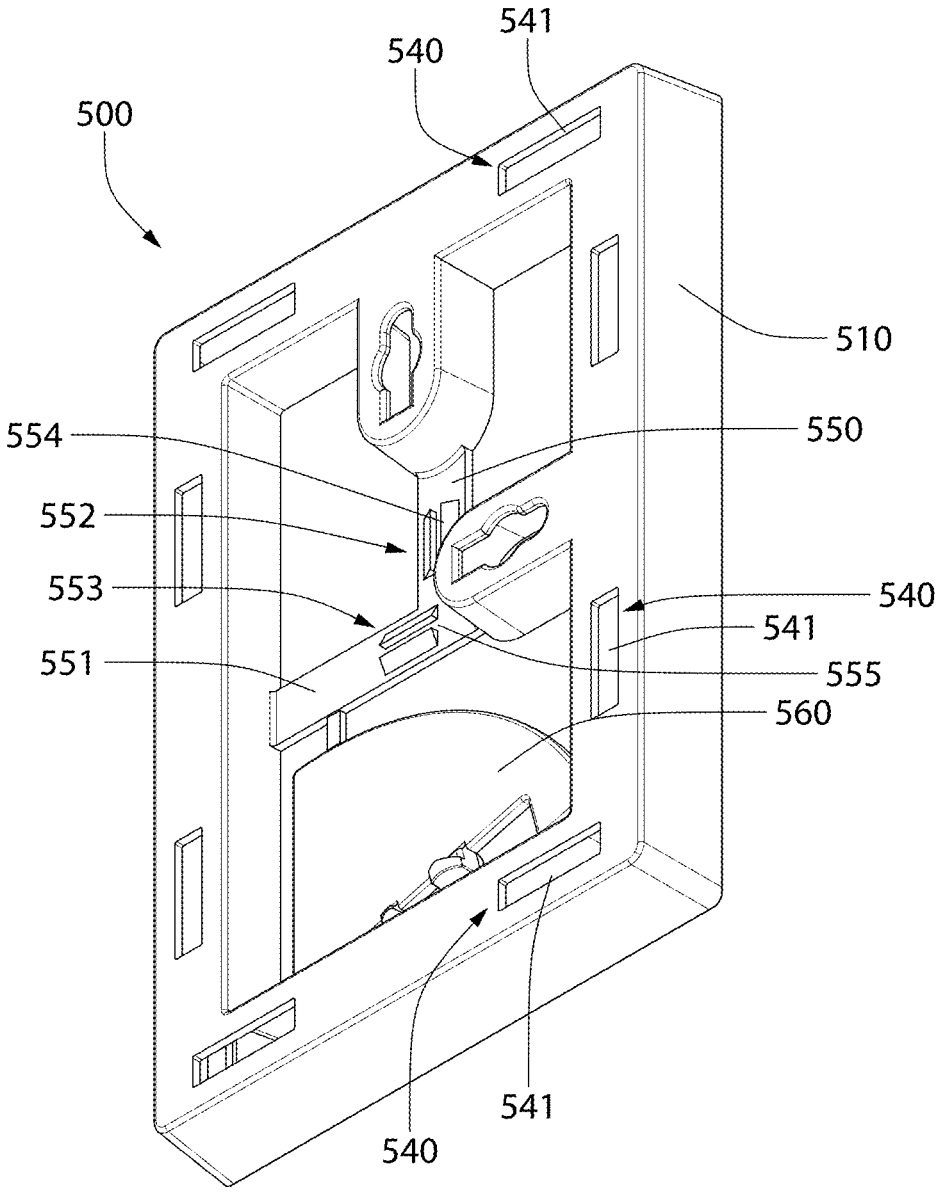
Figure 18C:
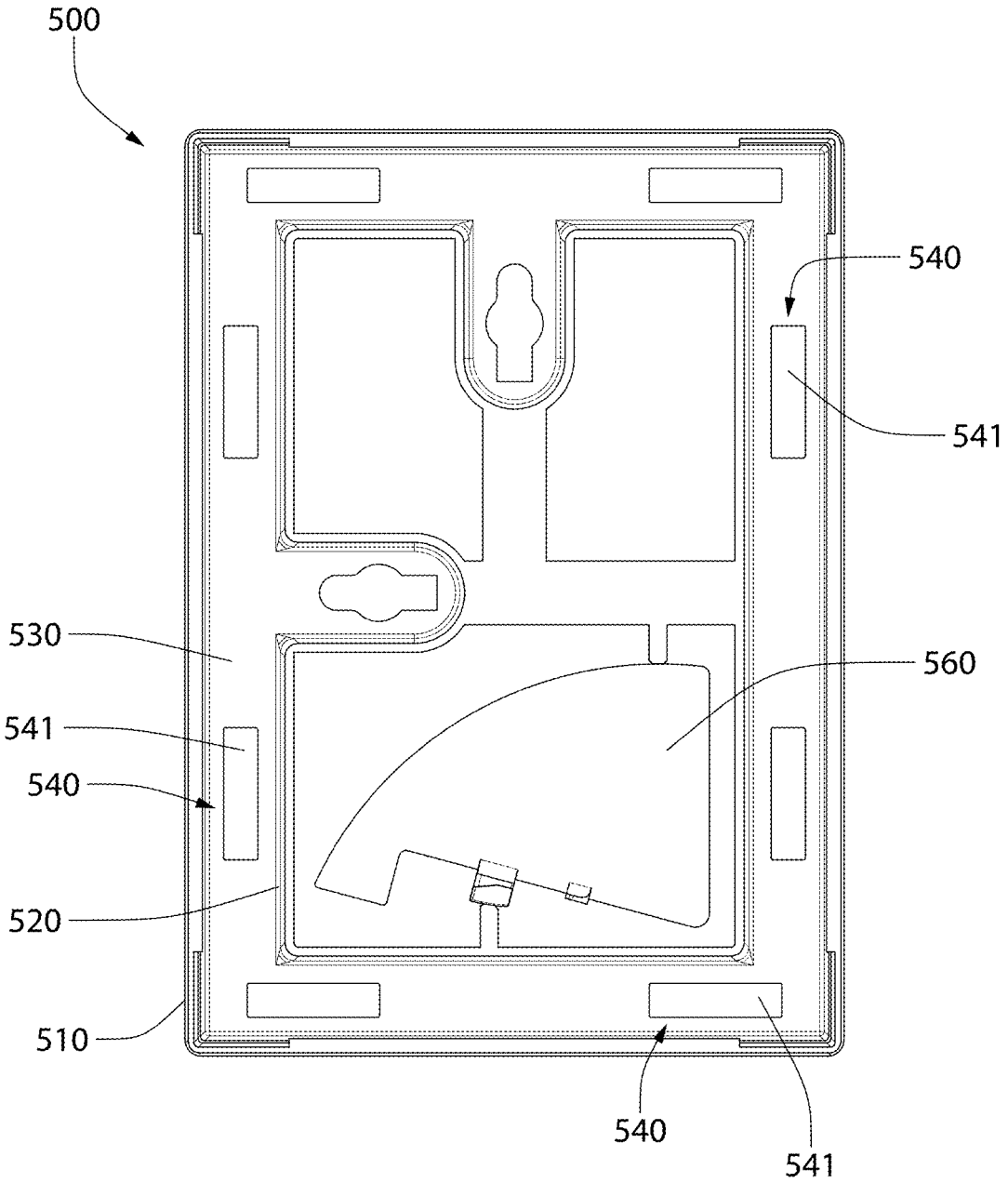
Figure 19A:
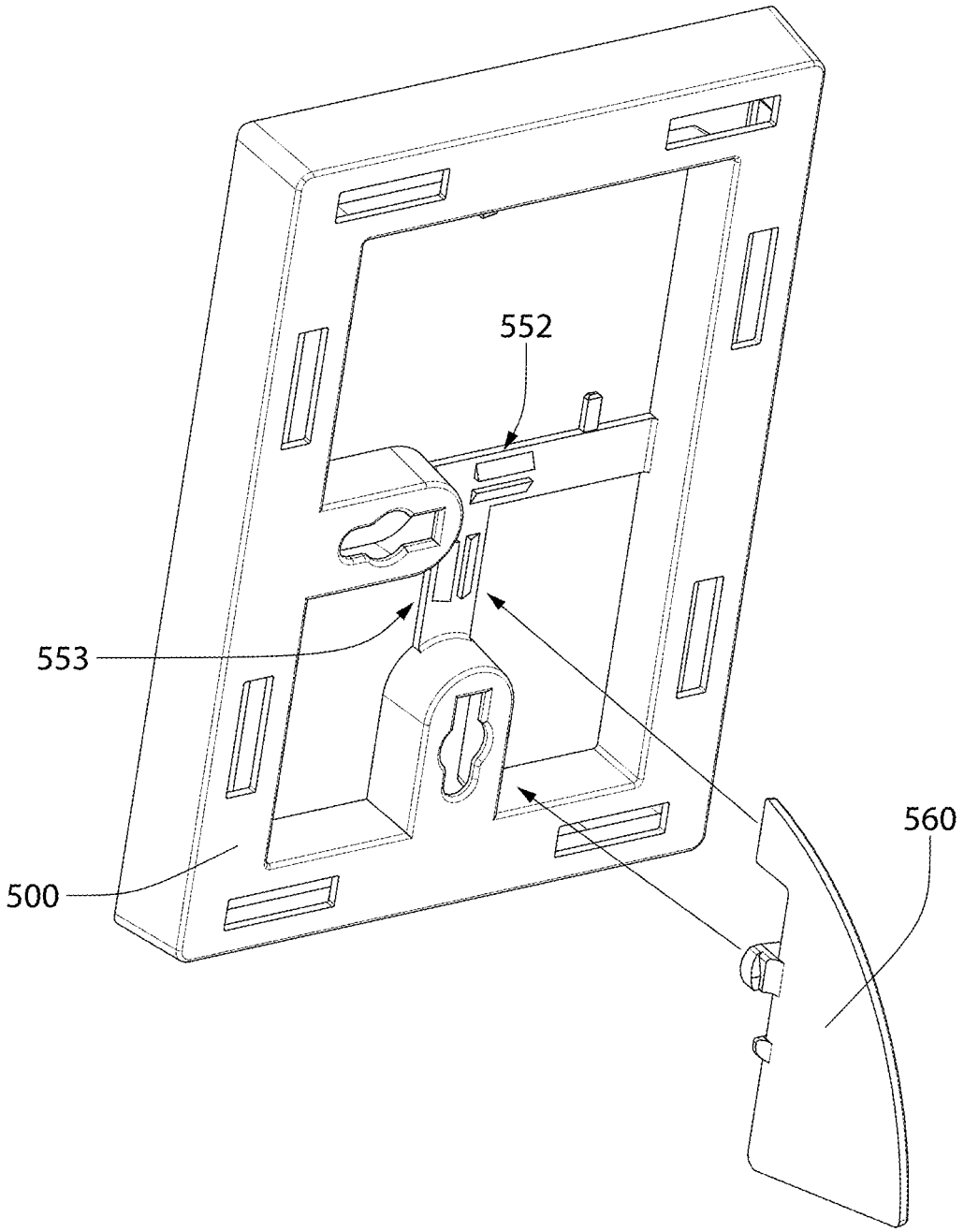
Figure 19B:
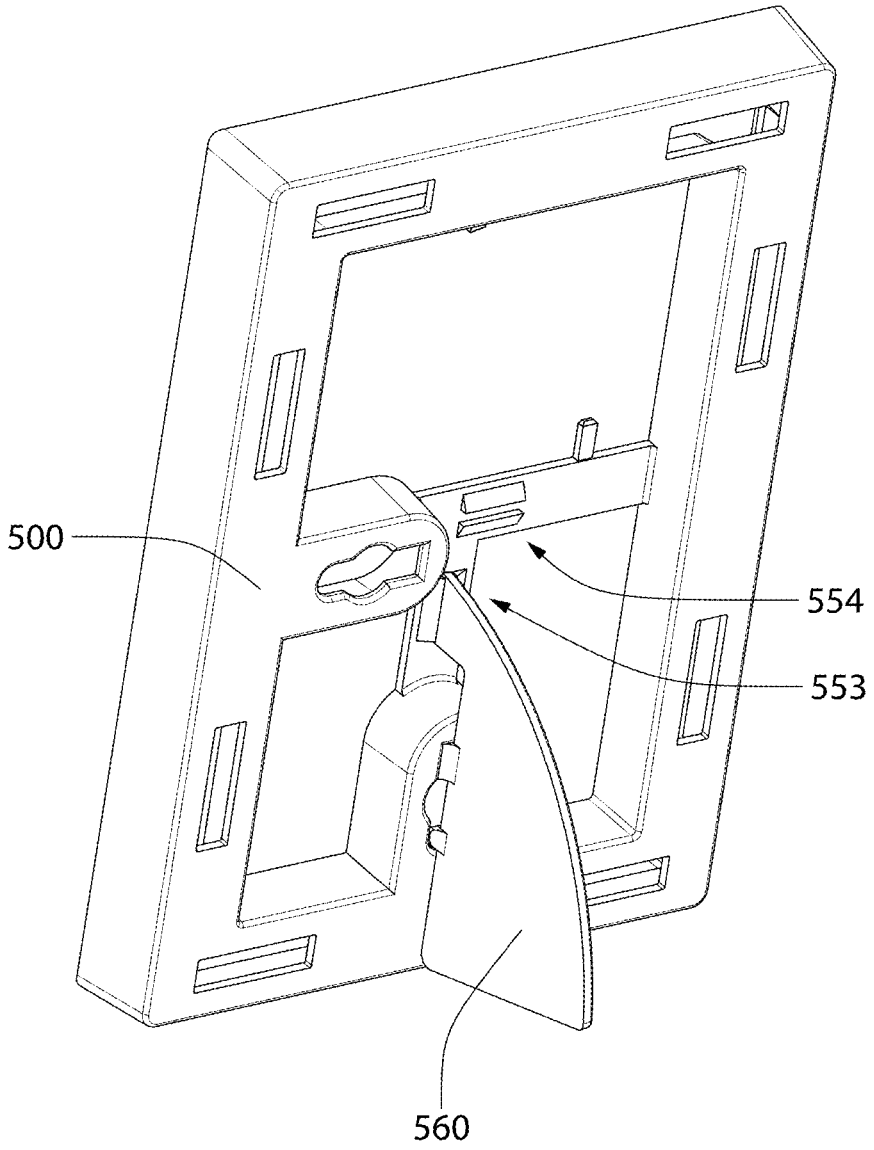
Figure 20A:
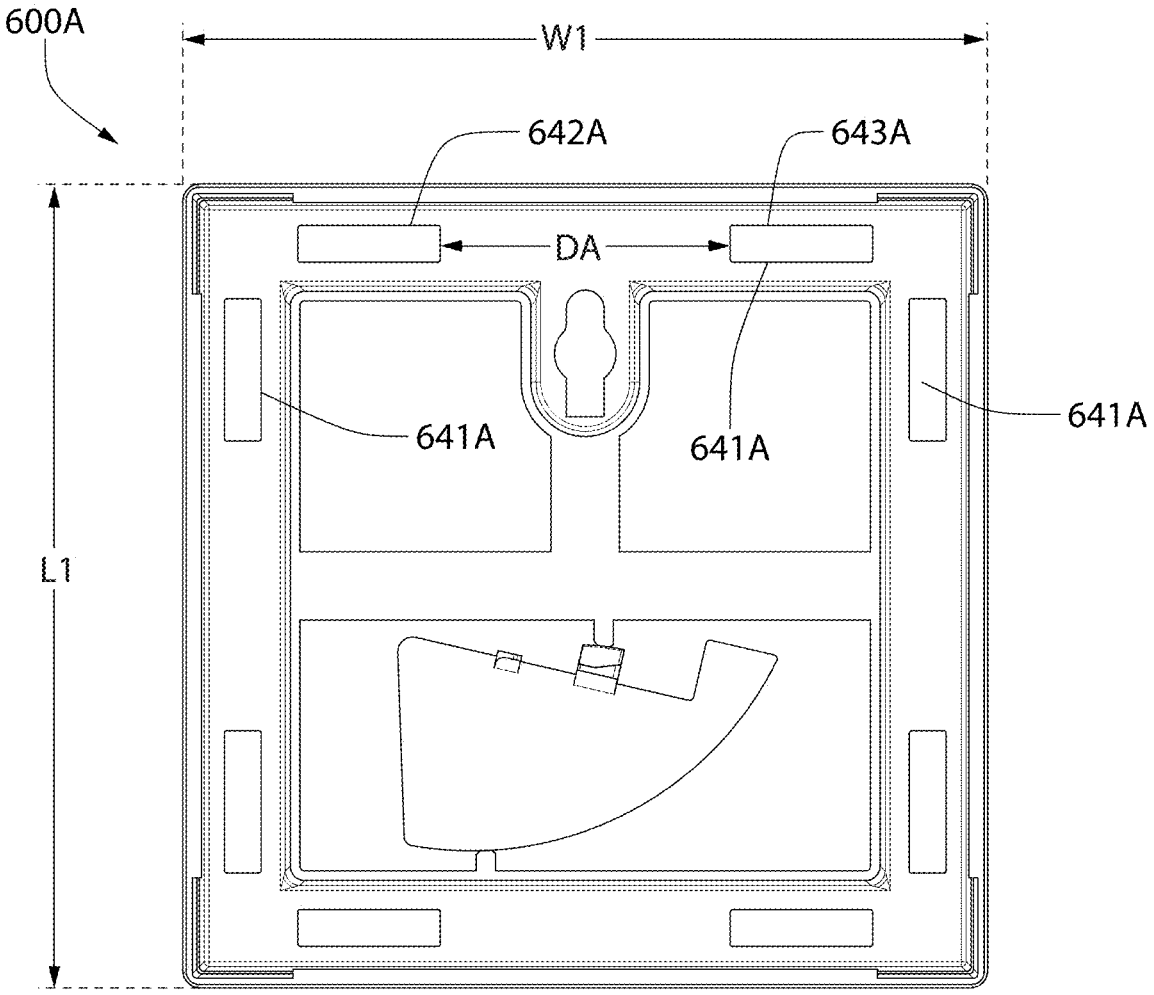
Figure 20B:
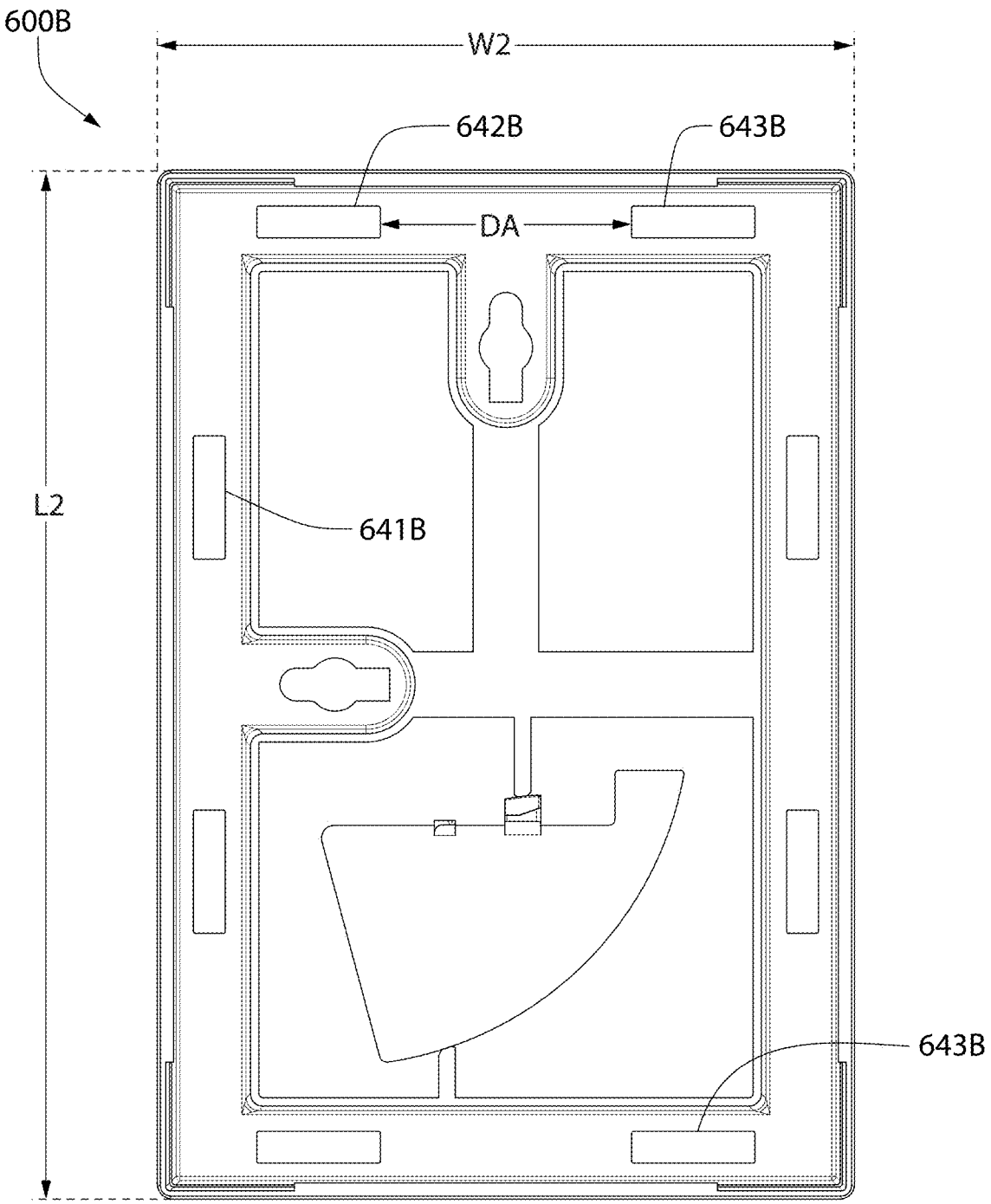
Figure 20C:
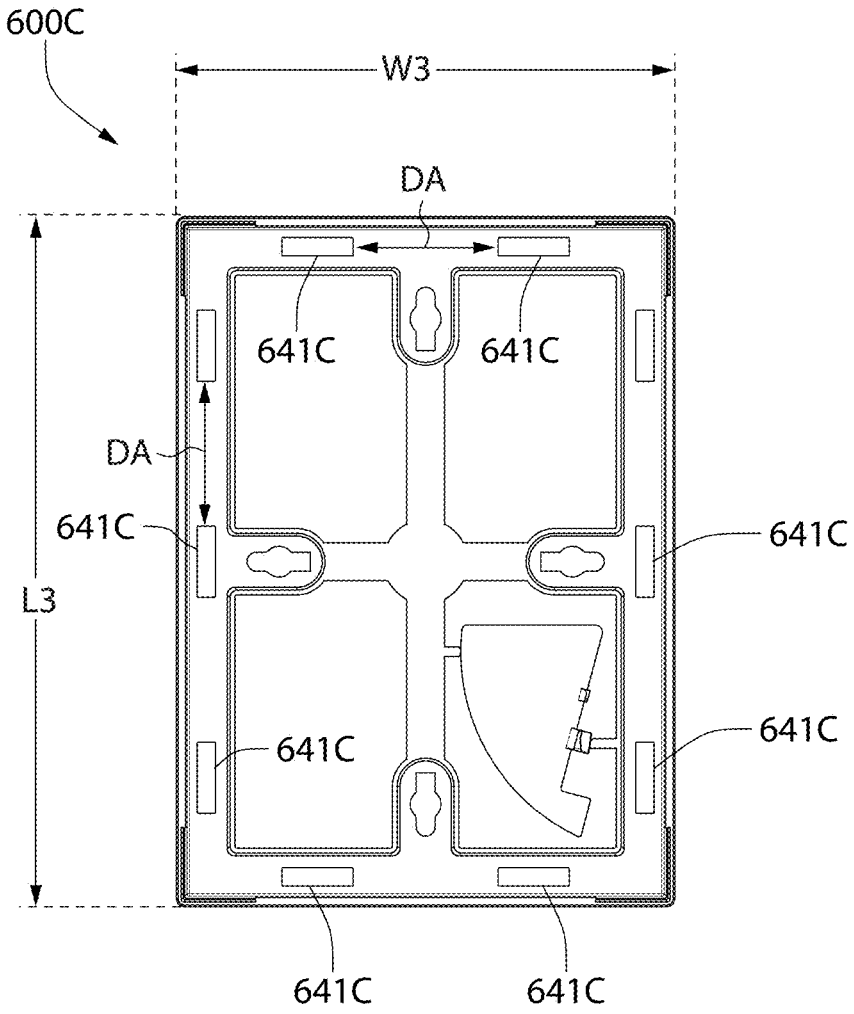
Figure 20D:
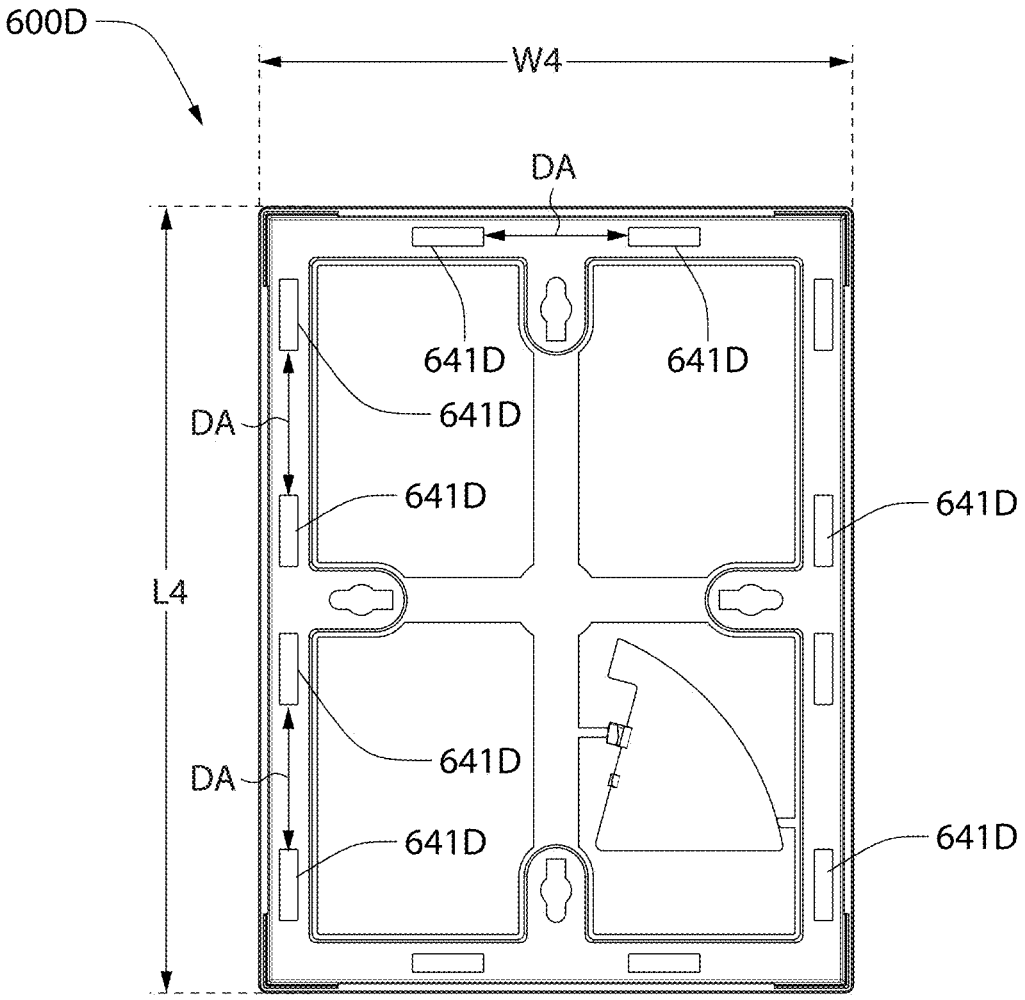
Figure 20E:
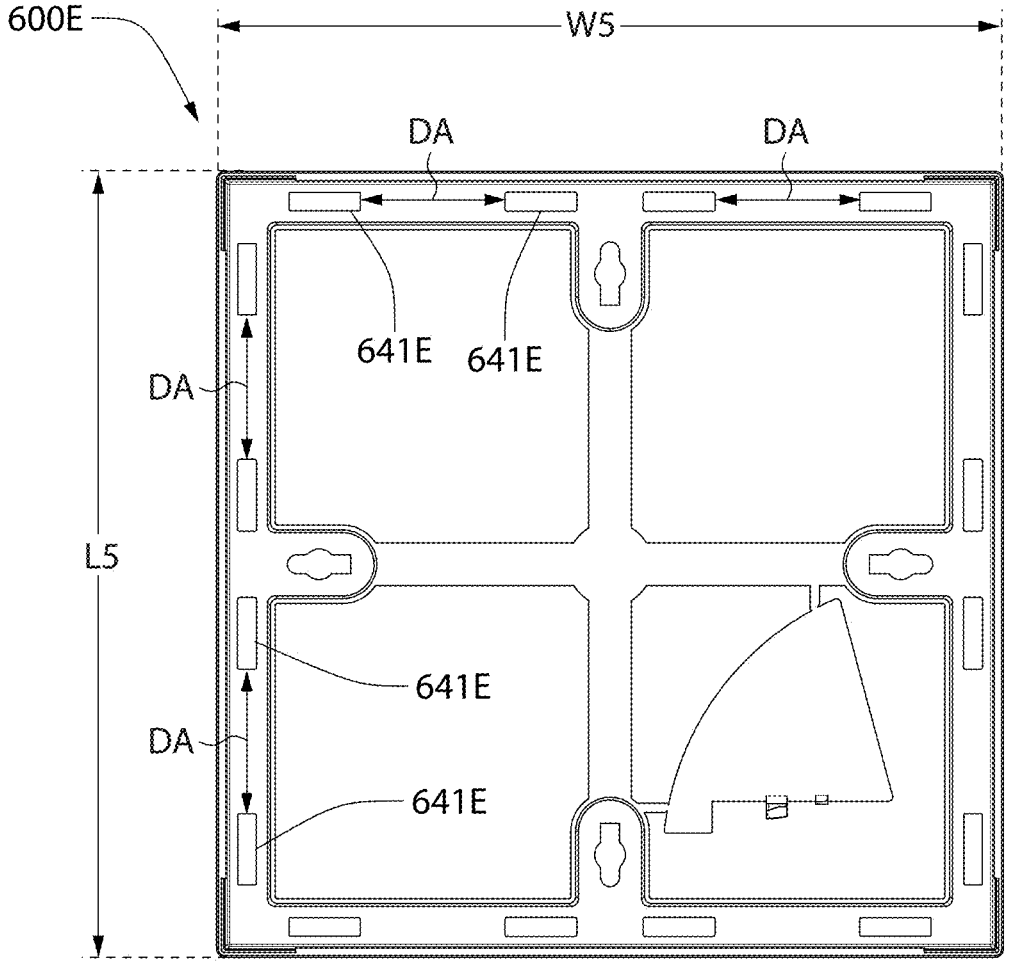
Figure 20F:
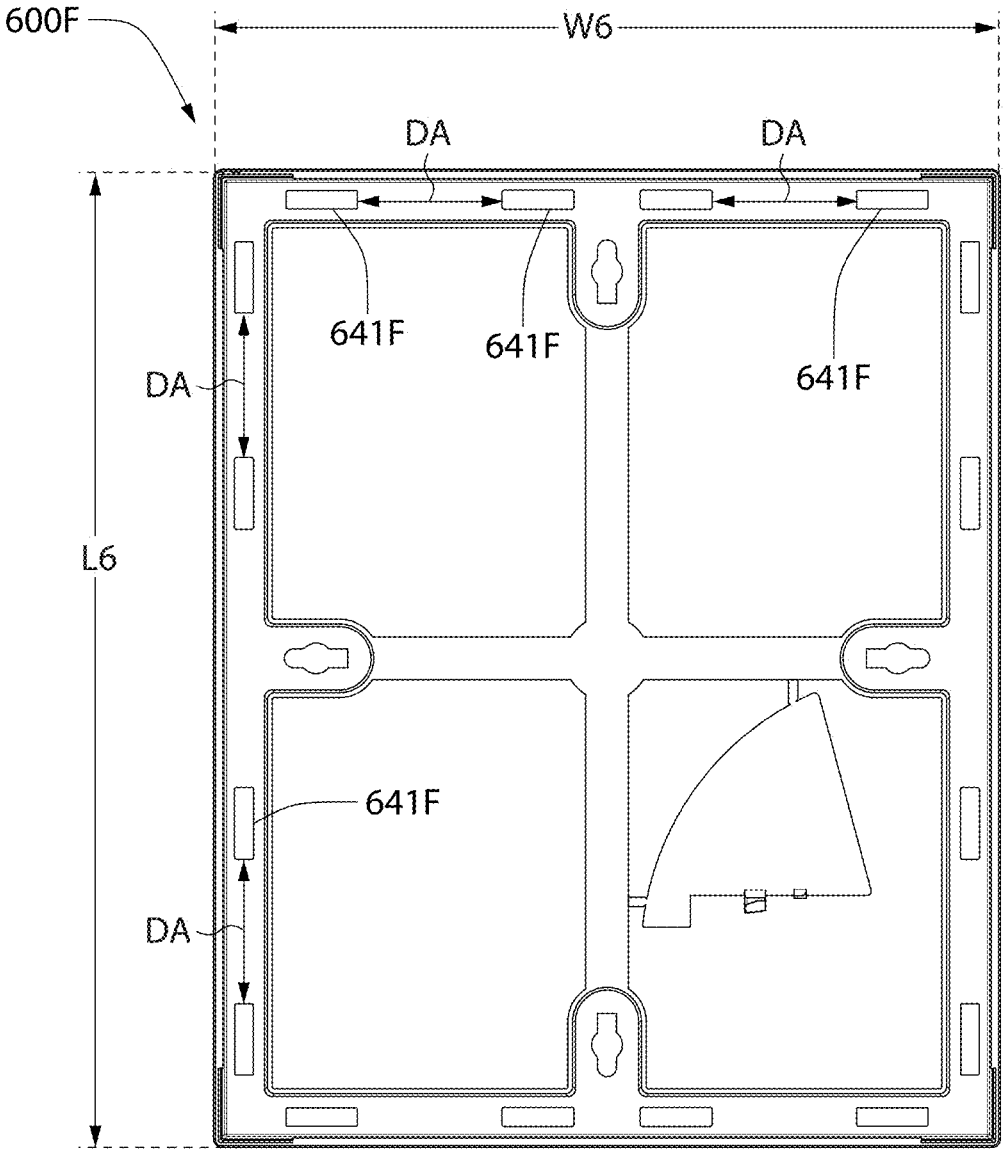
Figure 20G:
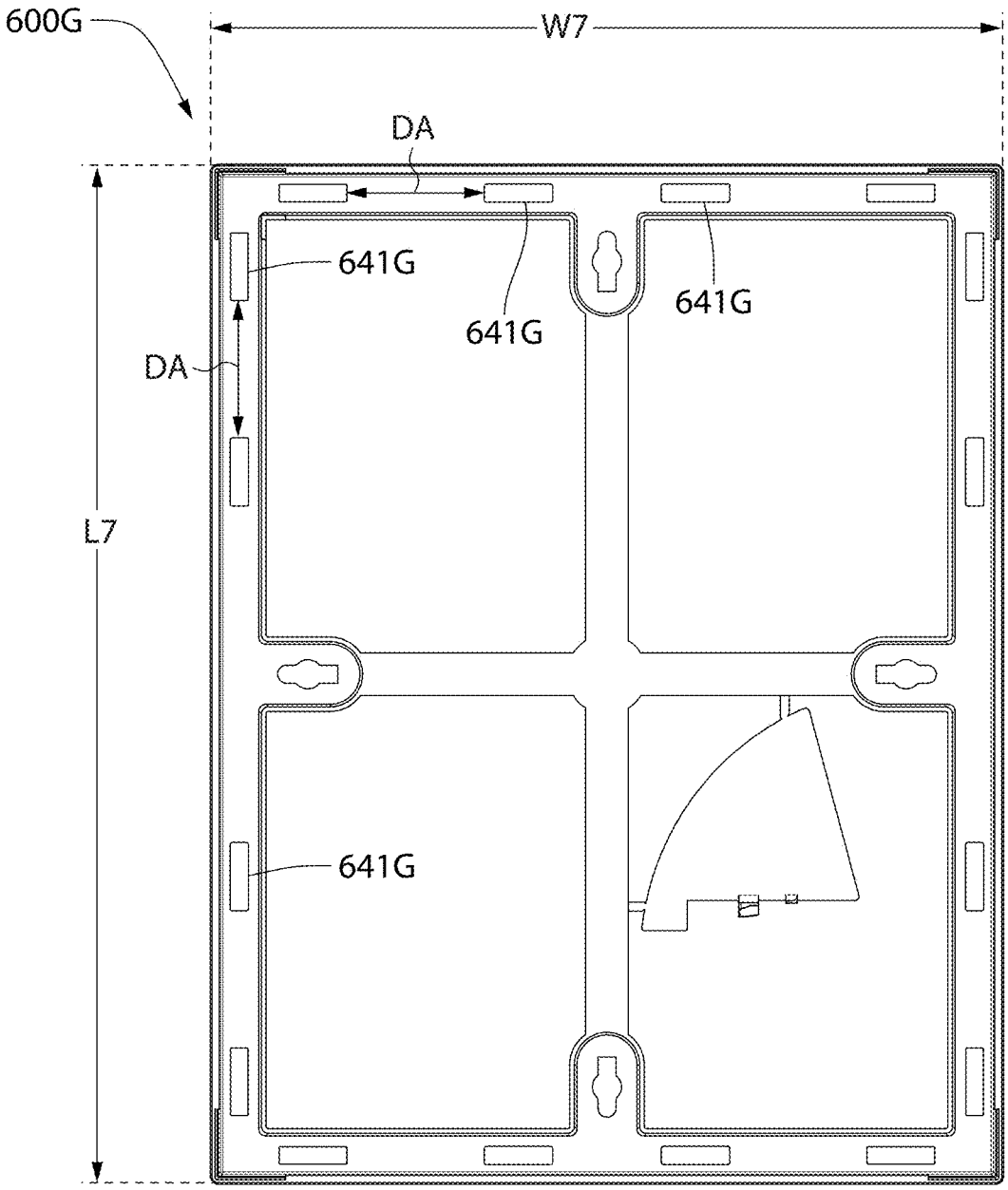
Figure 20H:
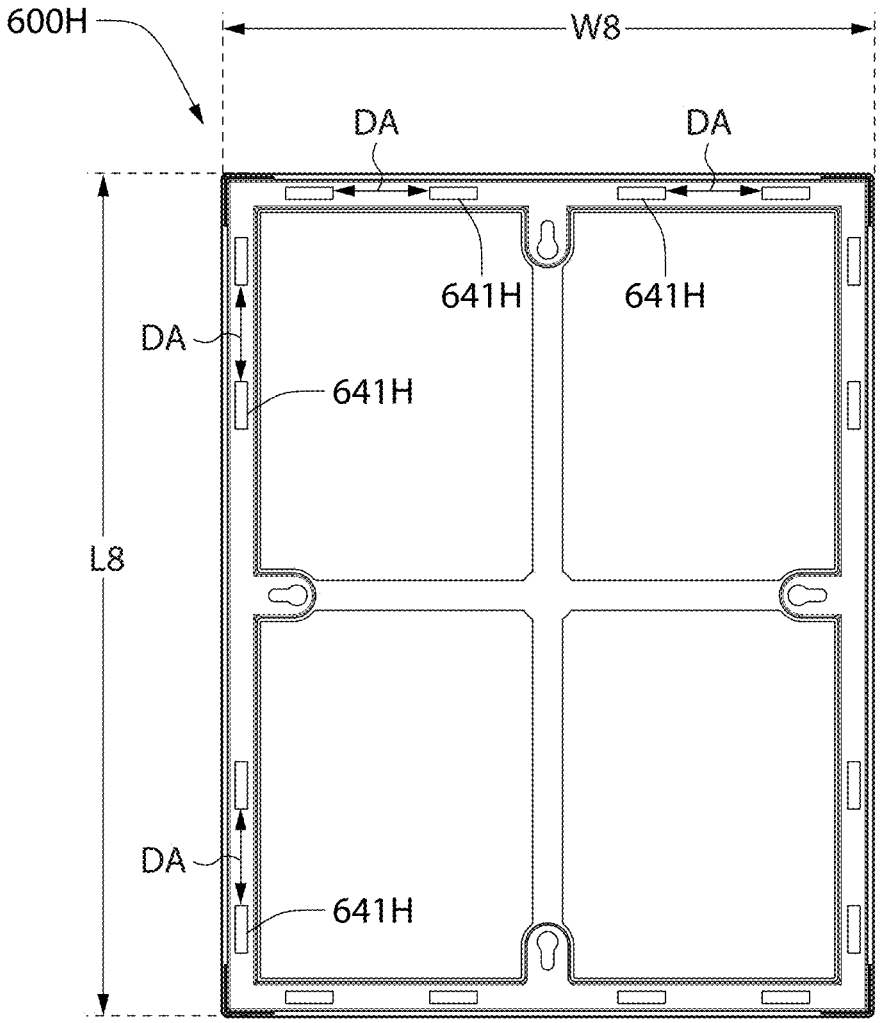
Figure 20I:
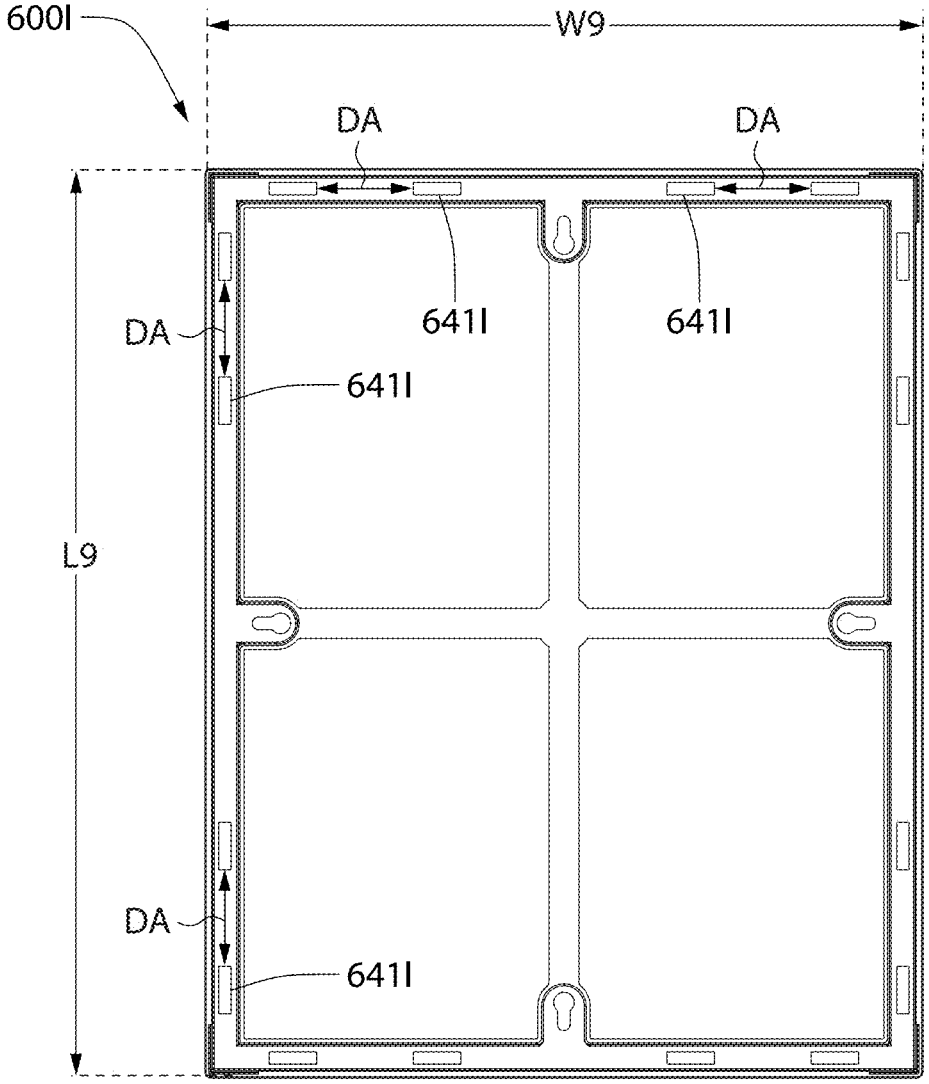
Figure 20J:
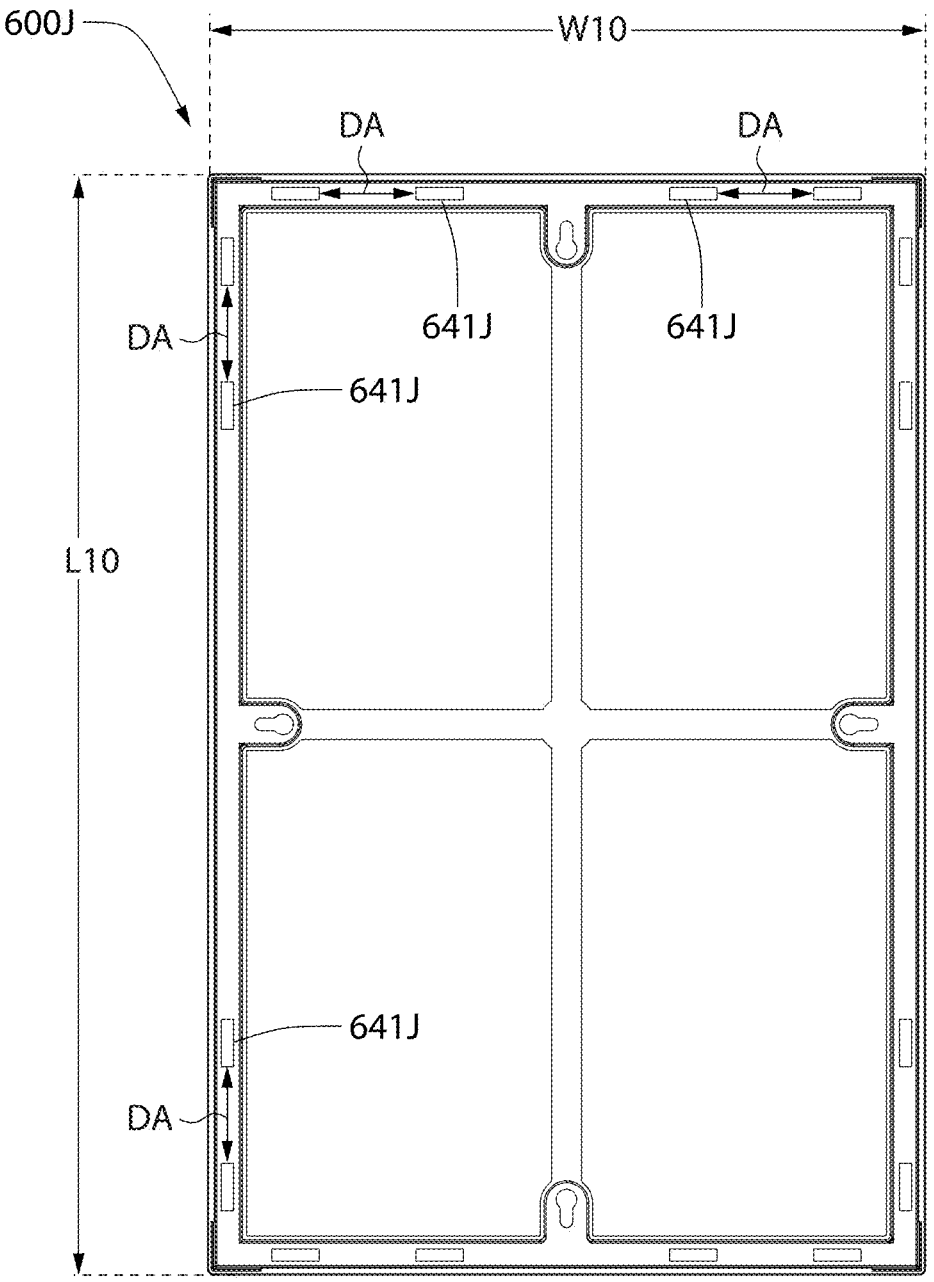
Figure 20K:
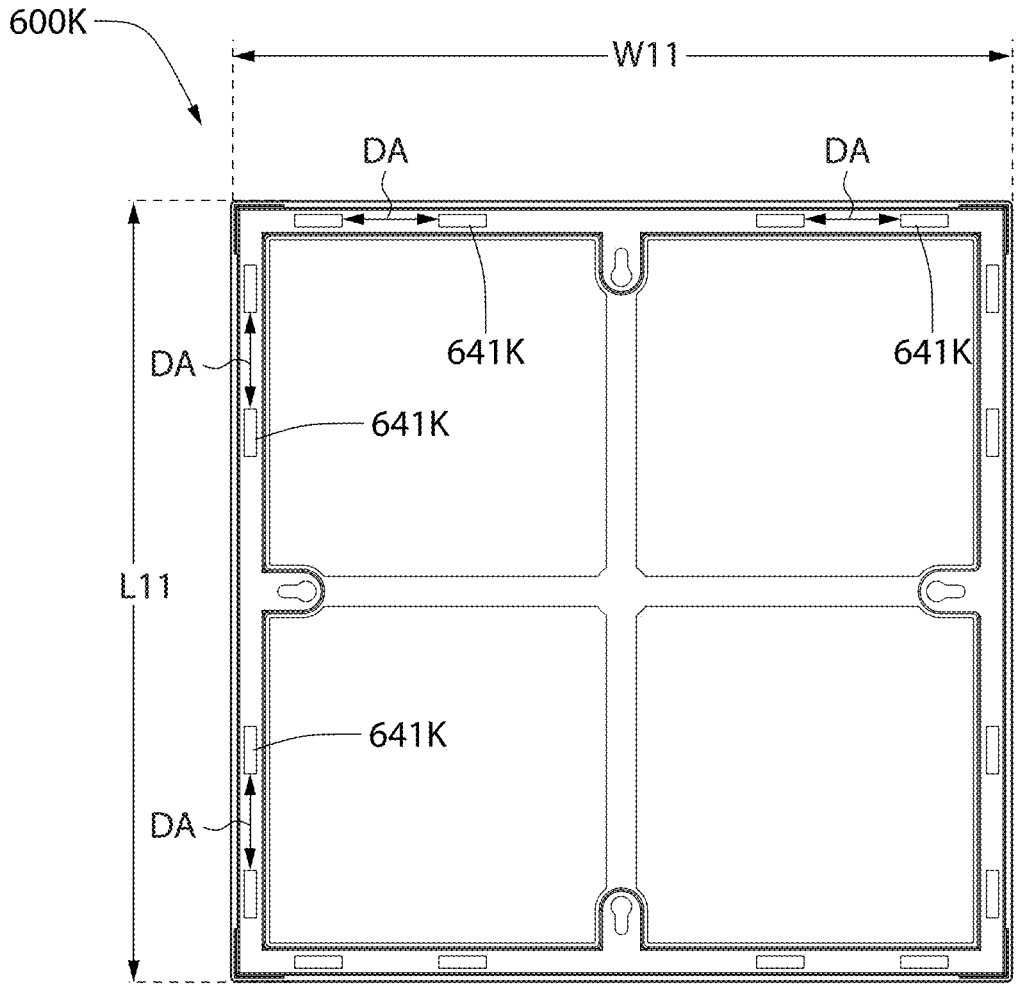
Figure 20L:
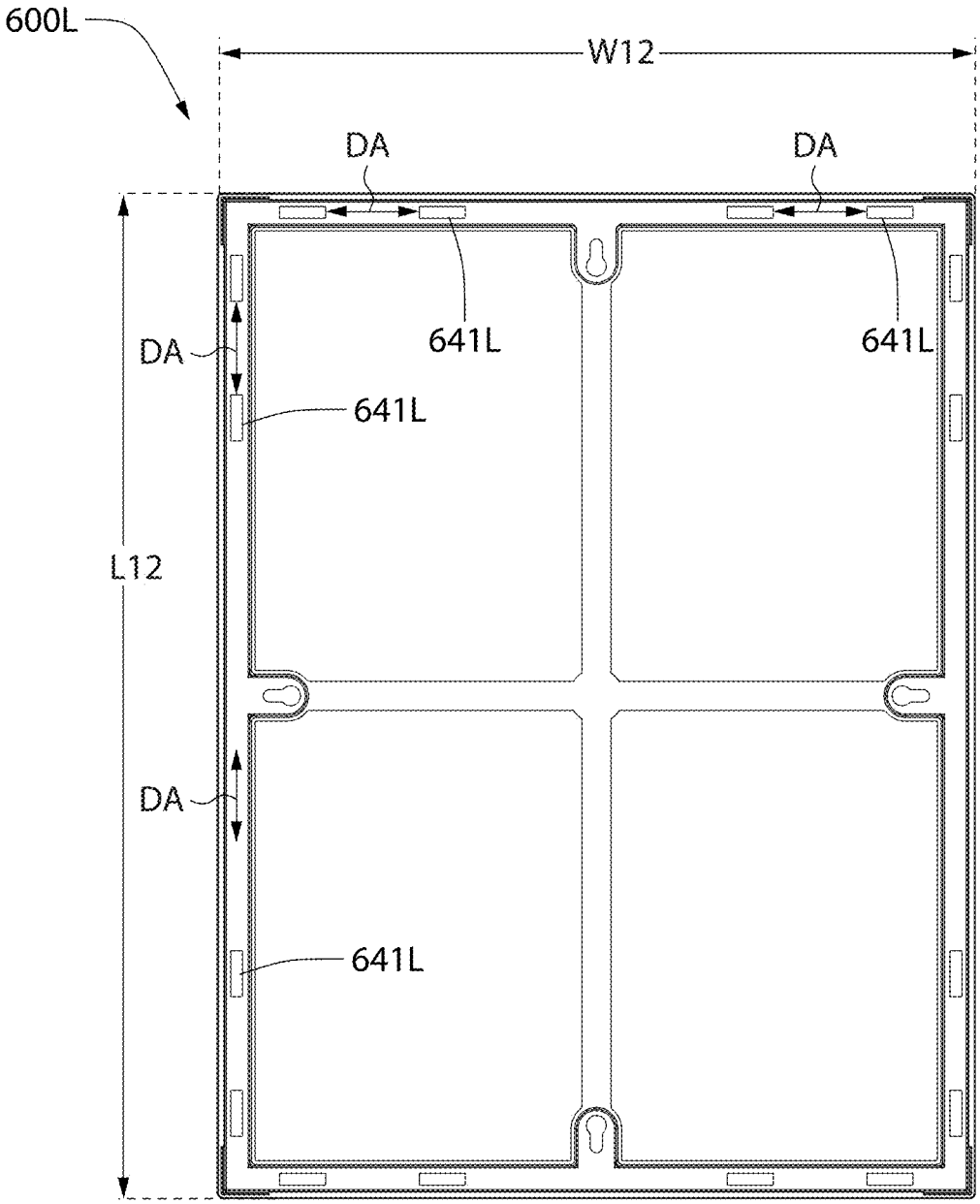
Figure 20M:
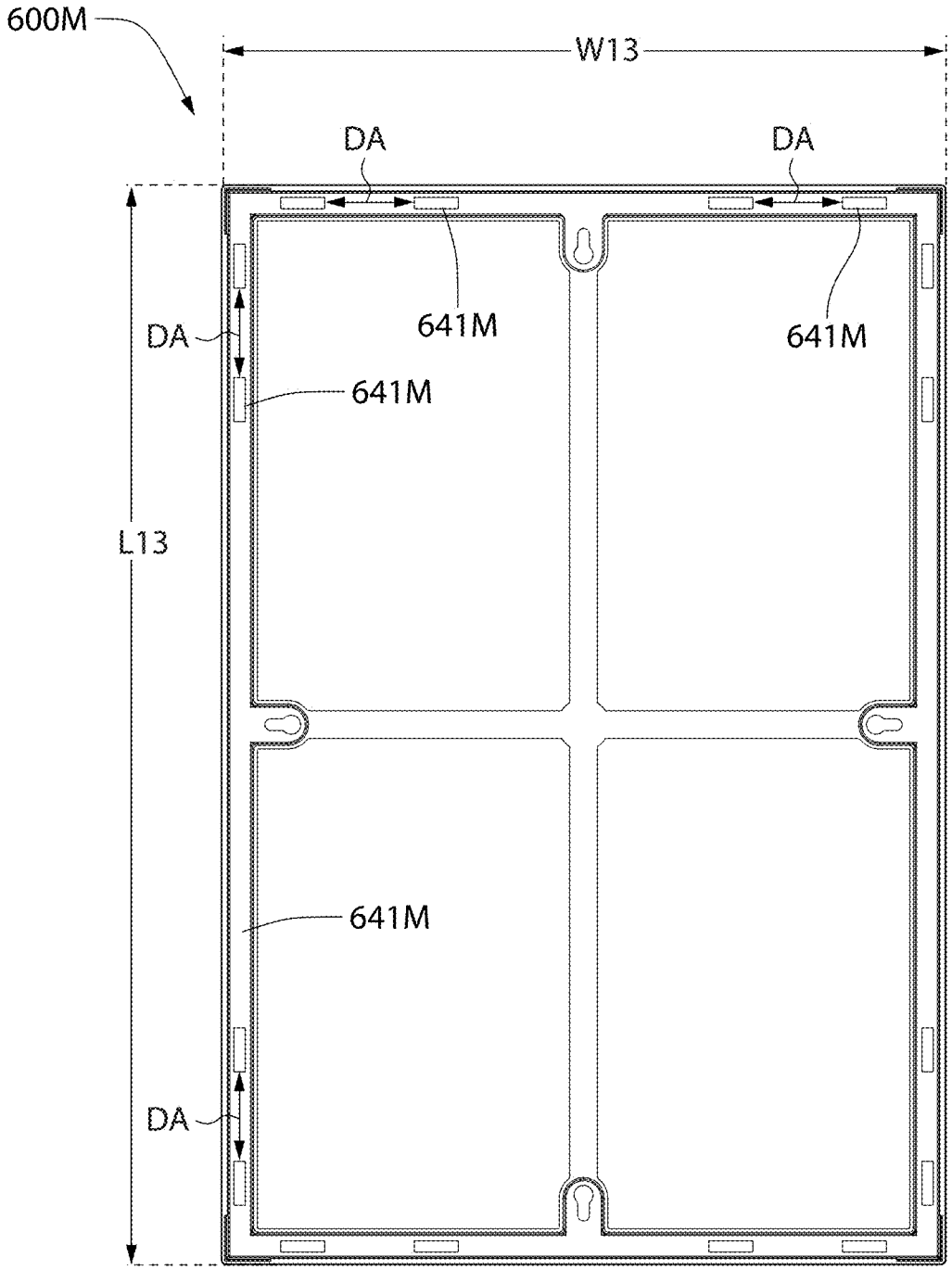
Figure 20N:
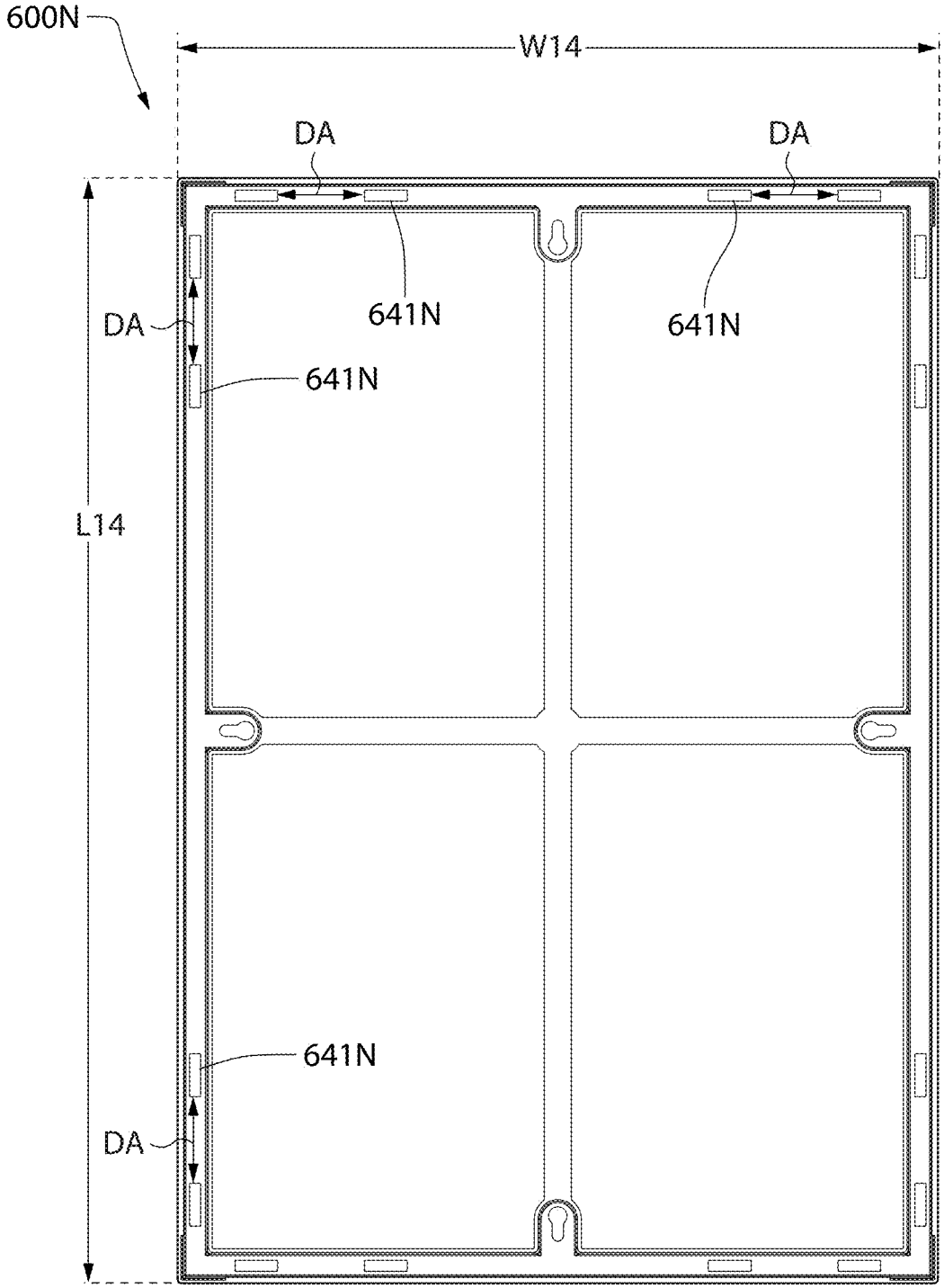
Figure 20O:
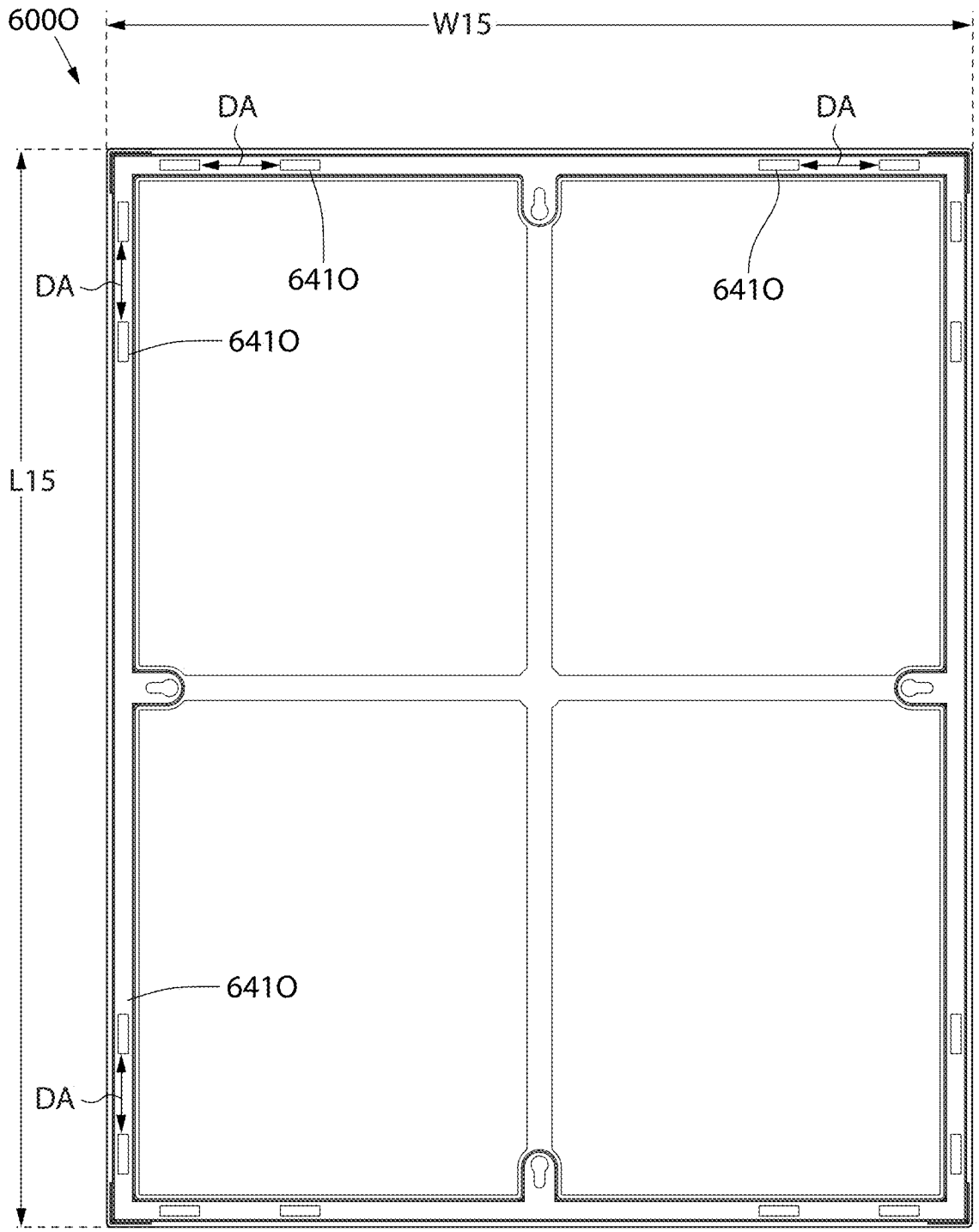
Figure 21A:
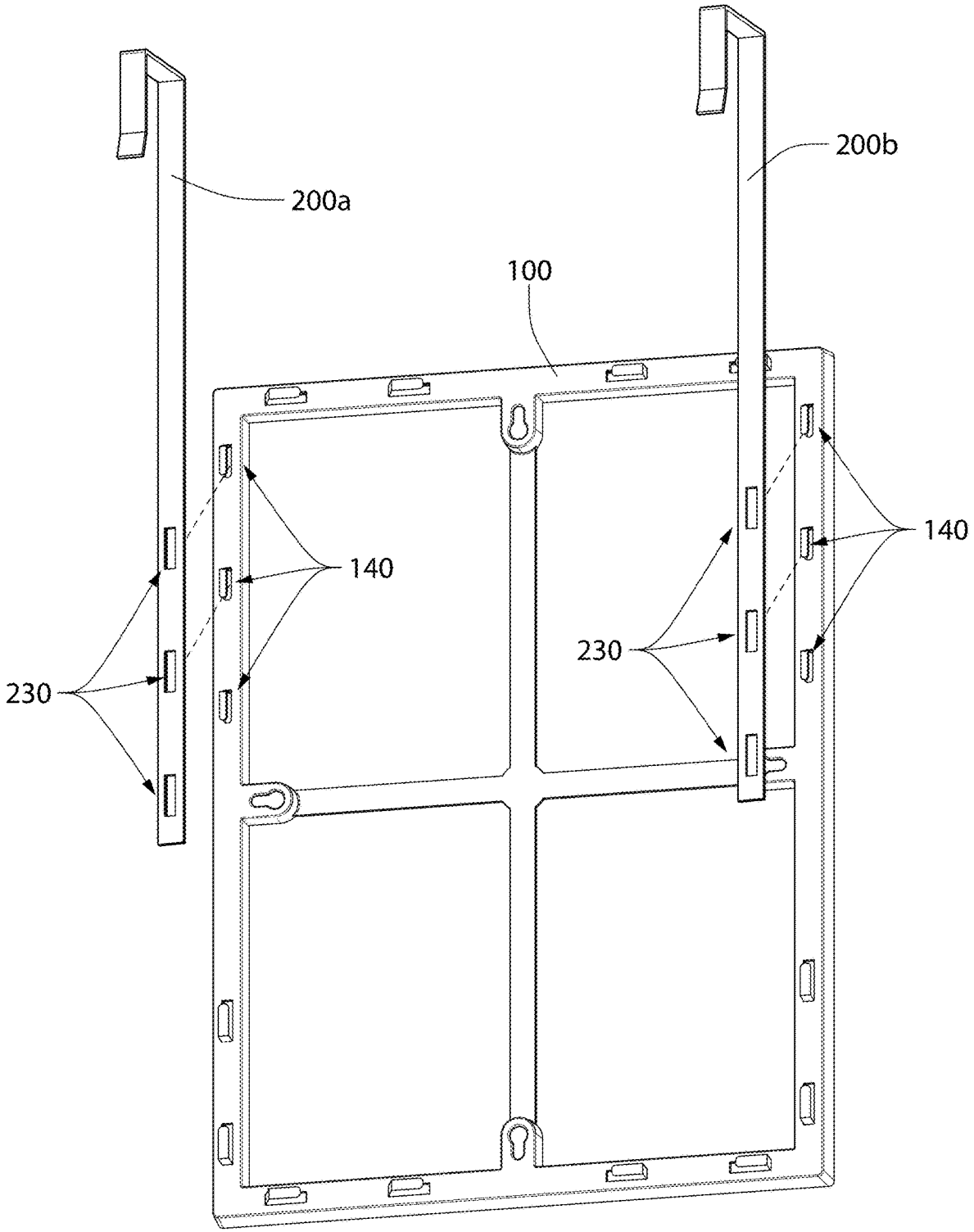
Figure 21B:
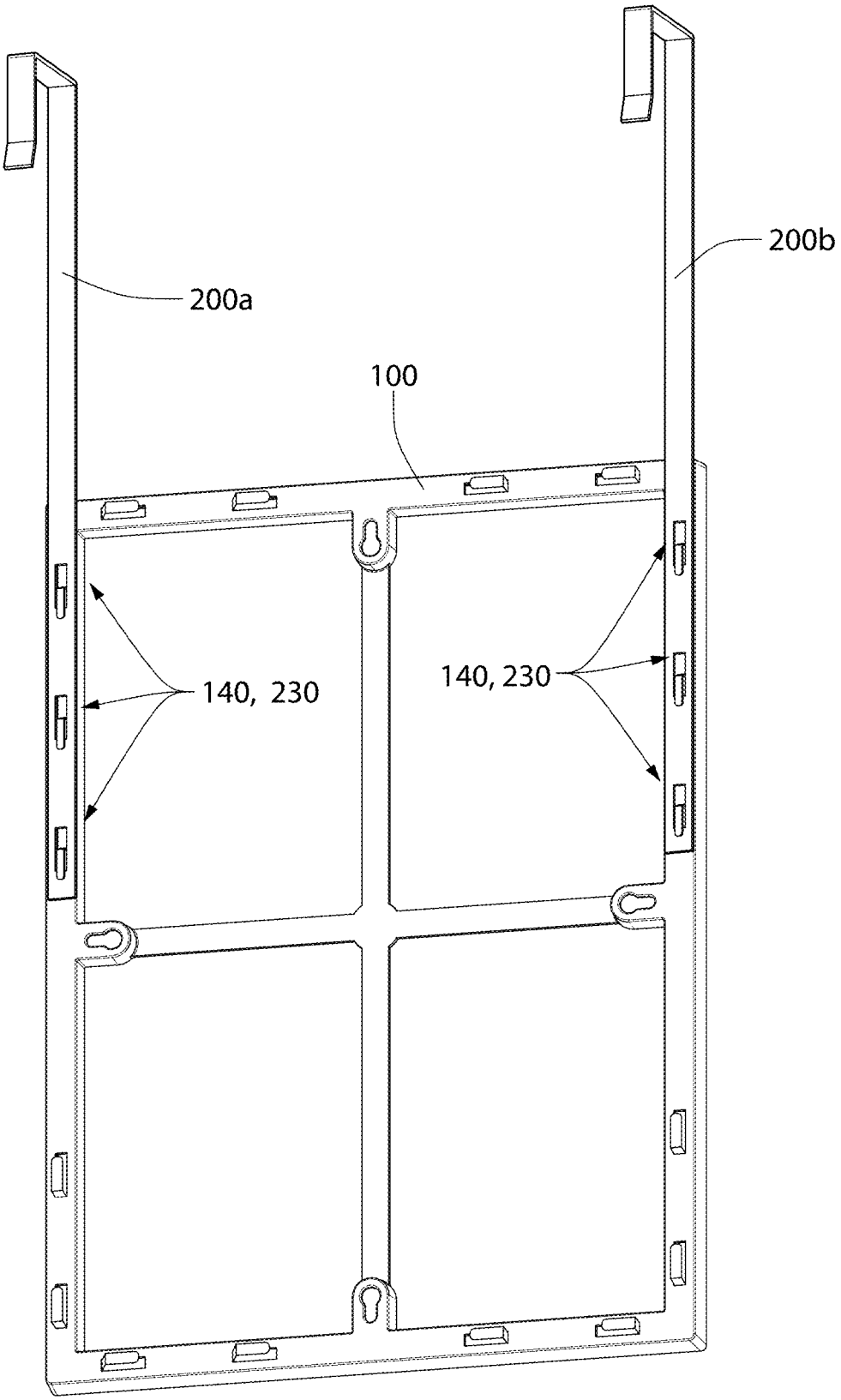
Figure 22:
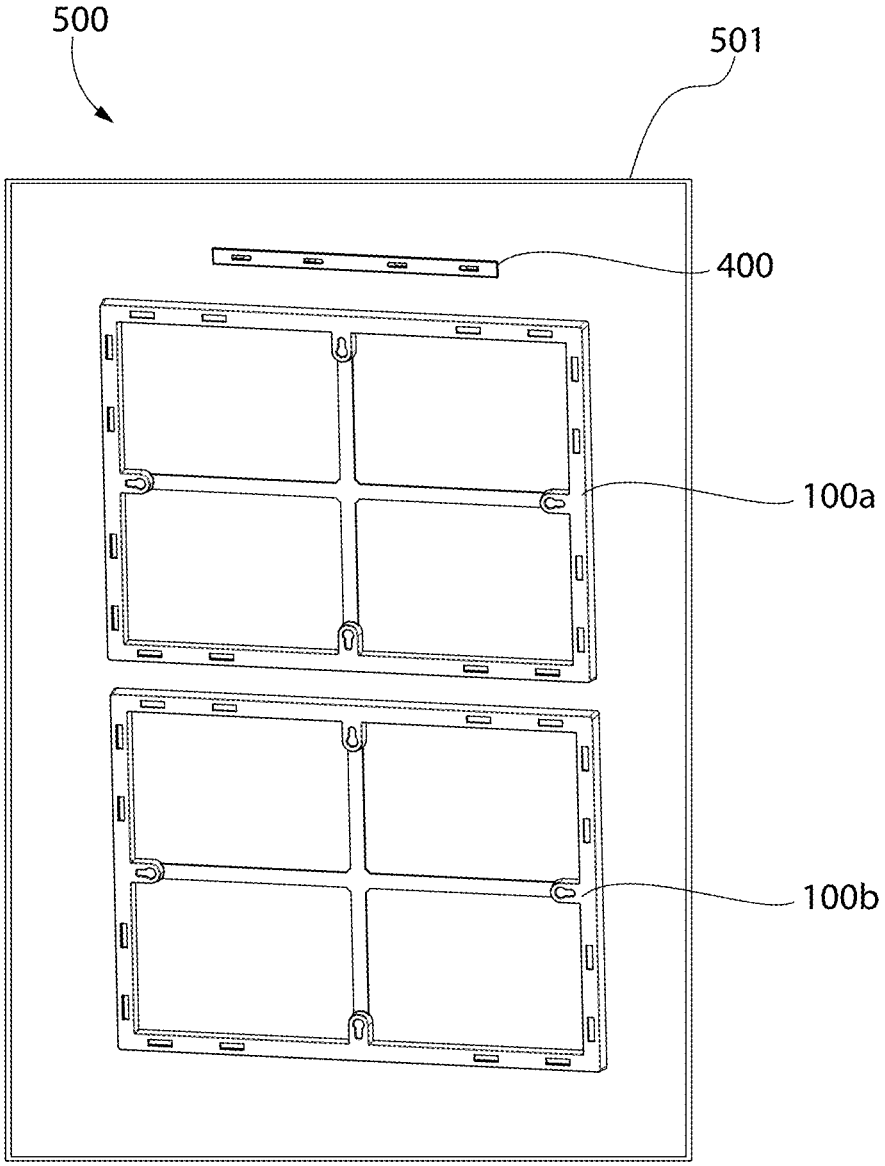
Figure 23:
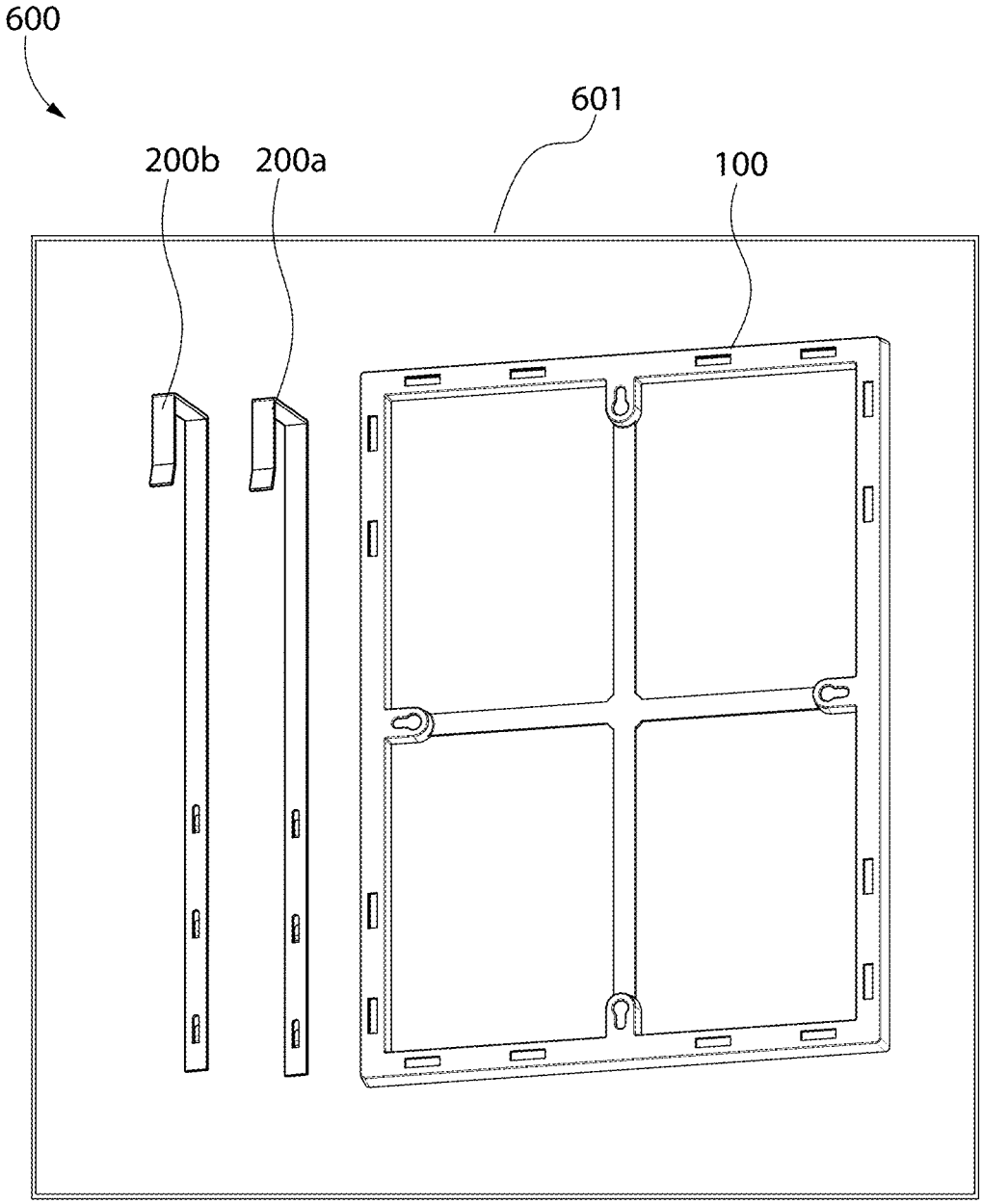
Figure 24A:
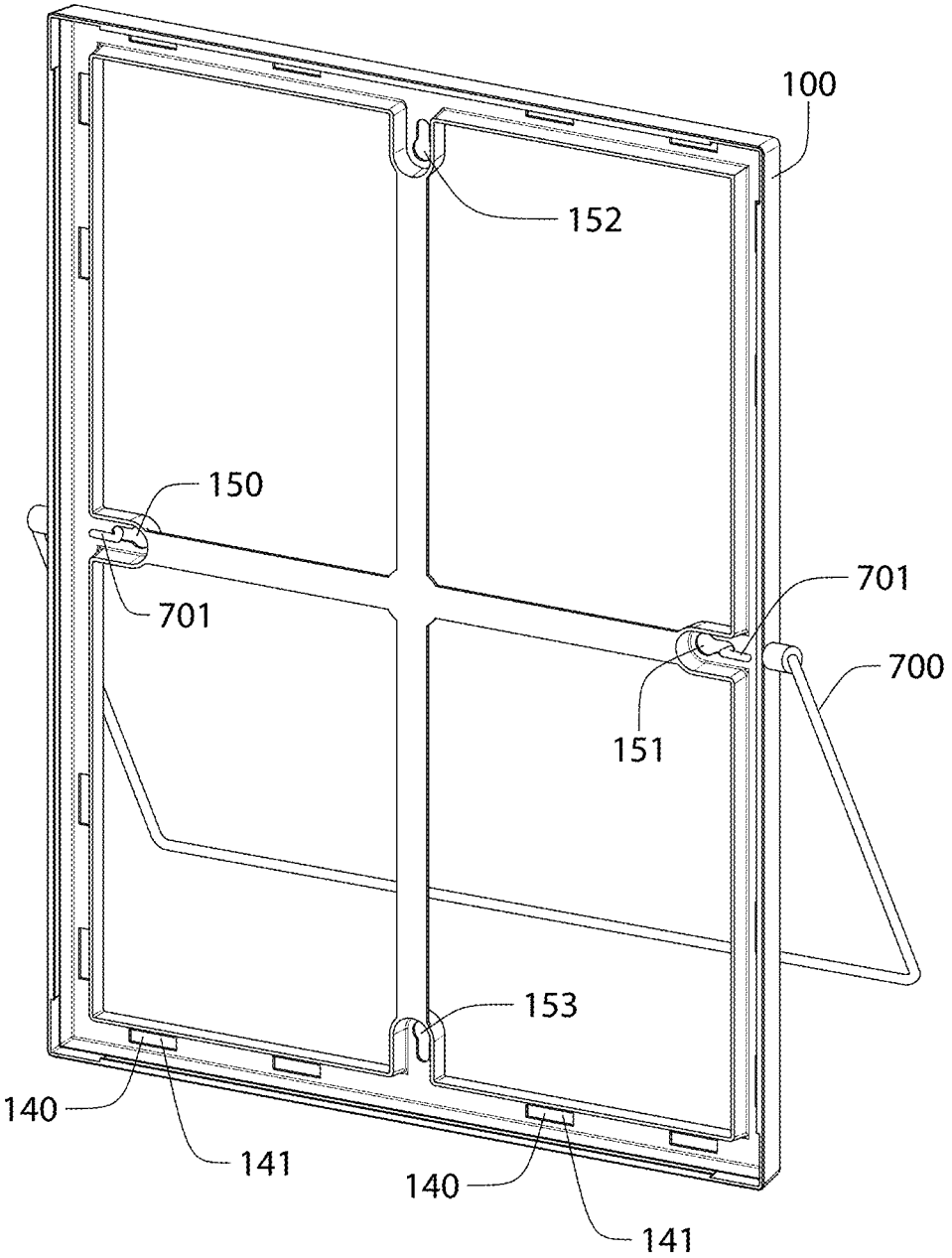
Figure 24B:
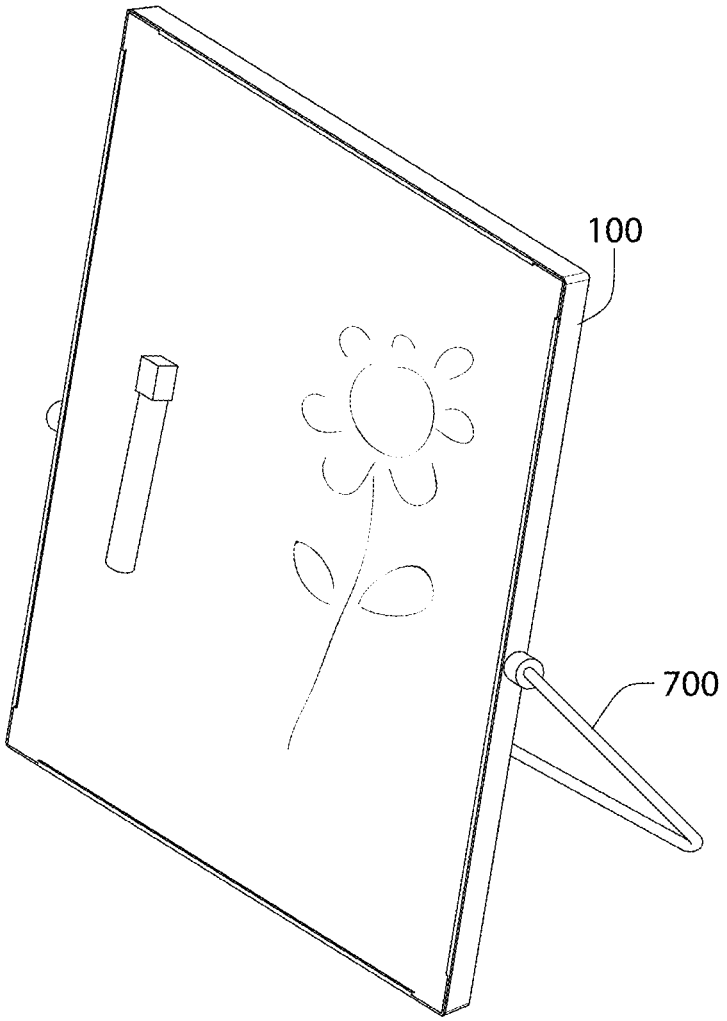
Figure 25A:
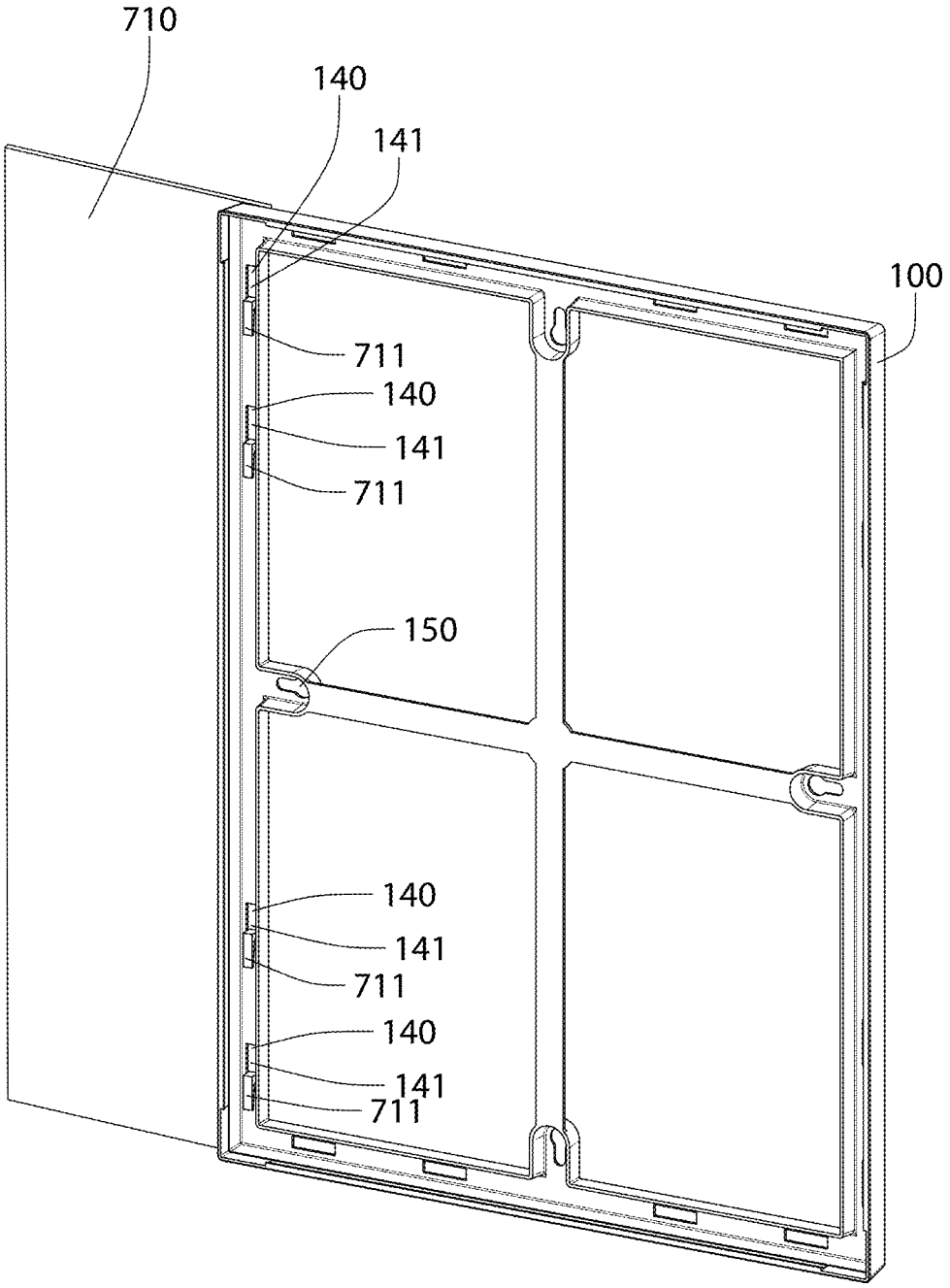
Figure 25B:
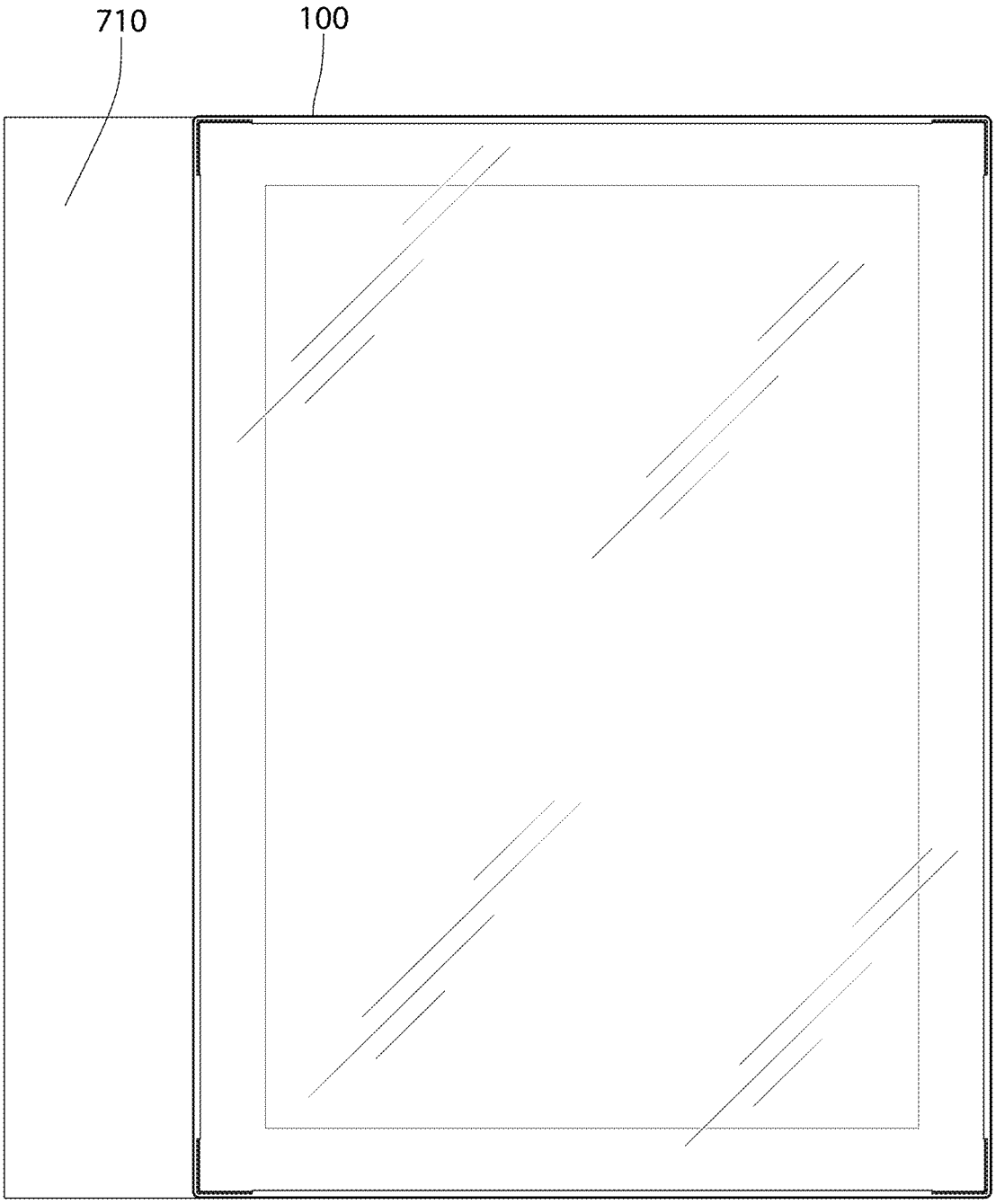
Figure 26:
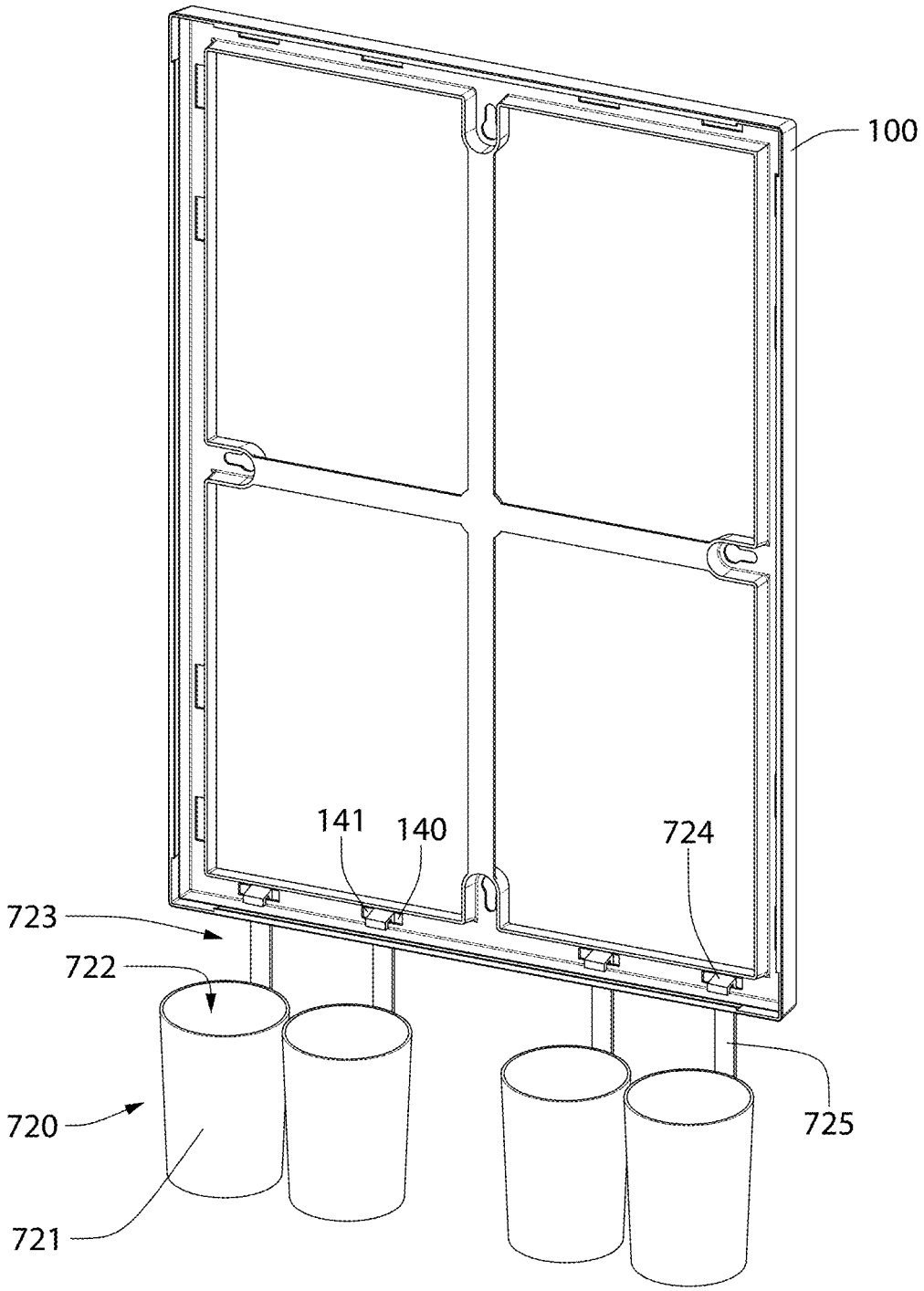
Figure 27:
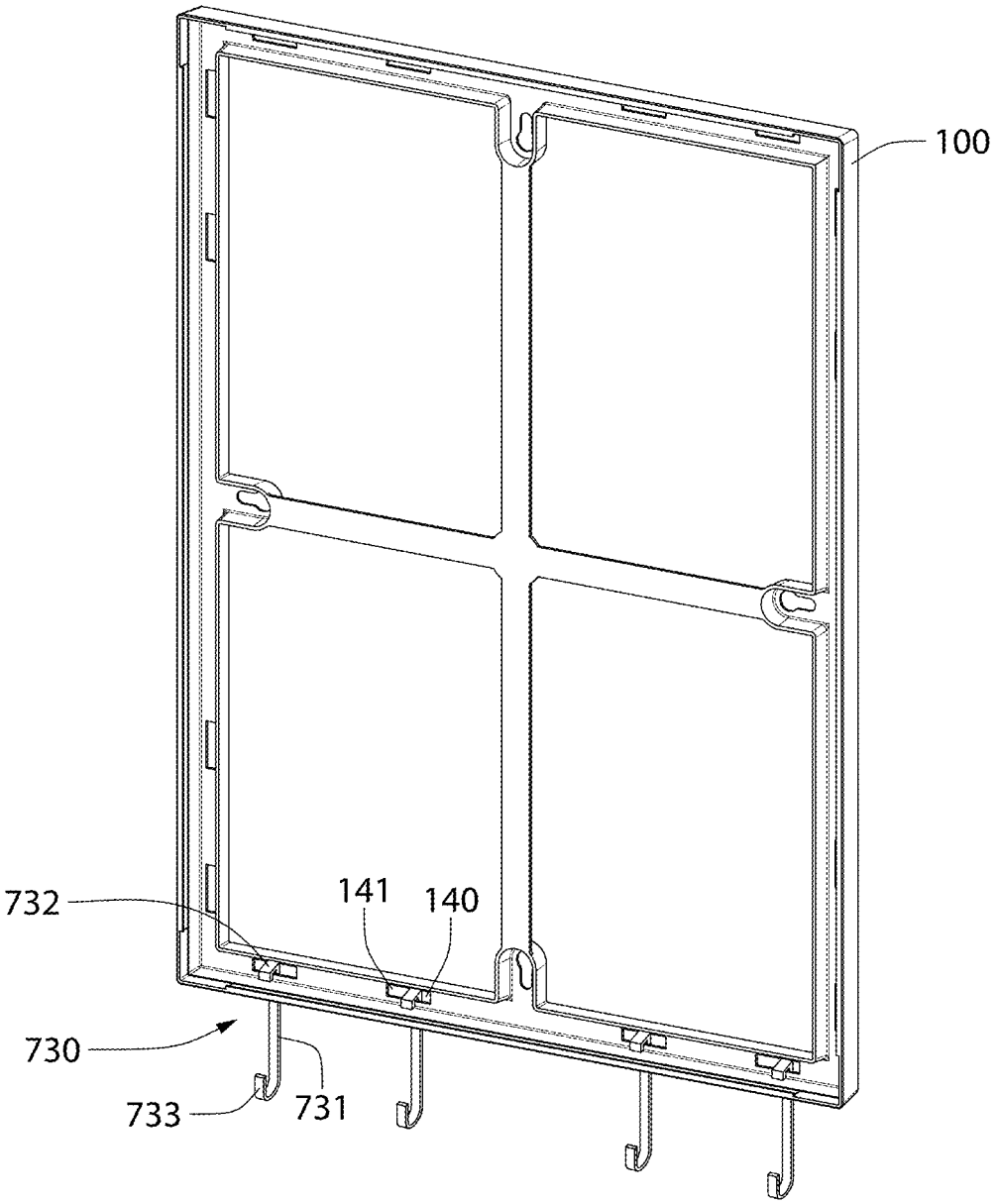
Figure 28:
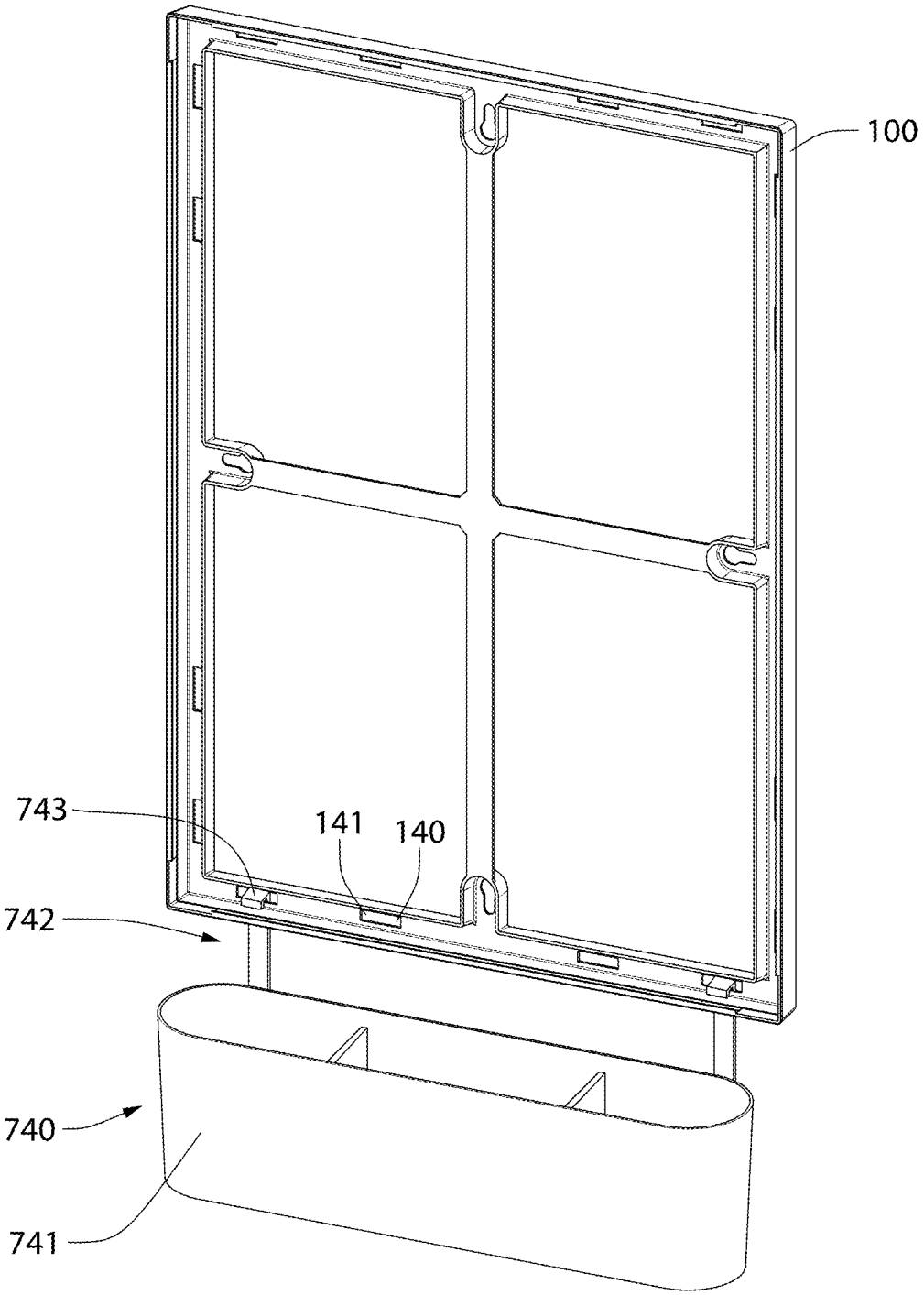
Figure 29:
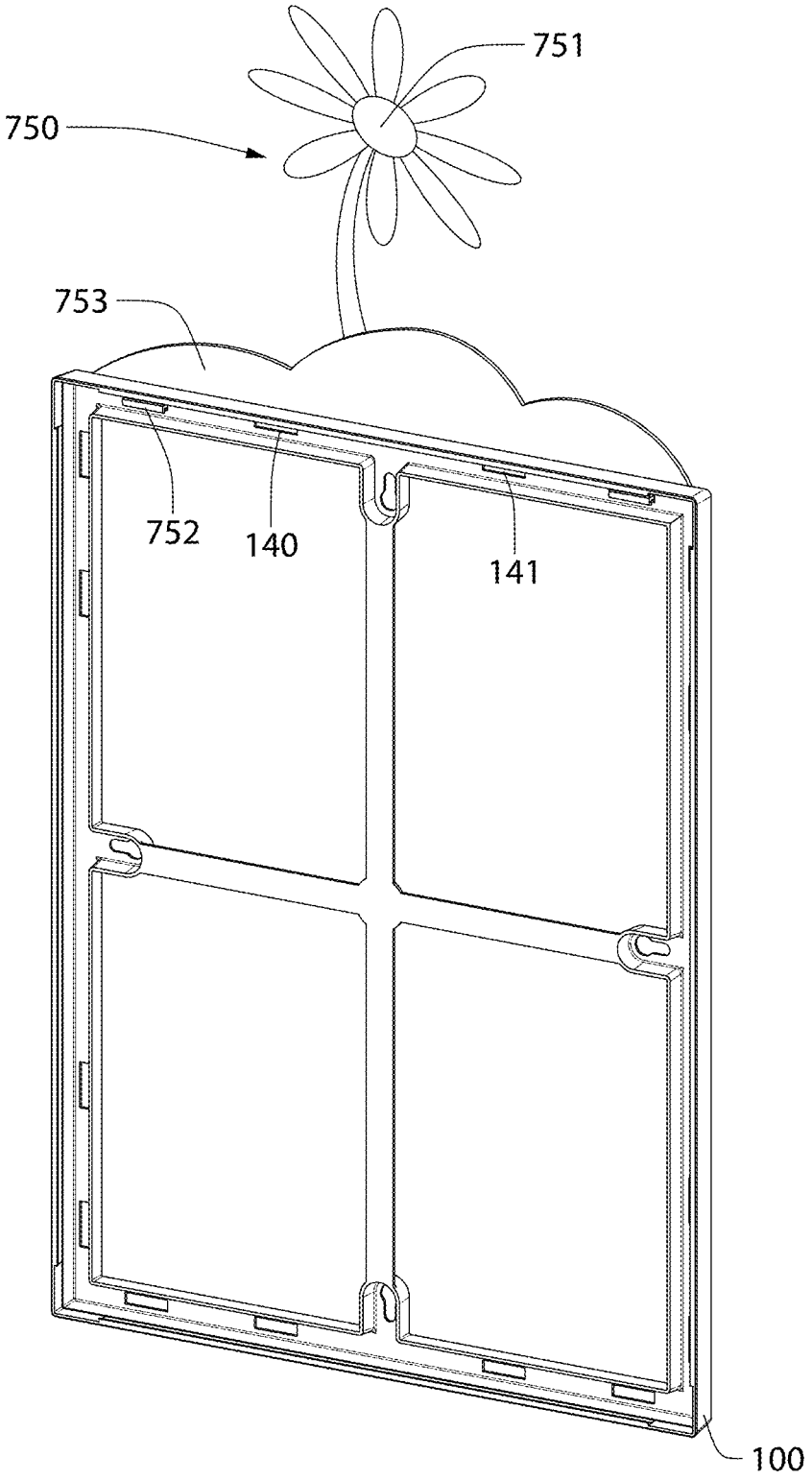
Figure 30A:
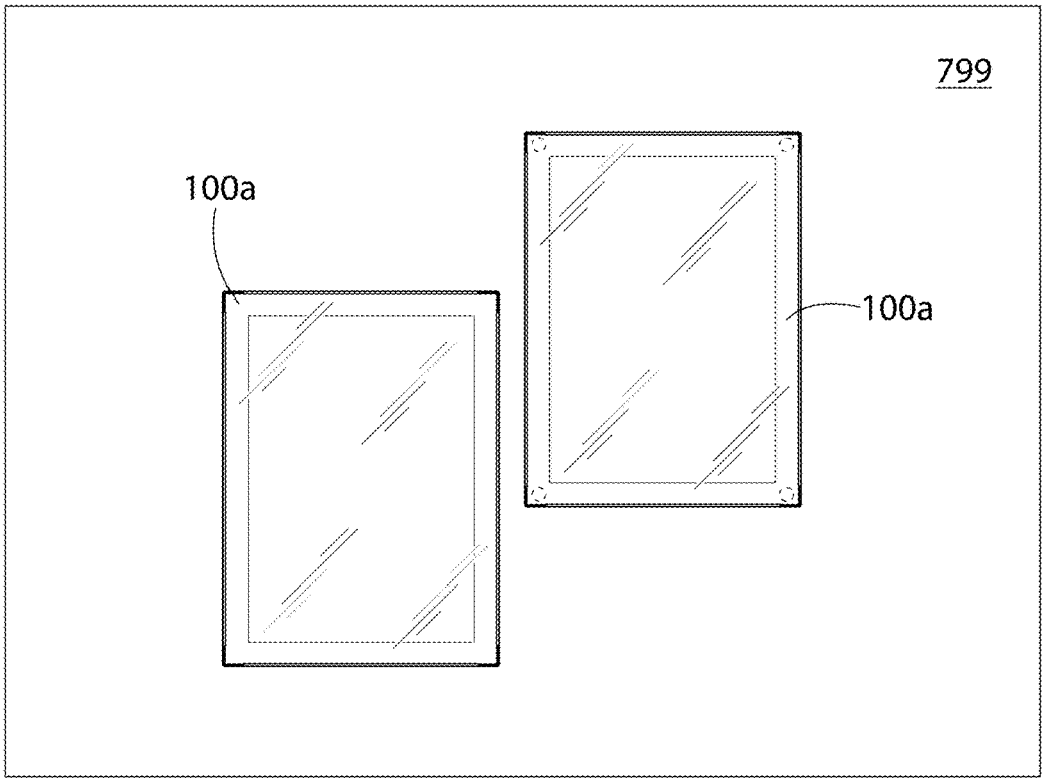
Figure 30B:
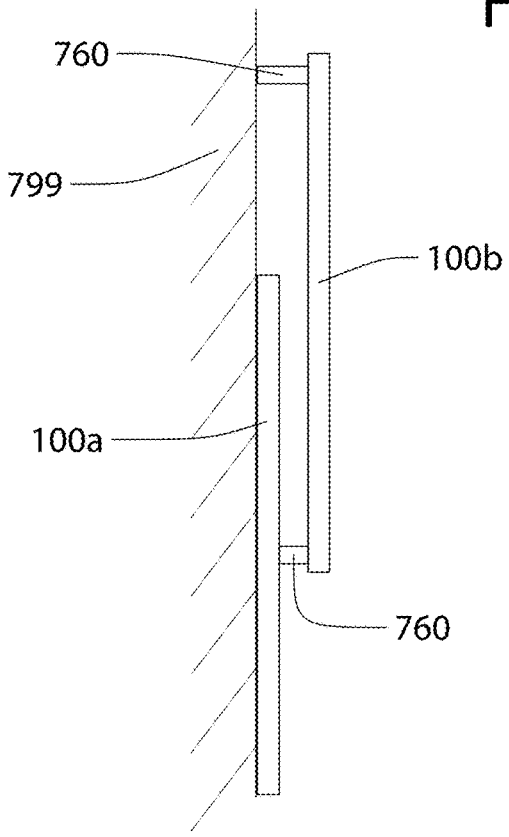
Figure 31:
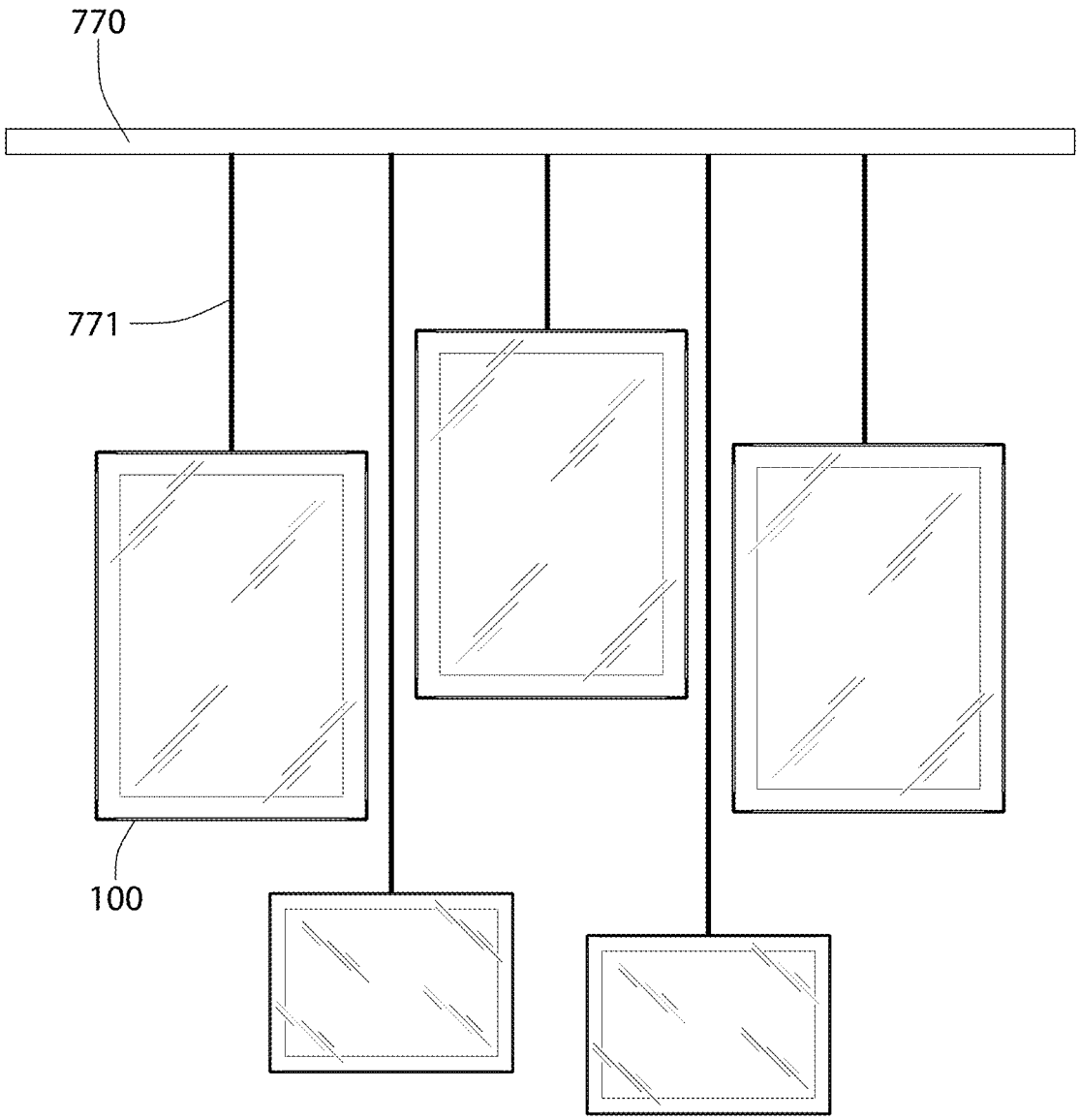
Figure 32:
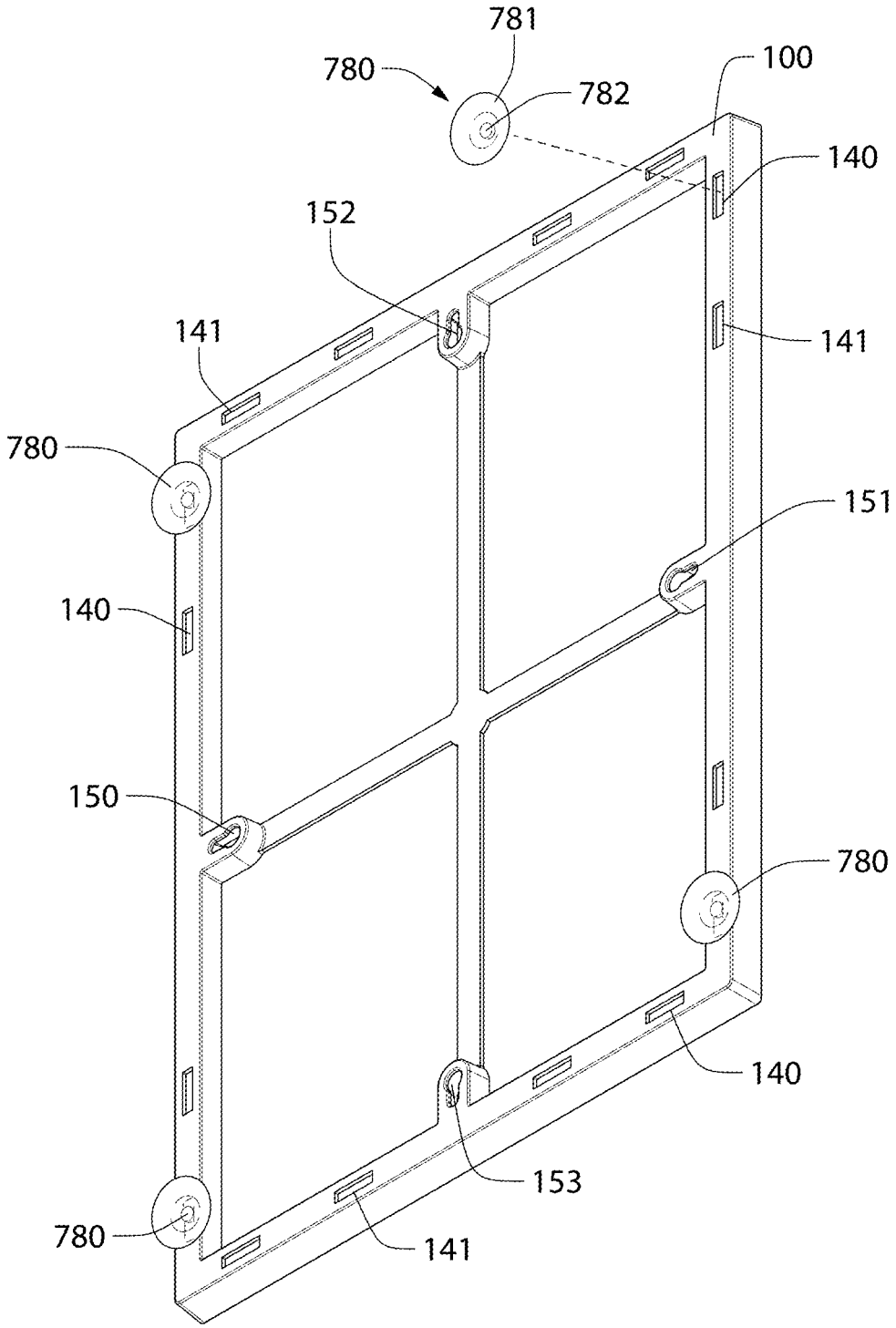
Figure 33:
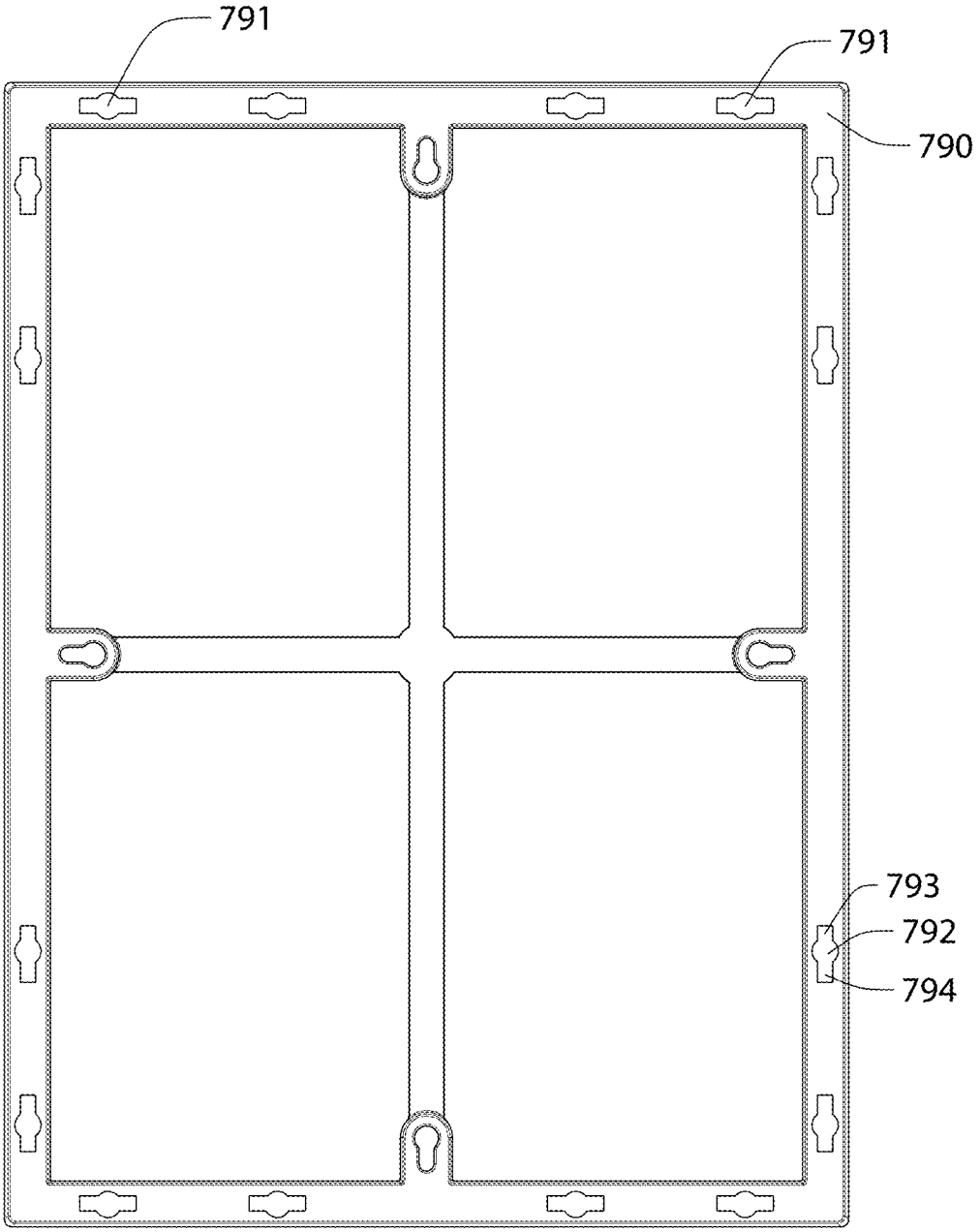
Figure 34A:
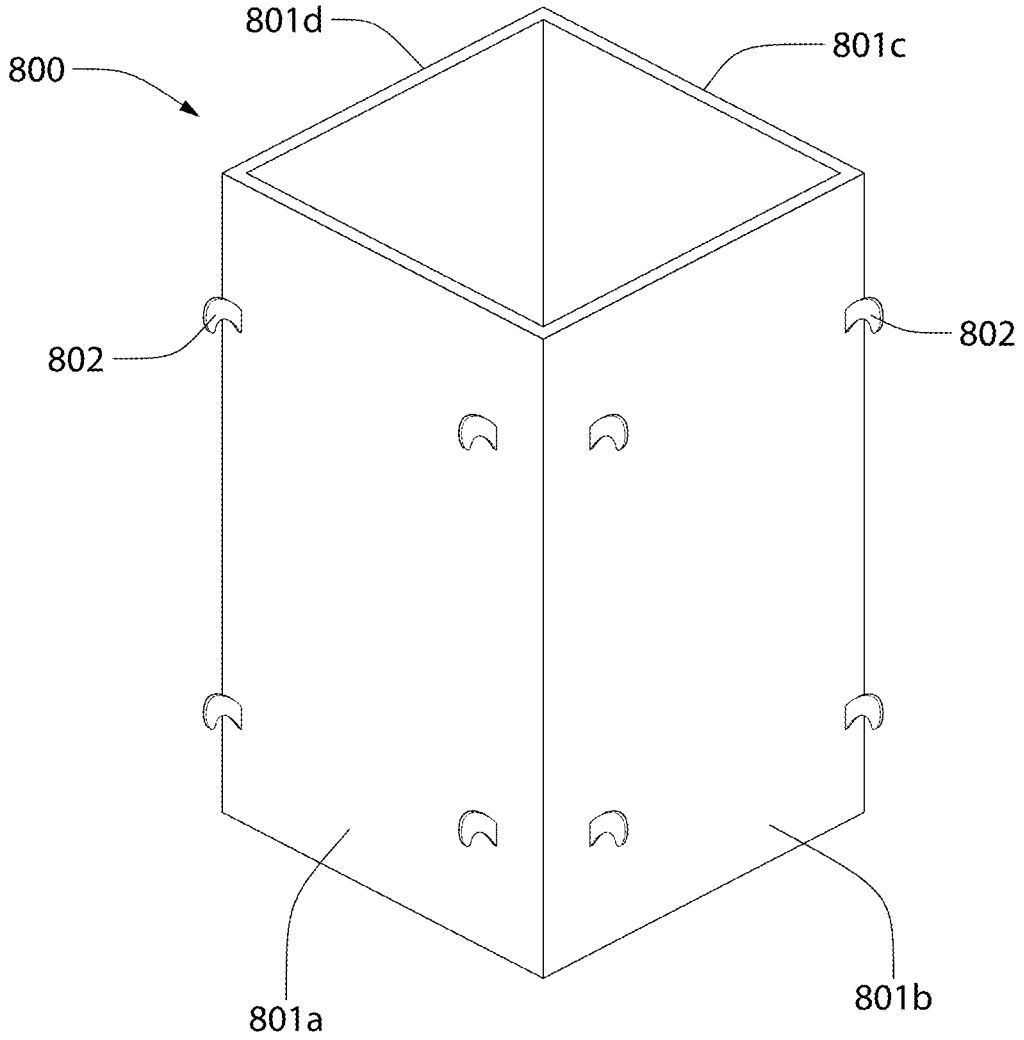
Figure 34B:
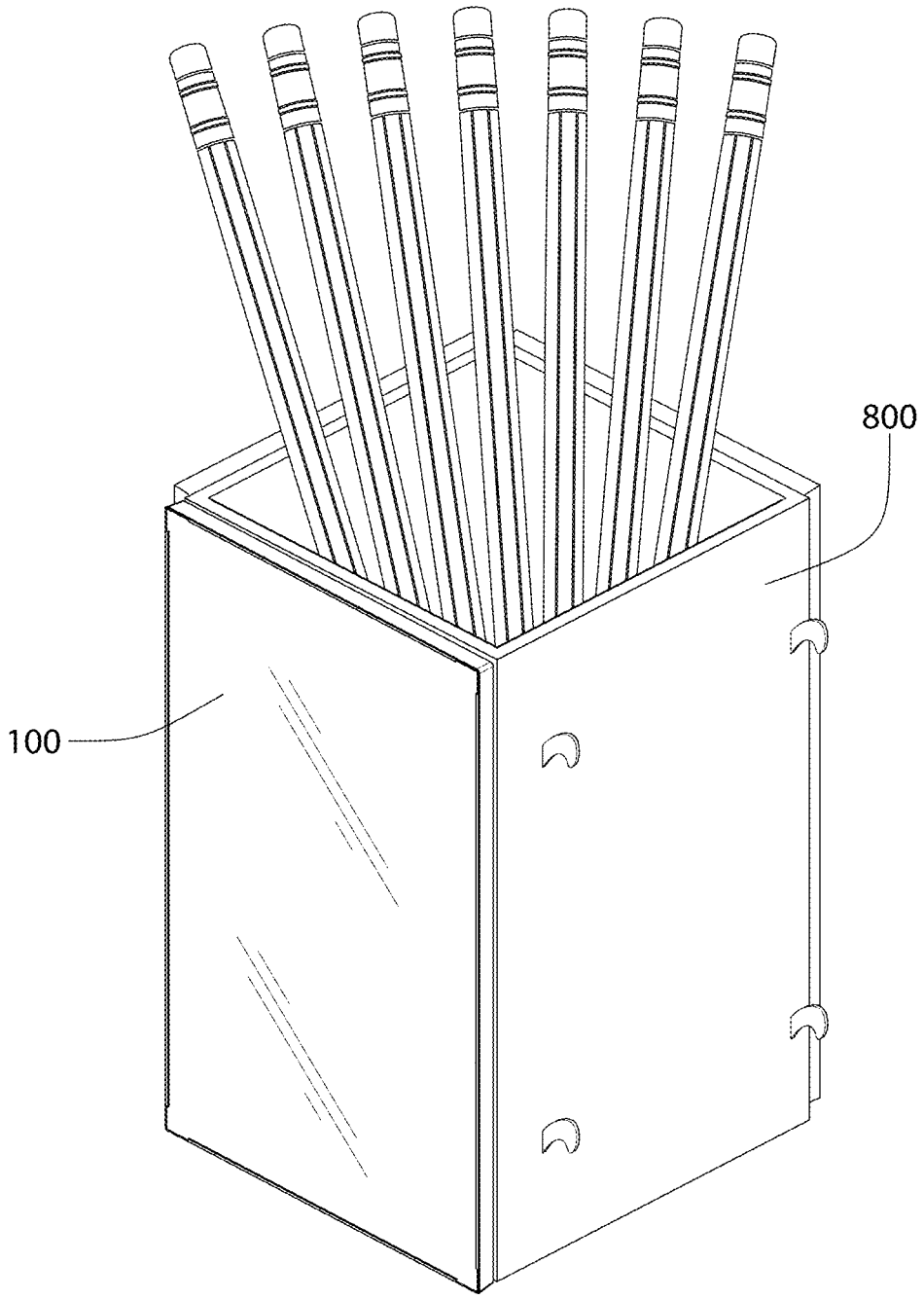
Figure 35A:
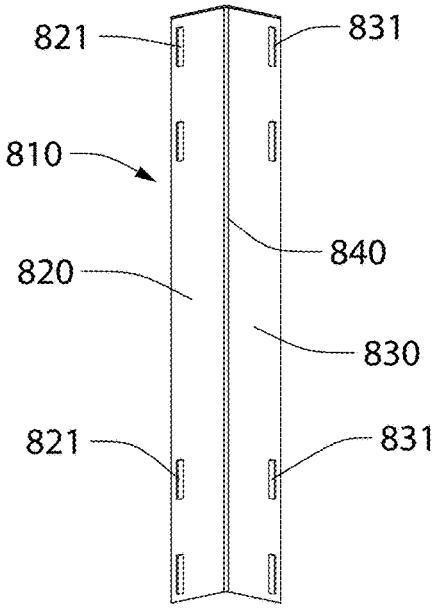
Figure 35B:
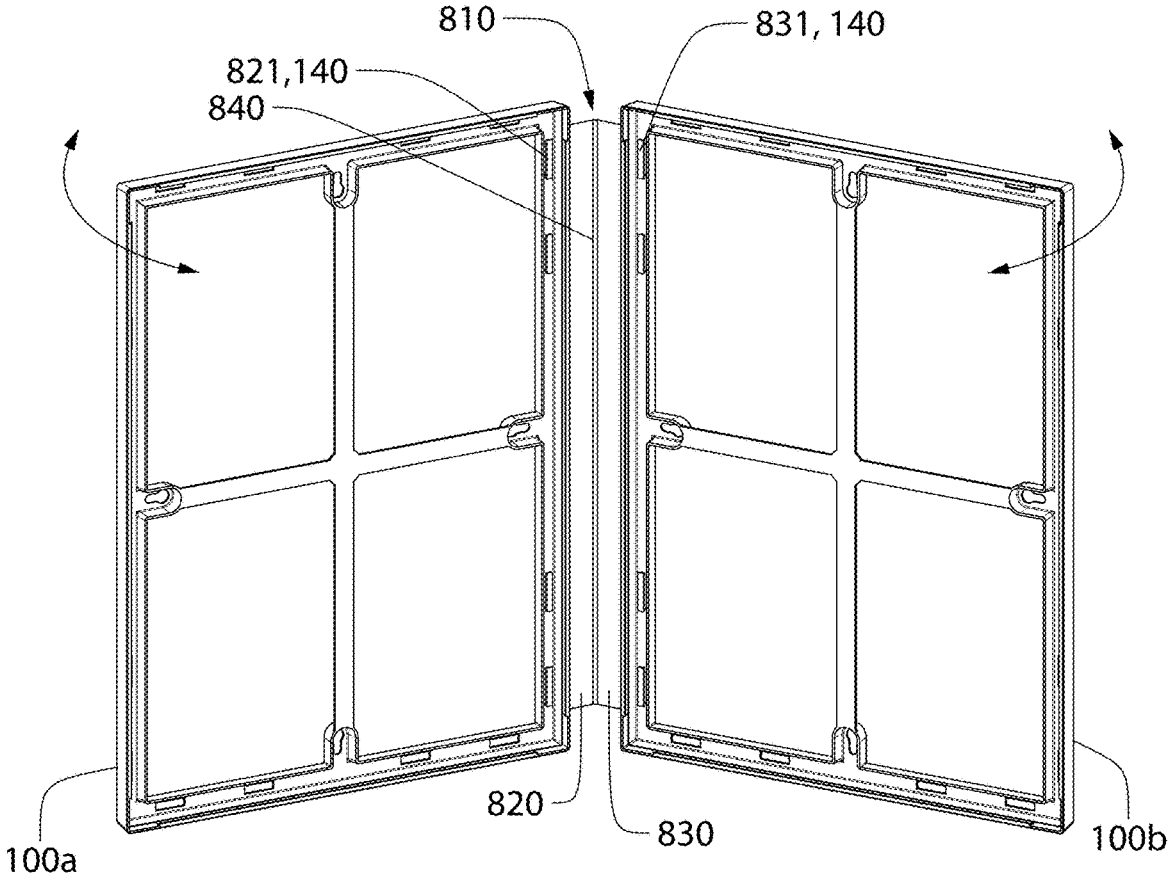
Figure 35C:
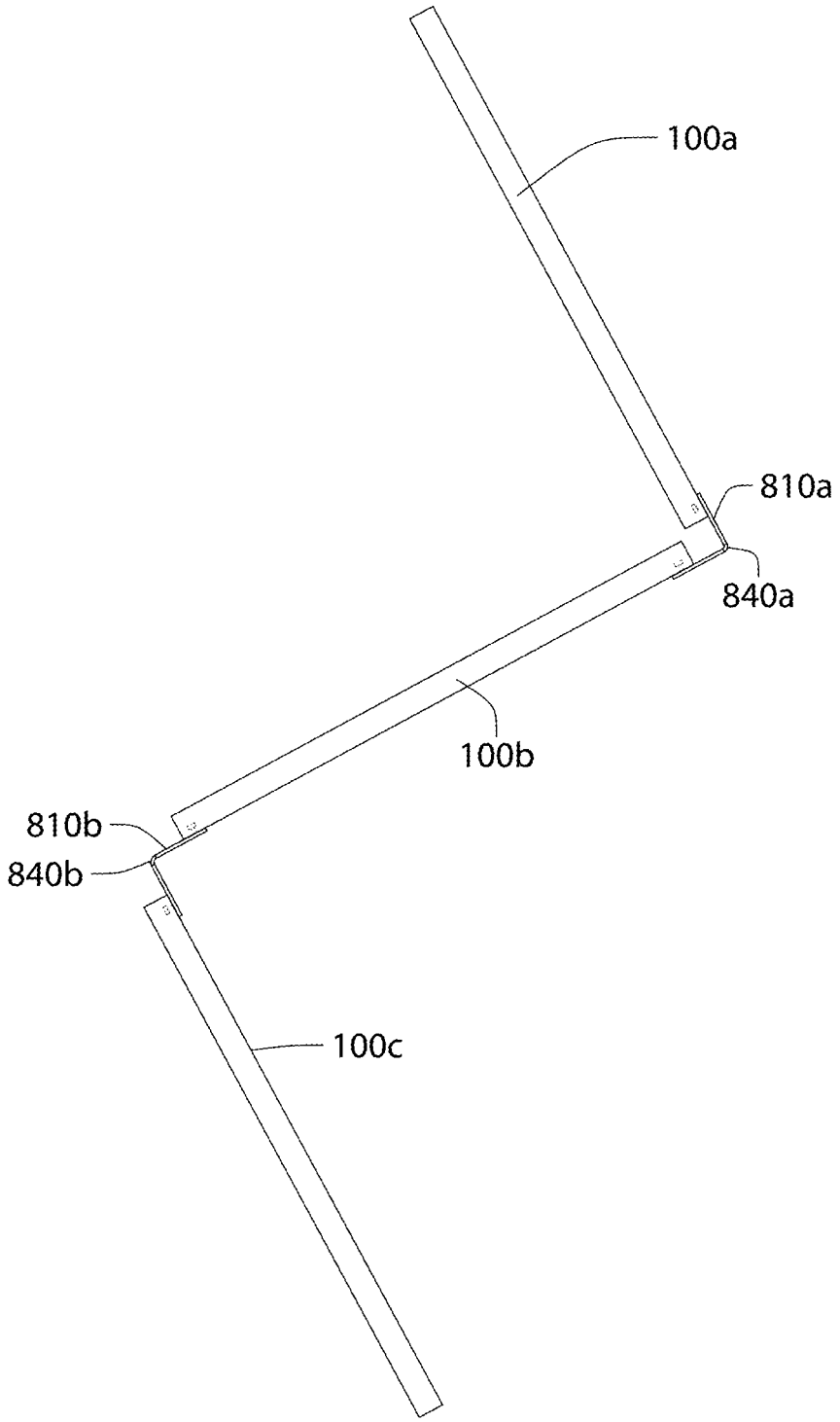

16A is a rear view illustrating attachment of the connector bracket of FIG. 15 to a second frame;

FIG. 16B is a rear view illustrating attachment of the connector bracket to a first frame, with the first frame also having two hanging brackets coupled thereto;

FIG. 16C is a rear view illustrating the connector bracket coupled to each of the first and second frames;

FIG. 17A is a cross-sectional view taken along line XVIIA-XVIIA of FIG. 16C;

FIG. 17B is a front view illustrating two sets of first and second frames with the first frame hanging from a top edge of a door via the hanging brackets and the second frame hanging from the first frame via the connector bracket;

FIG. 17C is a front view illustrating frames hanging from a top edge of a door and coupled to one another in accordance with an alternative embodiment;

FIG. 18A is a front perspective view of a frame in accordance with another embodiment of the present invention;

FIG. 18B is a rear perspective view of the frame of FIG. 18A;

FIG. 18C is a front view of the frame of FIG. 18A;

FIGS. 19A and 19B illustrate the process of detaching an integral easel from the frame of FIGS. 18A-18C and attaching the easel to the frame in a manner which permits it to rest stably on a tabletop;

FIGS. 20A-20O are front views of different size frames in accordance with embodiments of the present invention;

FIG. 21A illustrates two of the hanging brackets adjacent to a rear of a frame with dashed lines indicating a manner of attaching the hanging brackets to the frame in accordance with an alternative embodiment;

FIG. 21B illustrates the hanging brackets and the frame of FIG. 21A in an attached or assembled state;

FIG. 22 illustrates a kit of parts in accordance with an embodiment of the present invention;

FIG. 23 illustrates a kit of parts in accordance with another embodiment of the present invention;

FIGS. 24A and 24B are perspective views of a frame with an easel detachably coupled thereto in accordance with an embodiment of the present invention;

FIGS. 25A and 25B are perspective views of a frame with an accessory detachably coupled to a side portion thereof in accordance with an embodiment of the present invention;

FIG. 26 is a perspective view of a frame with a plurality of accessories detachably coupled to a bottom portion thereof in accordance with an embodiment of the present invention;

FIG. 27 is a perspective view of a frame with a plurality of hooks detachably coupled to a bottom portion thereof in accordance with an embodiment of the present invention;

FIG. 28 is a perspective view of a frame with an accessory container detachably coupled to a bottom portion thereof in accordance with an embodiment of the present invention;

FIG. 29 is a perspective view of a frame with a decorative item detachably coupled to a top portion thereof in accordance with an embodiment of the present invention;

FIGS. 30A and 30B are views of a pair of frames attached to a support surface in accordance with an embodiment of the present invention;

FIG. 31 is a front view of a set of frames hanging from a support bar in accordance with an embodiment of the present invention;

FIG. 32 is a rear view of a frame with suction cups detachably coupled thereto in accordance with an embodiment of the present invention;

FIG. 33 is a rear view of a frame in accordance with another embodiment of the present invention;

FIG. 34A is a perspective view of a container with hooks configured for coupling the container to a frame in accordance with an embodiment of the present invention;

FIG. 34B is a perspective view of the container of FIG. 34A detachably coupled to a frame in accordance with an embodiment of the present invention;

FIG. 35A is a perspective view of a hinge strip configured for coupling two frames together in accordance with an embodiment of the present invention;

FIG. 35B is a perspective view of two frames being coupled together by the hinge strip of FIG. 35A; and FIG. 35C is a top view of three frames being coupled together by two of the hinge strips of FIG. 35A.

DETAILED DESCRIPTION OF THE INVENTION

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1-4, a frame 100 is illustrated in accordance with an embodiment of the present invention. The frame 100 may be part of a frame apparatus which may, in one embodiment, comprise the frame 100 and a display item. The frame apparatus may, in another embodiment, comprise the frame 100, the display item, and one or more accessories which may include, without limitation, tray attachments, connector brackets, hanging brackets, hook assemblies, mesh attachment boards, and the like. Further details about the frame apparatus will be provided below following a description of the frame 100.

The frame 100 may be a front-loading frame. This means that the display items which are displayed by or otherwise held by the frame 100 are inserted into the display cavity of the frame 100 via the same opening through which the display item is viewed by an end user. This is in contrast to a perhaps more conventional rear-loading frame where the display items are inserted into the frame via an opening in the rear of the frame but then viewed by the end user via an opening in the front of the frame. The frame 100 may be an integrally formed monolithic structure. The frame 100 may be formed from any desirable material, including without limitation polystyrene such as high impact molding grade polystyrene, other hard plastics including polyethylene, polyvinyl chloride, nylon, thermoplastics, elastomers or the like. The frame 100 may be formed or manufactured in an injection molding process. In other embodiments, the frame 100 may be formed of wood, metal or other similar materials. The frame 100 may have four sides and be square or rectangular as shown, or the frame 100 may take on other shapes including being circular, other polygonal shapes, or irregular shapes.

The frame 100 may comprise a longitudinal axis A-A and a transverse axis B-B that is perpendicular to the longitudinal axis A-A.

The frame 100 may comprise an outer annular wall 110, an inner annular wall 120, and a floor 130 that extends between the outer and inner annular walls 110, 120. In the exemplified embodiment, the outer and inner annular walls 110, 120 are continuous. In other embodiments, at least one of the outer and inner annular walls 110, 120 may be discontinuous and formed by wall segments. In still other embodiments, the inner annular wall 120 may comprise a plurality of discrete posts rather than a continuous or annular wall. As used herein, the term annular is not limited to a round or circular shape, but includes other closed shapes such as the rectangular shape shown in the exemplified embodiment. Thus, as used herein the term annular means a closed shape regardless of the specific shape formed (i.e., a closed circular shape, a closed square shape, a closed rectangular shape, a closed polygonal shape, a closed irregular shape).

The outer annular wall 110 may comprise an outer surface 111 that defines a periphery of the frame 100, an inner surface 112 that defines a display cavity 113 within which the display item (discussed in more detail below) is retained, a front edge 114 that defines a display opening through which the display item is inserted into (and perhaps removed from if disassembly is possible) the display cavity 113, and a rear edge 115. The outer annular wall 110 may dictate the overall shape of the frame 100. In the exemplified embodiment the outer annular wall 110 is rectangular, but the outer annular wall 110 may be square, circular, other polygonal shapes, irregular shapes, or the like in other embodiments. The outer annular wall 110 may have a thickness measured between the inner and outer surfaces 111, 112 that is between 1 mm and 4 mm, and more specifically between 1 mm, and 3 mm, and still more specifically between 1 mm and 2 mm. Owing to this relatively small thickness, the outer annular wall 110 may have some inherent flexibility when formed from hard plastic materials such as described herein which may be useful during insertion/removal of display items into and out of the display cavity 113.

Figure 1:
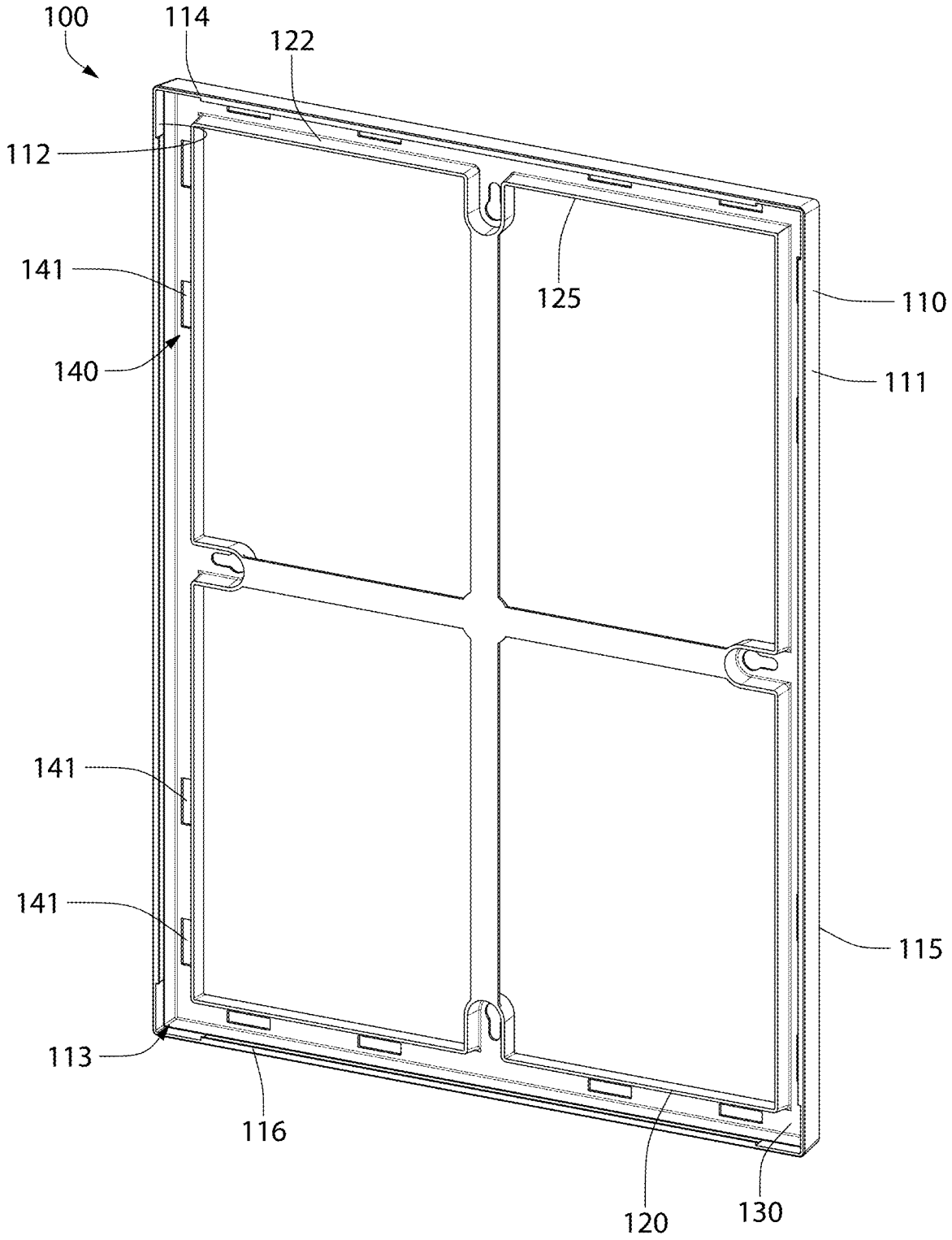
FIG. 1 is a front perspective view of a frame in accordance with an embodiment of the present invention.
Figure 2:
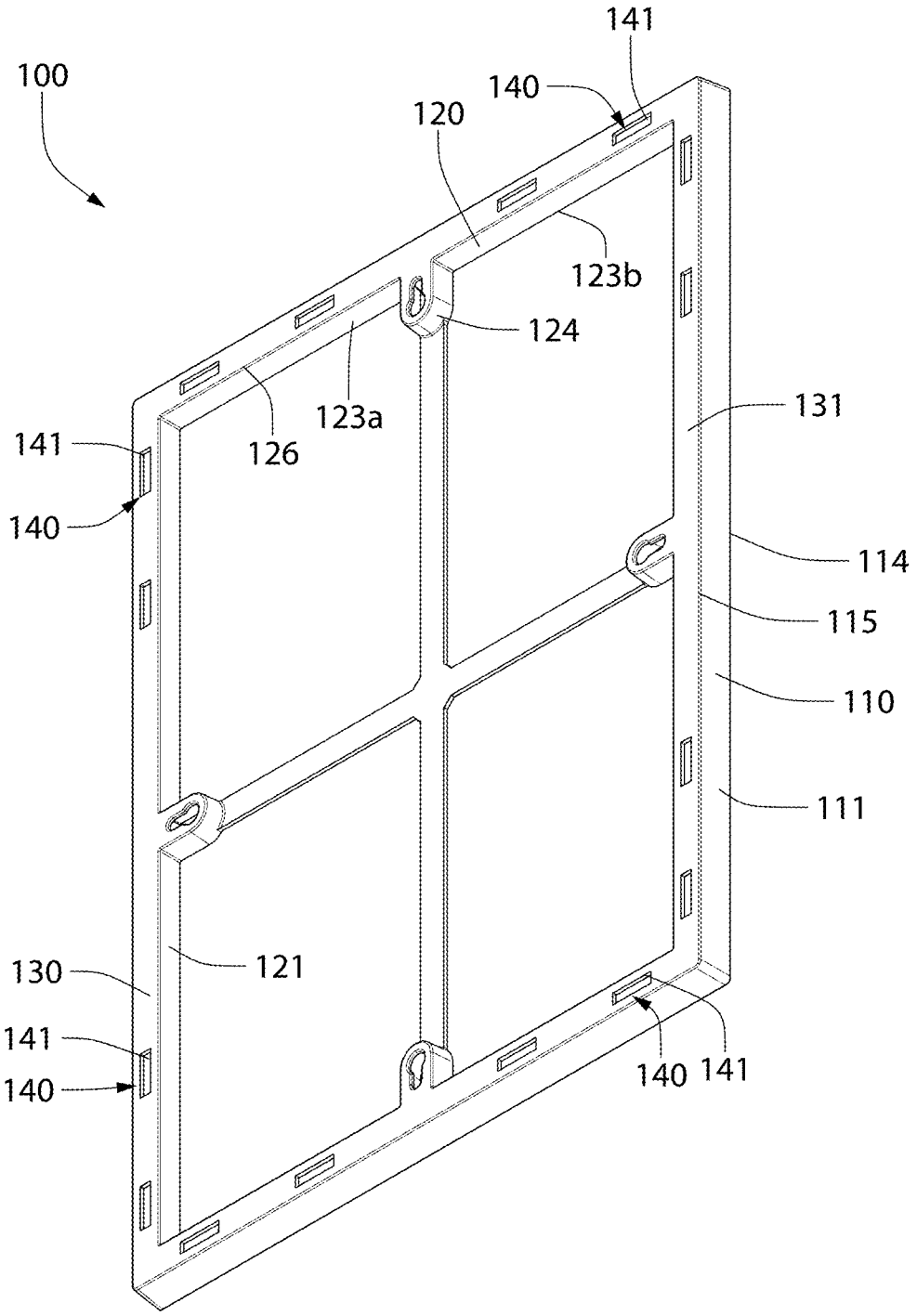
FIG. 2 is a rear perspective view of the frame of FIG. 1.
Figure 3:
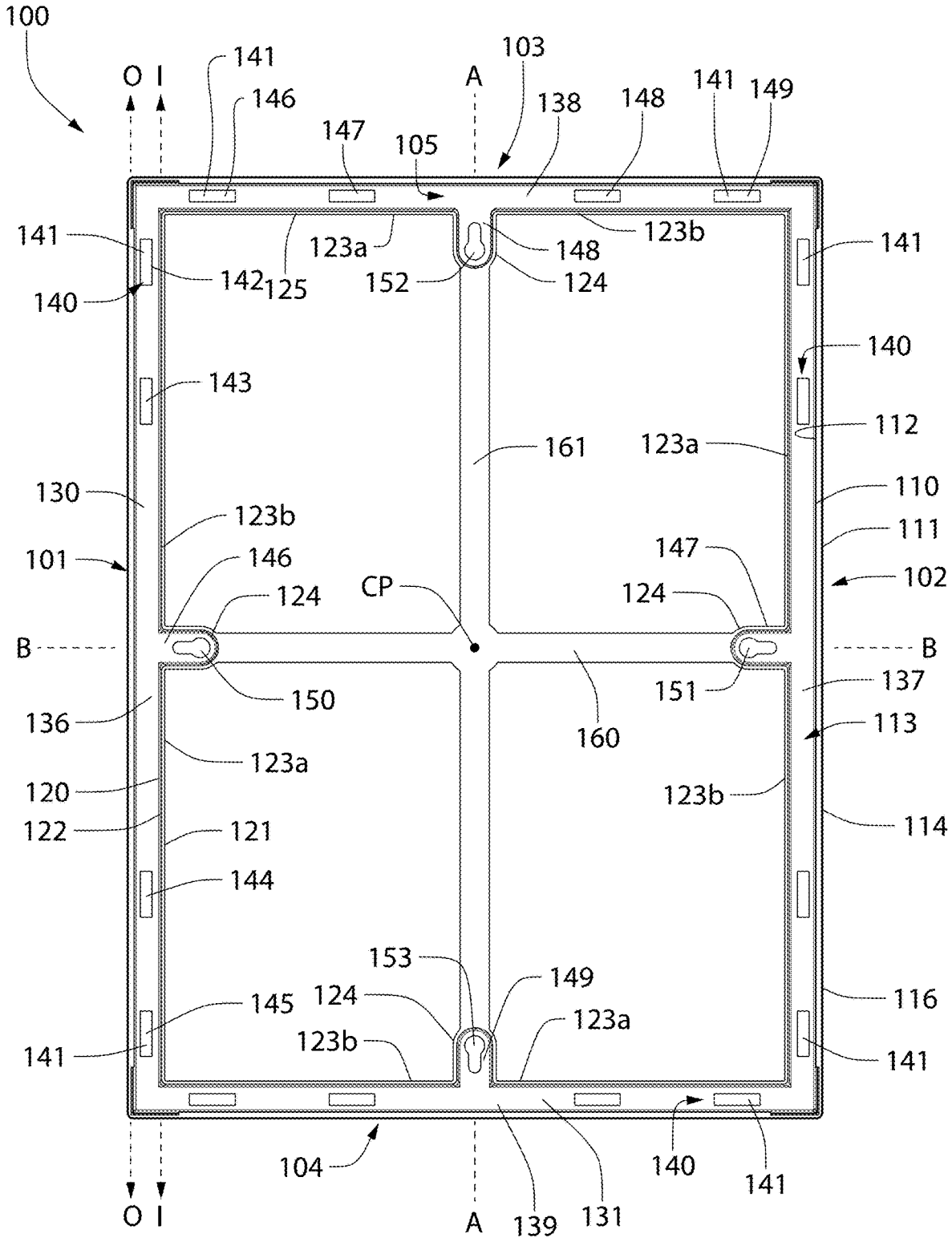
FIG. 3 is a front view of the frame of FIG. 1.
Figure 4:
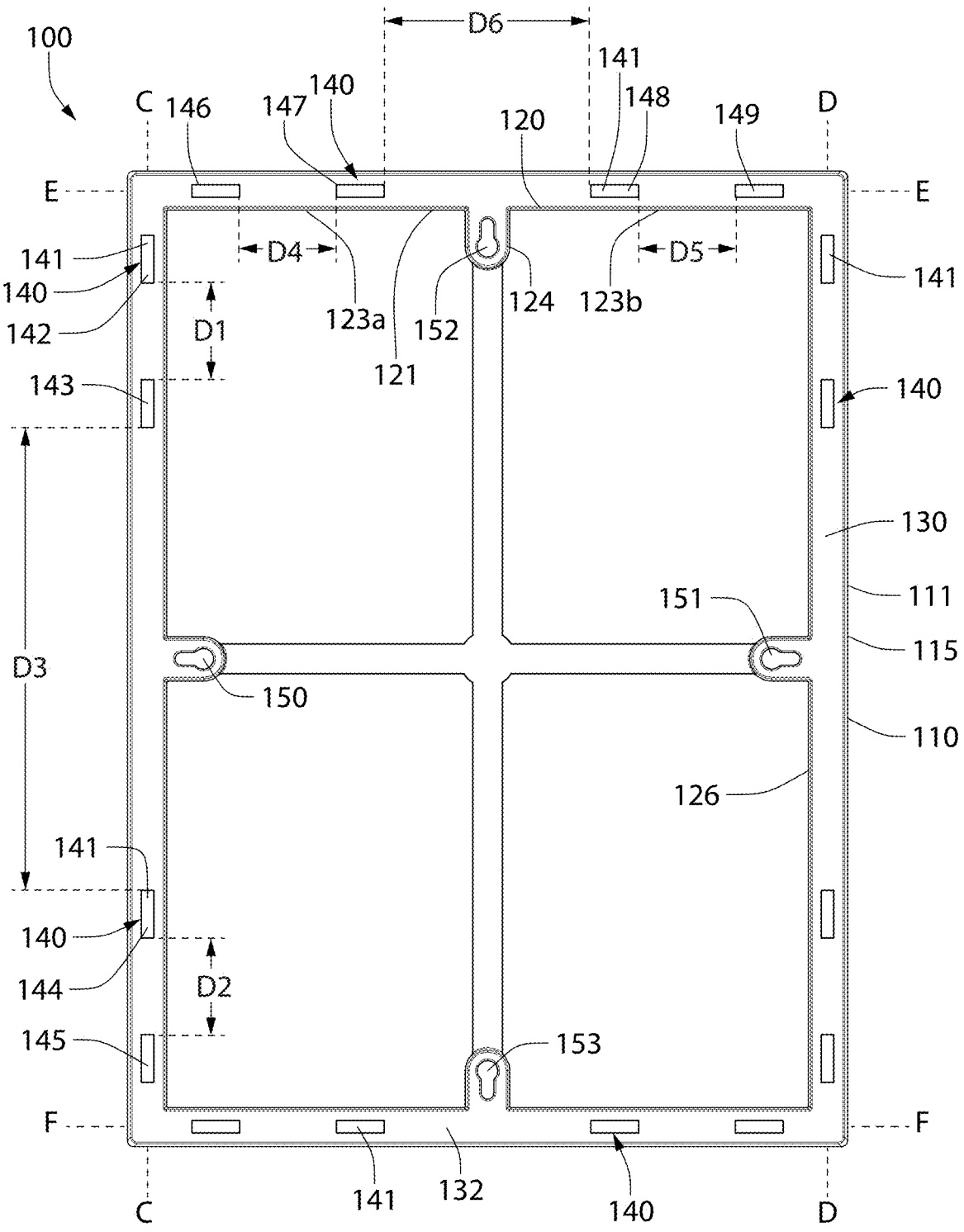
FIG. 4 is a rear view of the frame of FIG. 1.
Figure 5:
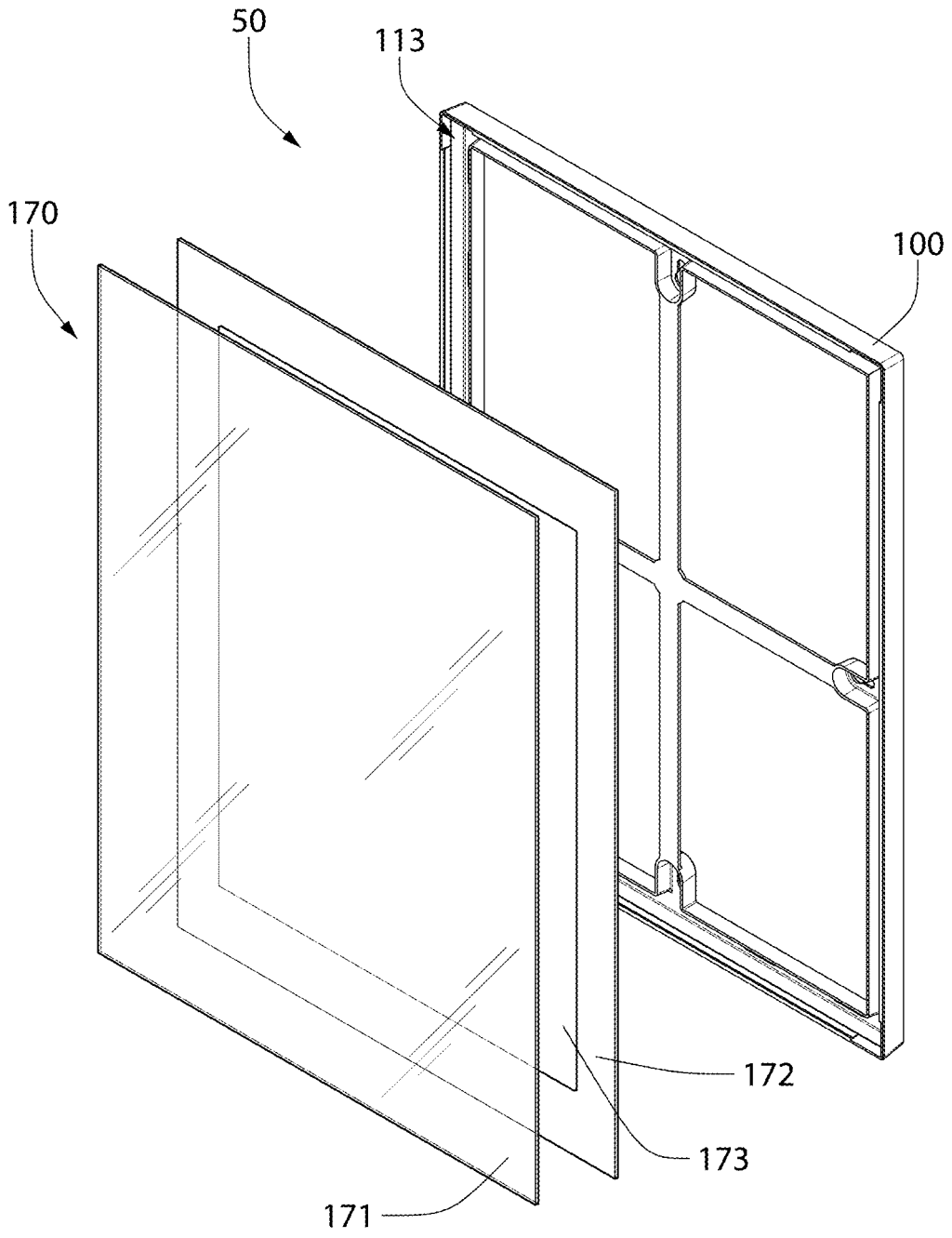
FIG. 5 is an exploded view of a frame apparatus which includes the frame of FIG. 1 and a display item.
Figure 6:
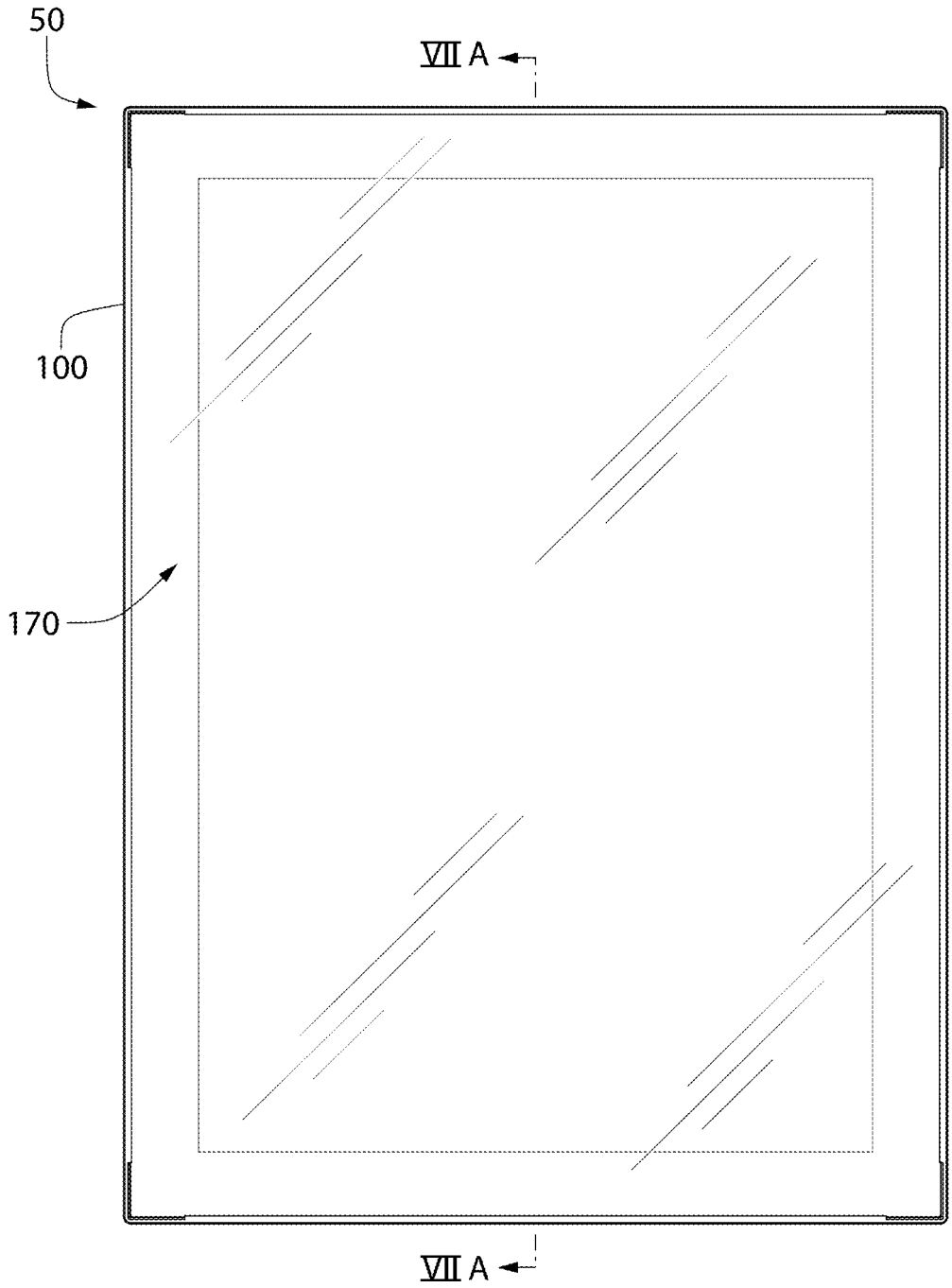
FIG. 6 is a front view of the frame apparatus in an assembled state.
Figure 7A:
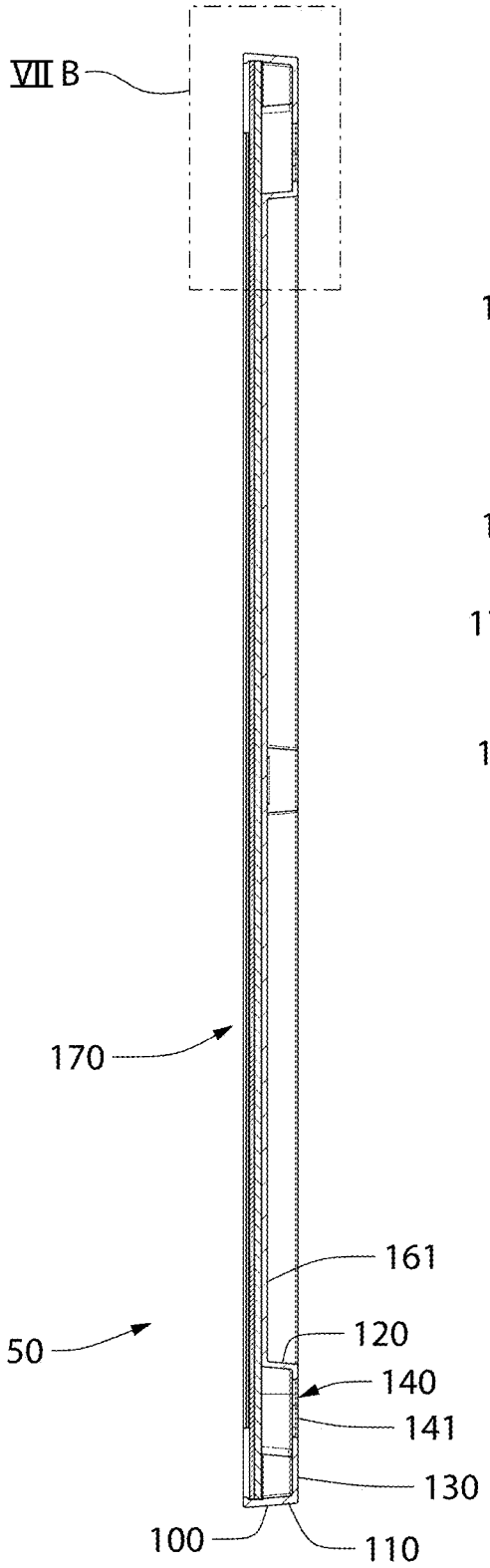
FIG. 7A is a cross-sectional view taken along line VIIA-VIIA of FIG. 6.
Figure 7B:
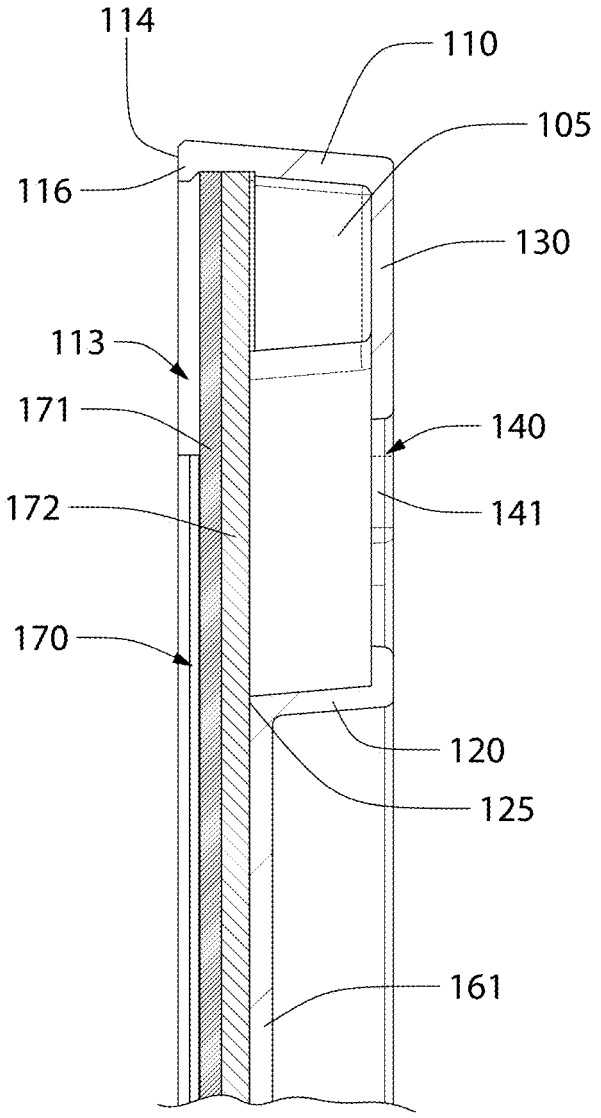
FIG. 7B is a close-up view of area VIIB of FIG. 7A.

The outer annular wall 110 may comprise a locking tab 116 protruding inwardly from the inner surface 112 of the outer annular wall 110 adjacent to the front edge 114 of the outer annular wall 110. The locking tab 116 may be a bump or protrusion that is elongated along the inner surface 112 of the outer annular wall 110. The locking tab 116 may be continuous in some embodiments and discontinuous in other embodiments. The locking tab 116 may not extend along corner portions of the outer annular wall 110, as best shown in FIG. 3. This is because there is a reduced flexibility of the outer annular wall 110 along the corner portions thereof and eliminating the locking tab 116 in those regions may make it easier to insert the display item into the display cavity 113 without breaking the frame 100 or the display item or both. The locking tab 116 may abut against a front surface of a display item located in the display cavity 113 to lock the display item in the display cavity 113. If the display item is not permanently mounted to the frame 100, a user may be able to remove the display item from the display cavity 113 by applying pressure against the rear of the display item in a direction towards the display opening. In such a scenario, the pressure or force applied needs to be sufficient to force the display item past the locking tab 116, which may involve the outer annular wall 110 or portions thereof flexing outwardly to create a space for the display item 113 to pass by the locking tab 116.

The inner annular wall 120 comprises an inner surface 122 that faces the inner surface 112 of the outer annular wall 110 in a spaced apart manner and an outer surface 121 opposite the inner surface 122. An annular gap 105 may exist in the space between the inner surface 122 of the inner annular wall 120 and the inner surface 112 of the outer annular wall 110. The inner annular wall 120 has a thickness measured between the inner and outer surfaces 121, 122. The thickness of the inner annular wall 120 may be similar to the thickness of the outer annular wall and may be in the range of 1-4 mm, or 1-3 mm, or 1-2 mm. The inner annular wall 120 may be generally of the same shape as the outer annular wall 110, such as being rectangular, square, other polygonal shapes, circular, irregular, or the like. As noted above, the inner annular wall 120 may be discontinuous rather than a continuous wall in some embodiments. The inner annular wall 120 may contain openings or apertures therein to reduce overall material and cost. The inner annular wall 120 may have a consistent height as shown in the exemplified embodiment. The inner annular wall 120 may have an inconsistent height in other embodiments, such that portions of the inner annular wall 120 may be taller than other portions of the inner annular wall 120. The inner annular wall 120 may comprise linear portions 123*a*, 123*b* and arcuate portions 124, with the arcuate portions 124 being intersected by the longitudinal axis A-A and the transverse axis B-B.

The inner annular wall 120 may further comprise a front edge 125 and a rear edge 126 that is opposite the front edge 125. The inner annular wall 120 may have a height which is less than a height of the outer annular wall 110. As such, the front edge 125 of the inner annular wall 120 may be recessed relative to the front edge 114 of the outer annular wall 110. When a display item is located within the display cavity 113, a rear of the display item may abut against the front edge 125 of the inner annular wall 120. Thus, the display item may not be capable of being positioned in the display cavity 113 deeper than the front edge 125 of the inner annular wall 120. When the display item is positioned in the display cavity 113, the annular gap 105 may exist between a rear of the display item and the floor 130 of the frame 100. The annular gap 105 may be an empty, air-filled space that may be capable of receiving a portion of a hanging hardware such as a screw or a nail which protrudes from a support surface to hang the frame 100 from the support surface. The existence of the annular gap 105 may further allow for other items and accessories to be coupled to the frame 100 by utilizing the annular gap 105 as a space within which mounting elements of such an item, accessory, connector bracket, hanging bracket, or the like may extend.

The floor 130 of the frame 100 may extend between the rear edge 115 of the outer annular wall 110 and the rear edge 126 of the inner annular wall 120. The floor 130 may comprise a front surface 131 that faces the display cavity 113 and a rear surface 132 which is opposite the front surface 131 and forms the rear of the frame 100. The inner and outer annular walls 110, 120 may extend perpendicularly from the floor 130. Alternatively, the inner and outer annular walls 110, 120 may extend at an angle which is 90° plus/minus 5° relative to the floor 130. The floor 130 may generally be spaced apart from any display item located in the display cavity 113 by the annular gap 105.

The frame 100 may comprise a plurality of linear frame sections which includes a first linear frame section 101, a second linear frame section 102 that is parallel to the first linear frame section 101, a third linear frame section 103, and a fourth linear frame section 104 that is parallel to the third linear frame section 103. The third and fourth linear frame sections 103, 104 may extend between the first and second linear frame sections 101, 102. Each of the first, second, third, and fourth linear frame sections 101-104 may comprise portions of the outer annular wall 110, portions of the inner annular wall 120, and portions of the floor 130. The transverse axis B-B may intersect the first and second linear frame sections 101, 102 at a center thereof and the longitudinal axis A-A may intersect the third and fourth linear frame sections 103, 104 at a center thereof. The first and second linear frame sections 101, 102 may be elongated in a direction parallel to the longitudinal axis A-A and the third and fourth linear frame sections 103, 104 may be elongated in a direction parallel to the transverse axis B-B.

As noted above, the frame 100 is not limited to the square or rectangular shape in all embodiments. Thus, in other embodiments the frame 100 may comprise additional linear frame sections (for example a pentagonal shaped frame may have five linear frame sections) or fewer linear frame sections (for example a triangular shaped from may have three linear frame sections). In some embodiments, the frame 100 may be round or circular and have no linear frame sections, but the features and general concepts described herein may be applicable nonetheless. Thus, instead of "linear" frame sections 101-104, the frame may simply have frame sections which generally correspond to the location of the linear frame sections 101-104.

The outer annular wall 110 may be linear along each of the first, second, third, and fourth linear frame sections 101-104. However, along each of the first, second, third, and fourth linear frame sections 101-104, the inner annular wall 120 may comprise a first linear portion 123*a*, a second linear portion 123*b*, and an arcuate portion 124. The arcuate portion 124 may be located in between the first and second linear portions 123*a*, 123*b*. The arcuate portions 124 may be intersected by the longitudinal and transverse axes A-A, B-B. In the exemplified embodiment there are four of the arcuate portions 124 of the inner annular wall 120, one for each of the first through fourth linear frame sections 101-104. Along each of the arcuate portions 124, the inner surface 122 is concave and the outer surface 121 is convex. Thus, the arcuate portions 124 form bump-outs in a direction towards a centerpoint CP of the frame 100 where the longitudinal and transverse axes A-A, B-B intersect.

The floor 130 comprises a plurality of linear floor sections each of which is associated with or extends along or is comprised by one of the linear frame sections 101-104. In particular, the first linear frame section 101 comprises a first linear floor portion 136 of the floor 130, the second linear frame section 102 comprises a second linear floor portion 137 of the floor 130, the third linear frame section 103 comprises a third linear floor portion 138 of the floor 130, and the fourth linear frame section 104 comprises a fourth linear floor portion 139 of the floor 130.

The floor 130 may comprise a plurality of mounting elements 140. In the exemplified embodiment, each of the plurality of mounting elements 140 is an aperture 141 that extends through the floor 130 from the front surface 131 of the floor 130 to the rear surface 132 of the floor 130. In alternative embodiments, the mounting elements 140 may comprise protuberances that protrude from the rear surface 132 of the floor 130 (see FIGS. 21A and 21B, described below). The mounting elements 140 may be used in a functional sense to facilitate the attachment of an accessory item such as a hanger bracket, a connector bracket, a tray attachment, or the like to the frame 100. Such an attachment may be achieved mechanically with one of the frame 100 or the accessory item comprising a male connector and the other one of the frame 100 or the accessory item comprising a female connector. The apertures 141 form female connectors, but in other embodiments the mounting elements 140 may be protuberances such as posts or the like which may form male connectors. This will be described more fully below during discussions regarding the coupling of various accessory items to the frame 100. Only some of the mounting elements 140 and apertures 141 are labeled in the drawings.

In the exemplified embodiment, each of the apertures 141 is rectangular in shape. Furthermore, each of the apertures 141 may be elongated in the same direction as the linear floor section 136-139 along which is it located. For example, the first linear floor section 136 may extend along a first axis C-C, the second linear floor section 137 may extend along a second axis D-D, the third linear floor section 138 may extend along a third axis E-E, and the fourth linear floor section 139 may extend along a fourth axis F-F. Any of the apertures 141 located along the first linear floor section 136 may be elongated in the direction of the first axis C-C. Any of the apertures 141 located along the second linear floor section 137 may be elongated in the direction of the second axis D-D. Any of the apertures 141 located along the third linear floor section 138 may be elongated in the direction of the third axis E-E. Any of the apertures 141 located along the fourth linear floor section 139 may be elongated in the direction of the fourth axis F-F. The invention is not to be limited by the shape of the apertures 141 in all embodiments and other shapes may be used for the apertures 141, including square, circular, other polygonal shapes, irregular shapes, or the like.

Each of the plurality of linear floor sections 136-139 may comprises at least one of the apertures 141. In the exemplified embodiment, each of the plurality of linear floor sections 136-139 comprises a plurality of the apertures 141, and more specifically four of the apertures 141. However, the invention is not to be so limited in all embodiments. In alternative embodiments, each of the plurality of linear floor sections 136-139 may comprise a single aperture 141 (or mounting element 140), two of the apertures 141 (or mounting elements 140), or three of the apertures 141 (or mounting elements 140). In still other embodiments, one or more of the linear floor sections 136-139 may comprise more than four of the apertures 141 (or mounting elements 140). In some embodiments, the first and second linear floor sections 136, 137 may comprise the same number of apertures 141 or mounting elements 140 and the third and fourth linear floor sections 138, 139 may comprise the same number of apertures 141 or mounting elements 140. Additional exemplary embodiments of frames with varying numbers of apertures are illustrated in FIGS. 20A-20O.

In the exemplified embodiment, the first floor section 136 comprises a first pair of the apertures 141 located on a first side of the transverse axis B-B and a second pair of the apertures 141 located on a second side of the transverse axis B-B. The first pair of the apertures 141 is located adjacent to the third linear floor section 138 and the second pair of the apertures 141 is located adjacent to the fourth linear floor section 139. The first pair of apertures 141 comprises a first aperture 142 and a second aperture 143 that are spaced apart by a first distance D1. The second pair of apertures 141 comprises a first aperture 144 and a second aperture 145 that are spaced apart by a second distance D2 that is equal to the first distance D1. The second aperture 143 of the first pair of apertures 141 is spaced apart from the first aperture 144 of the second pair of apertures 141 by a third distance D3 which is different than the first and second distances D1, D2. In the exemplified embodiment, the third distance D3 is greater than the first and second distances D1, D2. In other embodiments, the third distance D3 may be less than the first and second distances D1, D2. In still other embodiments, the third distance D3 may be the same as the first and second distances D1, D2. This may be dictated, at least in part, by the overall dimensions, and particularly the length, of the frame 100.

The second floor section 137 also comprises a first pair of the apertures 141 and a second pair of the apertures 141. The apertures 141 located along the second floor section 137 may be positioned at the exact same relative locations as the apertures 141 located along the first floor section 136 and the spacing between the various apertures 141 located along the second floor section 137 may be as described above with reference to the apertures 141 located along the first floor section 136. That is, each aperture located along the second floor section 137 may be aligned with one of the apertures located along the first floor section 136 such that an axis that is parallel to the transverse axis B-B (and perpendicular to the longitudinal axis A-A) will intersect one of the apertures located along the first floor section 136 and one of the apertures located along the second floor section 137. Further details about the apertures 141 on the second floor section 137 will not be repeated herein in the interest of brevity, it being understood that the description of the apertures along the first floor section 136 is applicable.

The third floor section 138 comprises a first pair of the apertures 141 and a second pair of the apertures 142. The first and second pairs of the apertures 141 are located on opposite sides of the longitudinal axis A-A of the frame 100. Thus, the first pair of apertures 141 are located adjacent to the first linear floor section 136 and the second pair of apertures 141 are located adjacent to the second linear floor section 137. The first pair of apertures 141 comprises a first aperture 146 and a second aperture 147 that are spaced apart by a fourth distance D4. The second pair of apertures 141 comprises a third aperture and a fourth aperture 149 that are spaced apart by a fifth distance D5. The fourth and fifth distances D4, D5 may be the same. The fourth and fifth distances D4, D5 may be the same as the first and second distances D4, D5. The second aperture 147 of the first pair of apertures 141 may be spaced apart from the first aperture 148 of the second pair of apertures 141 by a sixth distance D6. The sixth distance D6 may be different than the fourth and fifth distances D4, D5, such as being greater than or less than the fourth and fifth distances D4, D5. In another embodiment, the sixth distance D6 may be the same as the fourth and fifth distances. This may be dictated, at least in part, by the dimensions, and particularly the width, of the frame 100.

The fourth floor section 139 also comprises a first pair of the apertures 141 and a second pair of the apertures 141. The apertures 141 located along the fourth floor section 139 may be positioned at the exact same relative locations as the apertures 141 located along the third floor section 138 and the spacing between the various apertures 141 located along the fourth floor section 139 may be as described above with reference to the apertures 141 located along the first third section 138. That is, each aperture located along the fourth floor section 139 may be aligned with one of the apertures located along the third floor section 138 such that an axis that is parallel to the longitudinal axis A-A (and perpendicular to the transverse axis B-B) will intersect one of the apertures located along the third floor section 138 and one of the apertures located along the fourth floor section 139. Further details about the apertures 141 on the fourth floor section 139 will not be repeated herein in the interest of brevity, it being understood that the description of the apertures along the third floor section 138 is applicable.

Thus, in some embodiments, the axial position of the apertures 141 (or mounting elements 140) along the first and second floor sections 136, 137 is the same and the axial position of the apertures 141 (or mounting elements 140) along the third and fourth floor sections 138, 139 is the same. The frame 100 may be symmetrical about the longitudinal axis A-A and about the transverse axis B-B.

The apertures 141 within each pair of the apertures 141 may be spaced apart from one another by the same distance. That is, the distances D1, D2, D4, D5 may be equal. This may facilitate readily attaching various accessory items to the frame 100 using different pairs of the apertures 141 or mounting elements 140. Again, while a specific number of apertures 141 or mounting elements 140 are depicted in the exemplary embodiment, various modifications are possible including modifying the number of apertures 141 or mounting elements 140. In some embodiments, each of the linear floor sections 136-139 may comprise at least one of the apertures 141 or mounting elements 140. In another embodiment, each of the linear floor sections 136-139 may comprise at least two of the apertures 141 or mounting elements 140. In some embodiments, each of the linear floor sections 136-139 may comprise a first aperture 141 located adjacent to one of the corner portions of the frame 100 and a second aperture 141 located adjacent to an adjacent one of the corner portions of the frame 100.

The exact spacing between the various apertures 141 or mounting elements 140 is not to be limiting of the invention in all embodiments. Thus, the adjacently positioned apertures 141 or mounting elements 140 may be positioned closer together or further apart. This may be dictated by the structure of any accessory items that are configured to be coupled to the frame 100, the dimensions of the frame 100, aesthetics, or for other reasons. In some embodiments, the mounting elements 140 or apertures 141 may be positioned along the floor 130 of the frame 100 in a continuously equidistantly spaced apart manner. That is, there may not be large spaces between adjacent mounting elements 140 or apertures 141 in some alternative embodiments.

In the exemplified embodiment, along each of the linear frame sections 101-104, the outer annular wall 110 extends along an outer wall axis O-O and the linear portions 123*a*, 123*b* of the inner annular wall 120 extend along an inner wall axis I-I that is parallel to the outer wall axis O-O. Each of the apertures 141 may be formed in a portion of the floor 130 which is located between the inner and outer wall axes I-I O-O. In some embodiments, the first, second, third, and fourth linear floor sections 136-139 may be defined between the inner and outer wall axes I-I, O-O axes. The floor 130 may include extension portions, described above, which are not located between the inner and outer wall axes I-I, O-O.

The floor 130 of the frame 100 may comprise a plurality of extension portions, each of which is surrounded by one of the arcuate wall portions 124 of the inner annular wall 120. Thus, the floor 130 may comprise a first extension portion 146 which extends from and is continuous with the first linear floor portion 136, a second extension portion 147 which extends from and is continuous with the second linear floor portion 137, a third extension portion 148 which extends from and is continuous with the third linear floor portion 138, and a fourth extension portion 149 which extends from and is continuous with the fourth linear floor portion 139. Each of the first, second, third, and fourth extension portions 146-149 is arch-shaped in the exemplified embodiment, but the extension portions 146-149 could take on other shapes in other embodiments, including being square shaped extensions, rectangular shaped extensions, or the like. Each of the first through fourth extension portions 146-149 may extend inwardly towards the centerpoint CP of the frame 100. The first through fourth extension portions 146-149 may be located adjacent to the inner wall axis I-I, but not between the inner and outer wall axes I-I, O-O. Rather, the first and second extension portions 146, 147 may be located between the inner wall axis I-I and the longitudinal axis A-A and the third and fourth extension portions 158, 149 may be located between the inner wall axis I-I and the transverse axis B-B.

In the exemplified embodiment, the frame 100 comprises a connector element located along each of the first, second, third, and fourth extension portions 146-149. In the exemplified embodiment, the connector elements are connector holes. Thus, the frame 100 may comprise a first connector hole 150 located along the first extension portion 146 of the floor 130, a second connector hole 151 located along the second extension portion 147 of the floor 130, a third connector hole 152 located along the third extension portion 148 of the floor 130, and a fourth connector hole 153 located along the fourth extension portion 149 of the floor 130. The connector holes 150-153 may be keyhole shaped designed for receiving a head of a screw or fastener protruding from a wall or other support surface to hang the frame 100 therefrom. However, the connector holes 150-153 may take on other shapes in other embodiments. For example, the connector holes 150-153 may be square, rectangular, circular, other polygonal shapes, irregular shapes, or the like.

While the connector elements are described herein as being holes, the invention is not to be so limited in all embodiments. The connector elements may take on other forms in other embodiments, including being protrusions instead of holes.

In the exemplified embodiment, the connector holes 150-153 are elongated in a direction which is transverse to the axis of the linear floor section 136-139 on which it is located. Thus, the first connector hole 150 is located on the first extension portion 146 which is located along the first linear frame section 101 and adjacent to the first linear floor section 136. The first connector hole 150 is elongated in a direction that is transverse or perpendicular to the first axis C-C. The second connector hole 151 is elongated in a direction that is perpendicular to the second axis D-D, the third connector hole 152 is elongated in a direction that is perpendicular to the third axis E-E, and the fourth connector hole 153 is elongated in a direction that is perpendicular to the fourth axis F-F. While the exemplified embodiment has four of the connector holes 150-153, the invention is not to be so limited in all embodiments. In some embodiments the frame 100 may comprise the first and third connector holes 150, 152 while omitting the second and fourth connector holes 151, 153. In other embodiments, three of the four connector holes 150-153 may be included and the fourth omitted, in other embodiments the frame 100 may include just one of the connector holes 150-153.

The frame 100 may comprise a first strut 160 extending along the transverse axis B-B between the first and second linear frame sections 101, 102 and a second strut 161 extending along the longitudinal axis A-A between the third and fourth linear frame sections 103, 104. The first strut 160 may be coupled to the arcuate portions 124 of the inner annular wall 120 located along the first and second linear frame sections 101, 102. The second strut 161 may be coupled to the arcuate portions 124 of the inner annular wall 120 located along the third and fourth linear frame sections 103, 104. The first and second struts 160, 161 may be oriented perpendicularly relative to one another. The first and second struts 160, 161 may provide the frame 100 with added stability. One or both of the first and second struts 160, 161 may be partially or entirely omitted in some embodiments.

Referring to FIGS. 5-7B, a frame apparatus 50 will be described. The frame apparatus 50 may comprise the frame 100 and a display item 170 that is configured to be disposed within the display cavity 113 of the frame 100. In this embodiment, the display item 170 comprises a glazing 171, a backer 172, and an artistic image 173 which may be a drawing, a photograph, or any other item which is typically placed in a frame. In some embodiments, the display item 170 may comprise the glazing 171 and the backer 172 but not the artistic image 173, which is added later by the end user. In other embodiments the display item 170 may comprise the glazing 171 only and there may not be a backer 172. Other display items may be used in other embodiments, some of which will be described below. The glazing 171 may be formed from various transparent plastic or glass materials commonly used to form a glazing on a frame. The backer 172 may be formed from cardboard or similar material.

As used herein within the phrase "frame apparatus," the term apparatus means the equipment, parts, components, structures, or pieces that are used for a particular purpose. Thus, an apparatus may not refer to a singular component, but may instead refer to multiple components that are used together. For example, the frame apparatus 50 may include the frame 100 and the display item 170. As described further below, the frame apparatus 50 may also include additional items and accessories which are configured to be coupled to the frame 100 and therefore form part of the frame apparatus 50.

In this embodiment, the display item 170 is configured to be inserted into and removed from the display cavity 113 of the frame 100 as desired by the end user. Thus, the end user can swap out the artistic image 173 for another artistic image whenever desired. As noted previously and perhaps best shown in FIGS. 7A and 7B, when the display item 170 is positioned in the display cavity 113 of the frame 100, the display item 170 may abut against the top edge 125 of the inner annular wall 120. The display item 170 may also abut against the first and second struts 160, 161. Furthermore, the annular gap 105 exists between the back side of the display item 170 and the floor 130 of the frame 100. The apertures 141 form passageway from an exterior environment adjacent to a rear of the frame 100 to the annular gap 105. This may allow hooks, protuberances, male connectors, or the like to pass through the apertures 141 and into the annular gap 105 to facilitate attachment of an accessory item to the frame 100.

Figure 8A:
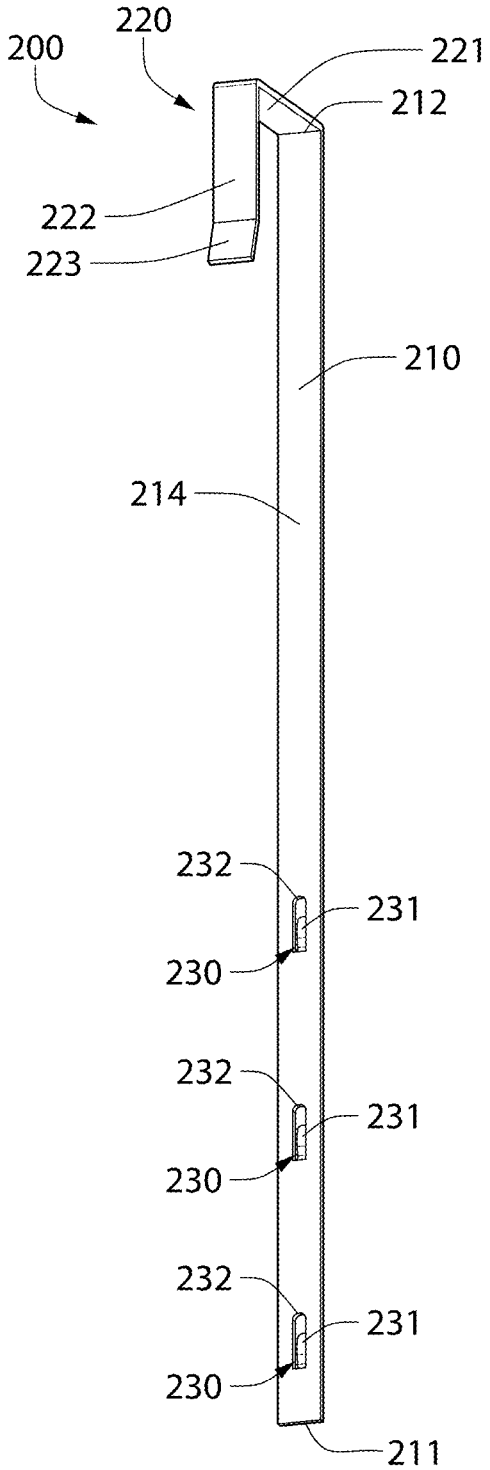
FIG. 8A is a perspective view of a hanging bracket in accordance with an embodiment of the present invention.
Figure 8B:
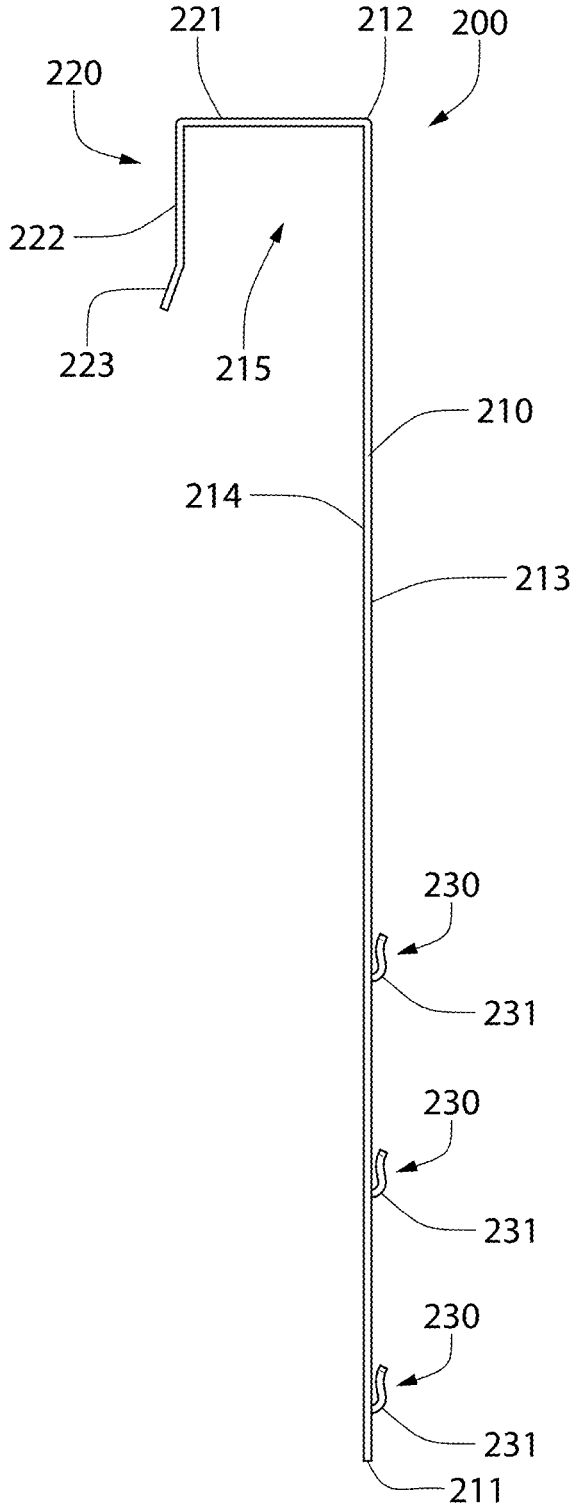
FIG. 8B is a side view of the hanging bracket of FIG. 8A.

Referring now to FIGS. 8A and 8B, a hanging bracket 200 will be described in accordance with an embodiment of the present invention. In some embodiments, the frame apparatus 50 may comprise one or two or more of the hanging brackets 200. Thus, the frame apparatus 50 may comprise the frame 100, the display item 170, and one or more of the hanging brackets 200 to facilitate the hanging of the frame 100 from a support surface. While one hanging bracket 200 will be described, it should be appreciated that if more than one of the hanging brackets 200 is used to hang the frame 100, the hanging brackets 200 will all be identical and thus the description below applicable.

The hanging bracket 200 comprises an elongated body portion 210 that extends from a first end 211 to a second end 212. The elongated body portion 210 comprises a front surface 213 and a rear surface 214 opposite the front surface 213. The elongated body portion 210 may form a flat plate such that the front and rear surfaces 213, 214 may be planar. The elongated body portion 210 may have a thickness measured between the front and rear surfaces 213, 213 of between 1-4 mm, or 1-3 mm. The hanging bracket 200 may be formed from metal, such as stamped metal in some embodiments.

The hanging bracket 200 may comprise a bracket portion 220 that protrudes from the rear surface 214 of the elongated body portion 210 at the second end 212 of the elongated body portion 210. The bracket portion 220 may comprise a horizontal arm portion 221 that extends generally perpendicularly from the rear surface 214 of the elongated body portion 210, a vertical arm portion 222 that extends downwardly from a distal end of the horizontal arm portion 221, and a tab portion 223 that extends obliquely from a distal end of the vertical arm portion 222 in a direction away from the elongated body portion 210. The vertical arm portion 222 is therefore spaced apart from the rear surface 214 of the elongated body portion 210 by a gap 215. This allows the hanging bracket 200 to be hung from a top edge of a door or other structure with a top portion of the door or other structure nesting in the gap 215, the elongated body portion 210 extending along one surface of the door or other structure, and the vertical arm portion 222 and the tab portion 223 extending along an opposite surface of the door or other structure.

The hanging bracket 200 further comprises at least one mounting element 230. In the exemplified embodiment, the hanging bracket 200 comprises a plurality of the mounting elements 230, and more particularly three of the mounting elements 230. However, the invention is not to be limited by the number of the mounting elements 230 included on the hanging bracket 200 in all embodiments and thus varying numbers of the mounting elements 230 may be used, such as one, two, three, four, or more.

In the exemplified embodiment, each of the mounting elements 230 is a protuberance 231 that protrudes from the front surface 213 of the elongated body portion 210 of the hanging bracket 200. In the exemplified embodiment, the protuberances 231 are stamped out of the elongated body portion 210 of the hanging bracket 200, and thus apertures 232 are formed into the elongated body portion 210 directly behind the protuberances 231. Of course, other techniques for forming the protuberances 231 may be used in other embodiments. In the exemplified embodiment, the protuberances 231 are hooks that extend outwardly from the front surface 213 of the elongated body portion 210 and upwardly towards the second end 212 of the elongated body portion 10. In alternative embodiments, the protuberances 231 may form posts that extend outwardly but not upwardly, or the protuberances 231 may form posts that extend outwardly and upwardly at a constant angle.

Thus, in the exemplified embodiment the mounting elements 230 are male connectors that are intended to mate with the female connectors (i.e., the apertures 141) on the frame 100. In other embodiments, the mounting elements 230 may be female connectors (i.e., apertures) and the mounting elements 140 on the frame 100 may comprise posts or hooks or protuberances configured to mate with apertures on the hanging brackets 200. As noted above, the intent is for the hanging brackets 200 to be configured to be coupled to the frame 100 using the mounting elements 140 of the frame 100 and the mounting elements 230 of the hanging brackets 200. Thus, if the mounting elements 140 of the frame 100 comprises the apertures 141 as shown in the exemplified embodiment, then the mounting elements 230 of the hanging brackets 200 may comprise the protuberances (or hooks or posts) 231 to facilitate the coupling. However, if the mounting elements 140 of the frame 100 comprises protuberances or posts, then the mounting elements 230 of the hanging brackets 200 may comprise holes or apertures (see, for example, FIGS. 21A and 21B, described further below). In some embodiments, the mounting elements 140, 230 of one of the frame 100 and the hanging brackets 200 may comprise a male feature (such as a post, a protuberance, a screw, or the like) and the mounting elements 140, 230 of the other one of the frame 100 and the hanging brackets 200 may comprise a female feature (such as a slot, an aperture, a hole, or the like). As such, the male/female features may be configured to mate with one another to facilitate the attachment of the hanging brackets 200 to the frame 100.

As used herein, the term mate generally means to connect or be connected mechanically. Thus, two structures which are described as mating or being mated are connected together mechanically. This connection may be achieved via sliding one structure relative to the other in a vertical or horizontal direction, pushing one structure towards the other, or via other functions or actions. In some embodiments, two mounting elements may be mated when one of the mounting elements (the male element) is at least partially located inside of or within or through the other one of the mounting elements (the female element). Thus, the mating may be achieved by inserting one mounting element (a male element) into another mounting element (a female element). The mating interaction may be as simple as a screw or other screw-like protuberance which is protruding from one of the frame 100 or the hanging bracket 200 being inserted into a hole which is formed into the other one of the frame 100 or the hanging bracket 200. Additional nuts and the like may be used to secure or lock the attachment of the two parts, but may not be required to achieve the mating between the various components or mounting elements thereof. That is, the term "mate" does not require that the two elements or components be locked together. Rather, two elements may be mated together by the simple action of inserting a post or protuberance into a hole or aperture, even though the two elements may be easily detached or un-mated by removing the post or protuberance from the hole or aperture.

Referring to FIGS. 9A-9D, the coupling of the hanging brackets 200 to the frame 100 will be described in accordance with an embodiment of the present invention. In accordance with the exemplified embodiment, two of the hanging brackets 200, including a first hanging bracket 200*a* and a second hanging bracket 200*b*, are used. In the embodiment shown, the first hanging bracket 200*a* is aligned with the first linear frame section 101 of the frame 100 and the second hanging bracket 200*b* is aligned with the second linear frame section 102 of the frame 100. However, in alternative embodiments the first hanging bracket 200*a* may be aligned with the third linear frame section 103 of the frame 100 and the second hanging bracket 200*b* may be aligned with the fourth linear frame section 104 of the frame 100. This may be dictated by the desired orientation, landscape or portrait, of the frame 100 on the support surface. Prior to attachment, the rear of the frame 100 (formed by the rear surface 132 of the floor 130 of the frame 100) is facing the front surface 213 of the elongated body portion 210 of the first and second hanger brackets 200*a*, 200*b*.

In the exemplified embodiment the first and second hanging brackets 200*a*, 200*b* are aligned with the first and second linear frame sections 101, 102 at a location which results in the hanging brackets 200*a*, 200*b* protruding or extending from the third linear frame section 103 when attached to the frame 100. However, the first and second hanging brackets 200*a*, 200*b* could alternatively be coupled to the frame 100 so that the hanging brackets 200*a*, 200*b* are aligned with the first and second linear frame sections 101, 102, respectively, while protruding or extending from the fourth linear frame section 104. The hanging brackets 200*a*, 200*b* may be coupled to the third and fourth linear frame sections 103, 104 in similar dual orientations so that the hanger brackets 200*a*, 200*b* may extend from the first or second linear frame sections 101, 102. This may be determined by the orientation of the display item which is held by the frame 100

Next, the mounting elements 230 (e.g., the protuberances or posts or hooks 231) of the first hanging bracket 200*a* are mated to the mounting elements 140 (e.g., the apertures 141) located along the floor 130 of the first linear portion 101 of the frame 100. This may be achieved by moving the first hanging bracket 200*a* towards the frame 100 (or moving the frame 100 towards the first hanging bracket 200*a*) until one or more of the protuberances 231 pass into one or more of the apertures 141. In the exemplified embodiment, two of the protuberances 231 are mated to a pair of the apertures 141, although mating between one protuberance 231 and one aperture 141 may be sufficient in alternative embodiments.

Similarly, the mounting elements 230 (e.g., the protuberances or posts or hooks 231) of the second hanging bracket 200*b* are mated to the mounting elements 140 (e.g., the apertures) located along the floor of the second linear portion 102 of the frame 100. This may be achieved by moving the second hanging bracket 200*b* towards the frame 100 (or moving the frame 100 towards the second hanging bracket 200*b*) until one or more of the protuberances 231 pass into one or more of the apertures 141. In the exemplified embodiment, two of the protuberances 231 are mated to a pair of the apertures, although mating between one protuberance 231 and one aperture 141 may be sufficient in alternative embodiments.

In an alternative embodiment shown in FIGS. 21A and 21B, the mounting elements 140 on the frame 100 are protuberances or hooks and the mounting elements 230 on the hanger brackets 200*a*, 200*b* are holes or apertures. The mounting elements 140 may be integrally formed with the frame 100. The mounting elements 140 may be formed separately from the frame 100 and coupled thereto. The hanger brackets 200*a*, 200*b* may be moved towards the frame 100 until the mounting elements 140 (i.e., protuberances or hooks) of the frame 100 extend into and through the mounting elements 230 (i.e., the holes or apertures) of the hanger brackets 200*a*, 200*b*. While in this embodiment the mounting elements 140 on the frame 100 are illustrated as downwardly extending hooks, the invention is not to be so limited. The hooks could instead be posts which protrude only perpendicularly or at an oblique angle relative to the rear of the frame 100. Such posts may be mated to the apertures of the hanger brackets 200*a*, 200*b* when the posts extend into and through the apertures of the hanger brackets 200*a*, 200*b*, with no locking engagement therebetween being required to achieve the mating. In such embodiments, the posts may be threaded so that nuts may be screwed thereon after the posts are mated to the apertures to lock the hanger brackets 200*a*, 200*b* to the frame 100. In yet another embodiment, the posts may have a flanged portion, such as a head of a screw, and the apertures may have a keyhole shape to facilitate the attachment without the need for any additional fastener elements such as bolts or the like to lock the components together. In another embodiment, the hanger brackets 200*a*, 200*b* and the frame 100 may both include male mounting elements that mate with one another to facilitate the attachment of the hanger brackets 200*a*, 200*b* to the frame 100. Many permutations of male/female and/or male/male mounting elements mating with one another to couple the hanger brackets 200*a*, 200*b* to the frame 100 may be used in alternative embodiments. Varying numbers of the mounting elements 140, 230 on the frame 100 and the hanger brackets 200*a*, 200*b* may also be used in different embodiments, including the frame 100 and the hanger brackets 200*a*, 200*b* having the same number of mounting elements 140, 230 or different numbers of mounting elements 140, 230.

Referring to FIGS. 9C-9F, the hanging of the frame apparatus 50 from a support structure 60 is illustrated and will be described. The support structure 60 may be a door as shown, although the invention is not to be so limited and any support structure with an exposed top edge could be used. For example, the support structure may be a cubicle, other temporary workstation wall which does not extend to the ceiling, or even a permanent wall which does not extend to the ceiling and therefore has a top edge which may be engaged by the bracket portions 220 of the hanger brackets 200. After the hanging brackets 200*a*, 200*b* are coupled to the frame 100 via mating between the mounting elements 230 (i.e., protuberances or hooks 231) of the hanging brackets 200*a*, 200*b* and the mounting elements 140 (i.e., apertures 141) of the frame 100, the bracket portions 220 of the hanger brackets 200*a*, 200*b* may be used to hang the frame apparatus 50 from a top edge 61 of the support structure 60. It should be noted that in other embodiments it may be possible to hang the hanging brackets 200*a*, 200*b* from the support structure 60 and then couple the frame 100 to the hanging brackets 200*a*, 200*b*.

When coupled to the support structure 60, the bracket portion 220 is positioned atop of the top edge 61 of the support structure 60 so that the horizontal arm portion 221 of the bracket portion 220 rests directly atop of the top edge 61 and the vertical arm portion 222 and the tab portion 223 lay along the rear 62 of the support structure 60. The elongated body portion 210 of the hanging brackets 200*a*, 200*b* lay along the front 63 of the support structure 60. Thus, the weight of the frame 100 is supported via the engagement between the bracket portion 220 of the hanging brackets 200*a*, 200*b* and the top edge 61 of the support structure 60.

In the exemplified embodiment, the hanging brackets 200*a*, 200*b* each have three of the protuberances 231. However, in the exemplified embodiment only two of the protuberances 231 are used at a time for coupling the hanging brackets 200*a*, 200*b* to the frame 100. This allows for adjustment in the hanging height of the frame 100. Specifically, by adjusting which of the protuberances 231 is mated with the two apertures 141, the height at which the frame 100 is hung from a support surface may be adjusted. Moreover, in other embodiments the attachment of the hanging brackets 200*a*, 200*b* to the frame 100 may be achieved with a single mounting element 230 of the hanger brackets 200*a*, 200*b* mating with a single mounting element 140 of the frame 100, and this may provide additional height adjustability in the hanging process.

Figure 9A:
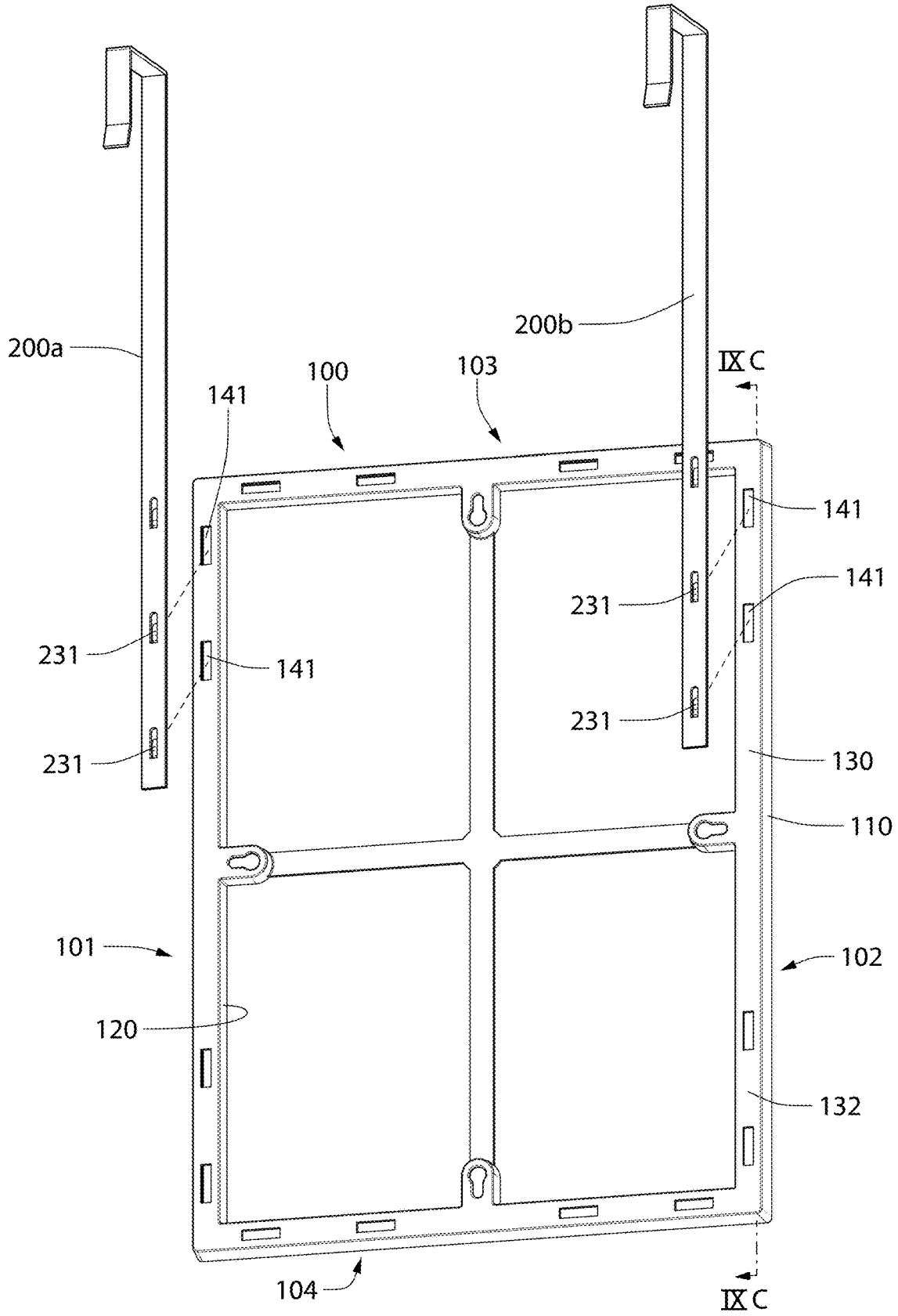
FIG. 9A illustrates two of the hanging brackets adjacent to a rear of the frame with dashed lines indicating a manner of attaching the hanging brackets to the frame.
Figure 9B:
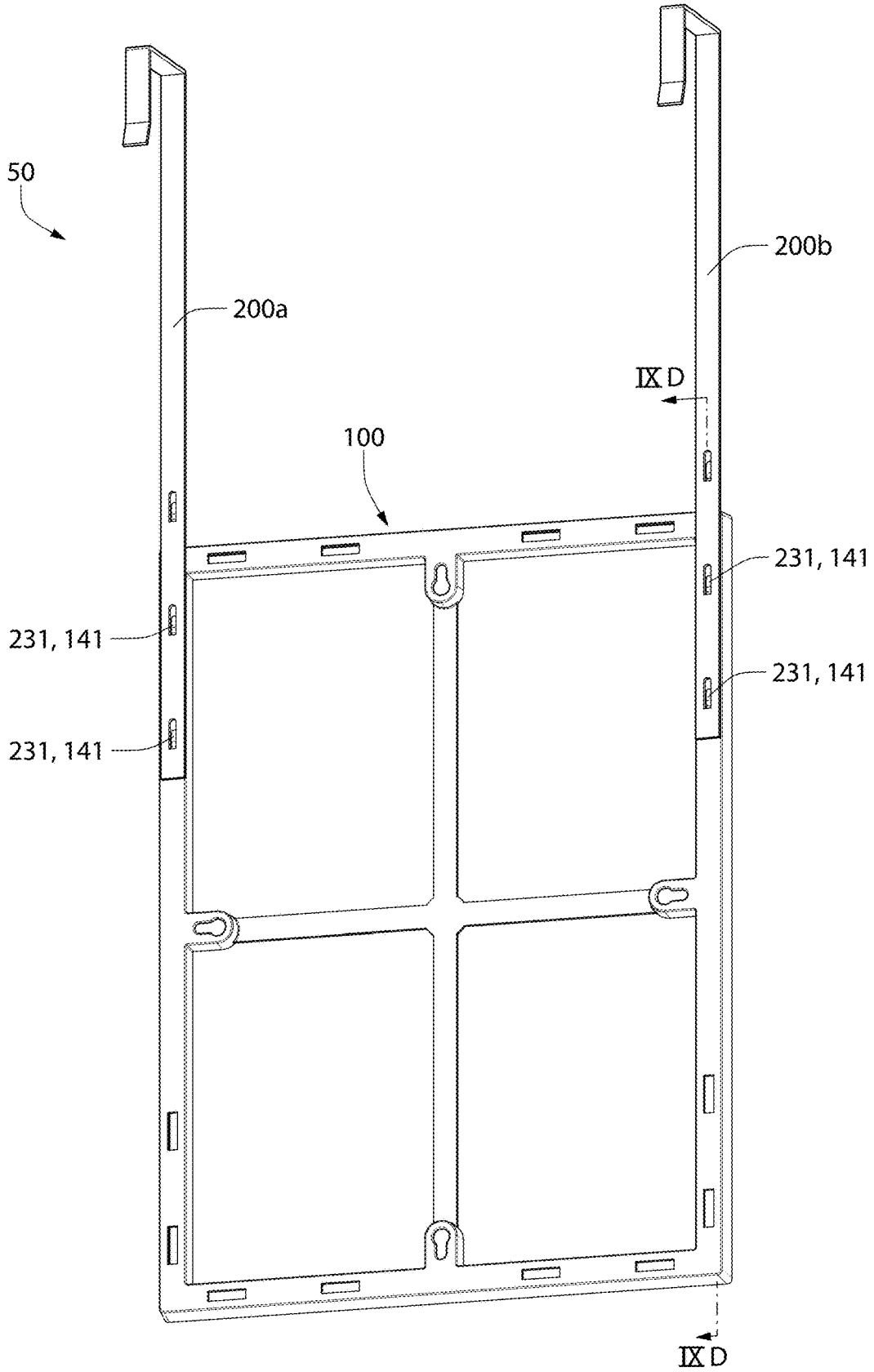
FIG. 9B illustrates the frame apparatus which includes the frame and two of the hanging brackets coupled thereto.
Figure 9C:
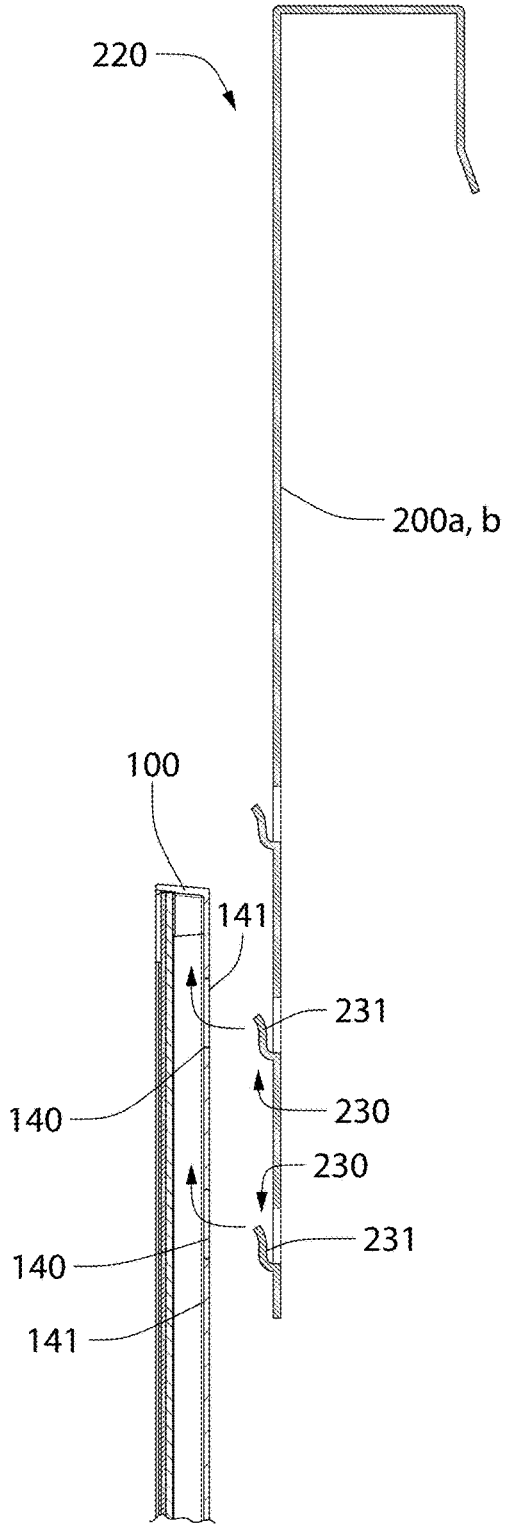
FIG. 9C is a cross-sectional view taken along line IXC-IXC.
Figure 9D:
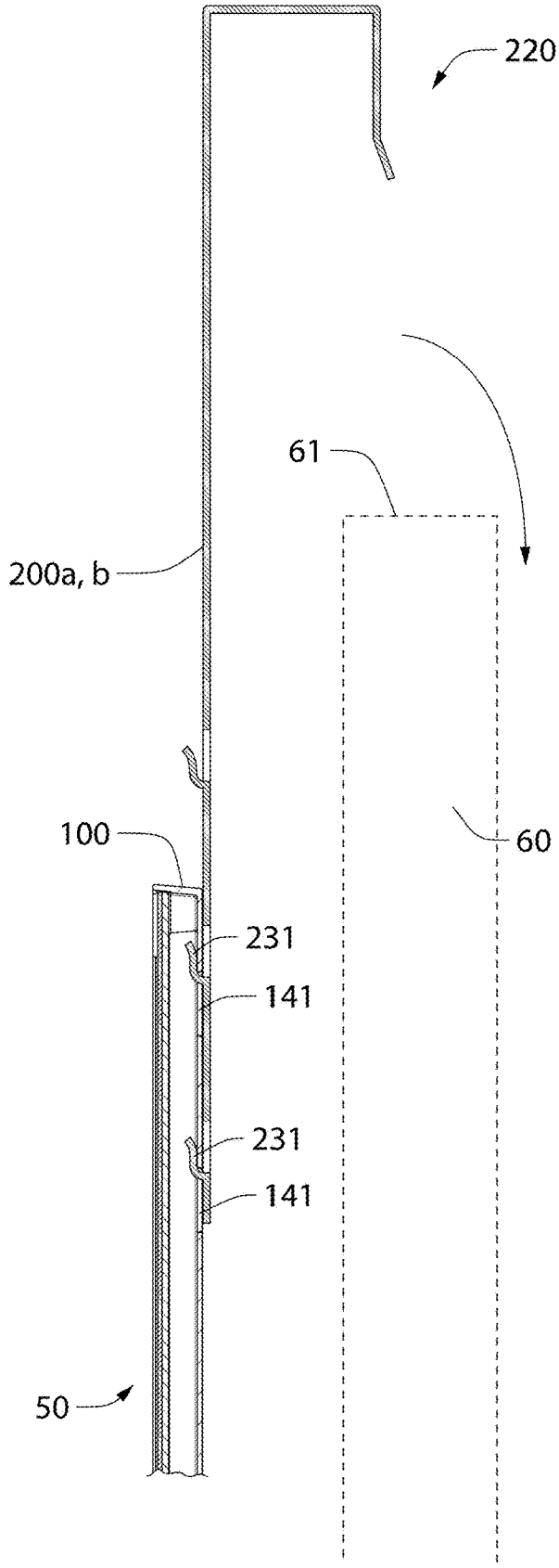
FIG. 9D is a cross-sectional view taken along line IXD-IXD, with the additional depiction of a support structure and an arrow indicative of a manner of hanging the frame apparatus from the support structure.
Figure 9E:
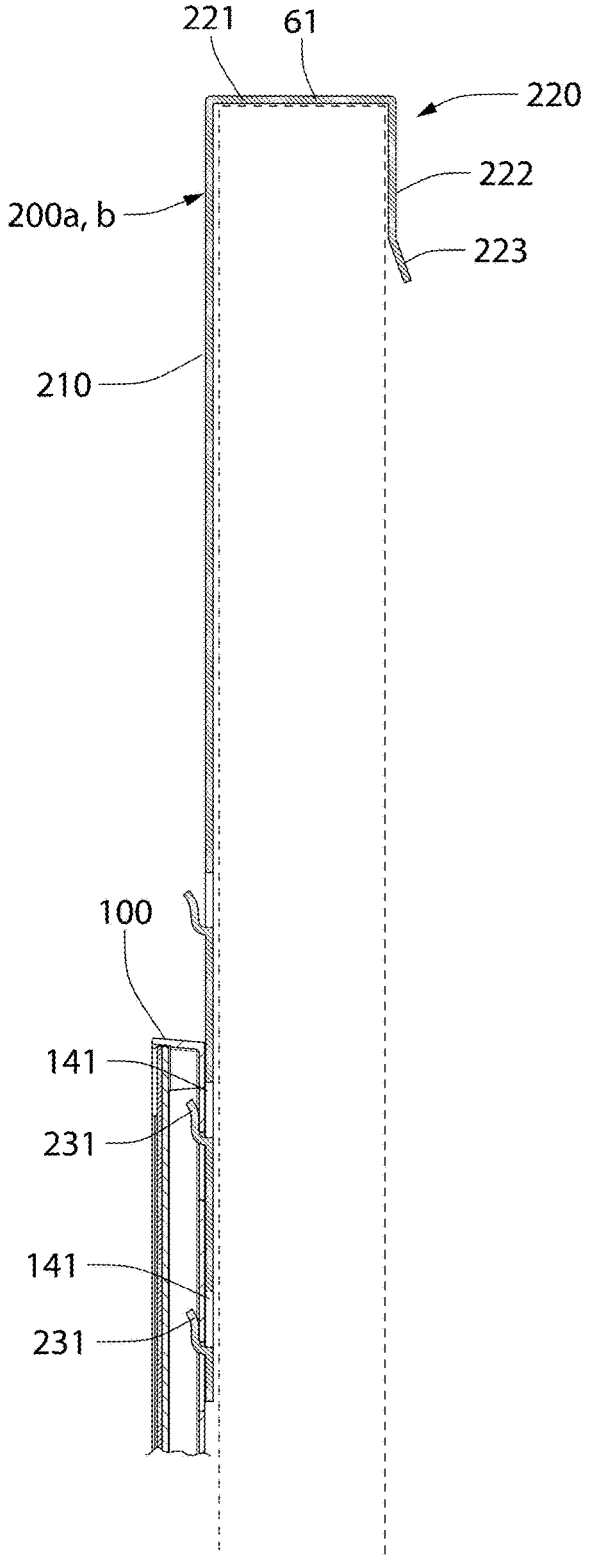
FIG. 9E is the cross-sectional view of FIG. 9D with the frame apparatus hanging from the support structure.
Figure 9F:
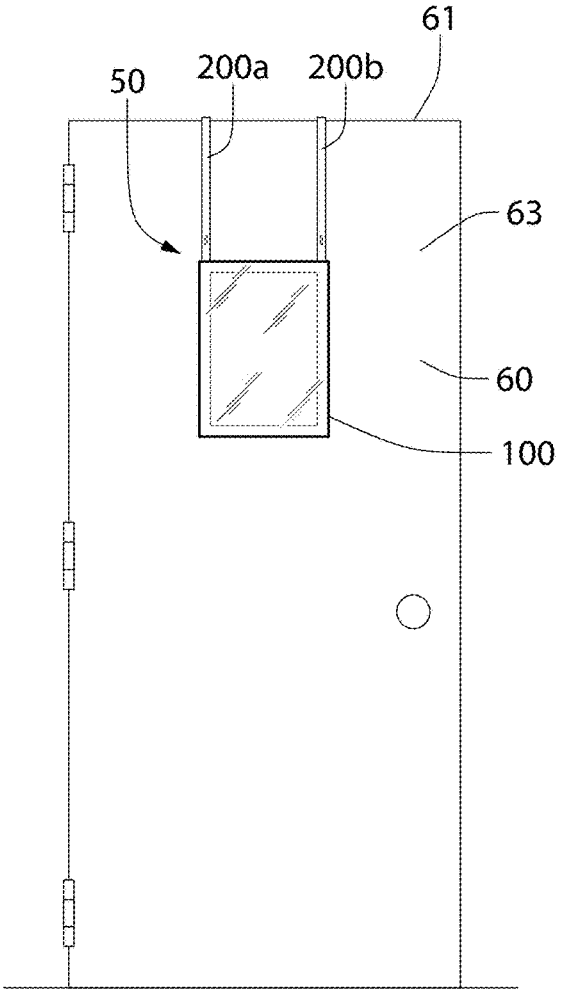
FIG. 9F is a front view illustrating the frame apparatus which includes the frame and the two hanging brackets hanging from a top edge of a door.
Figure 10A:
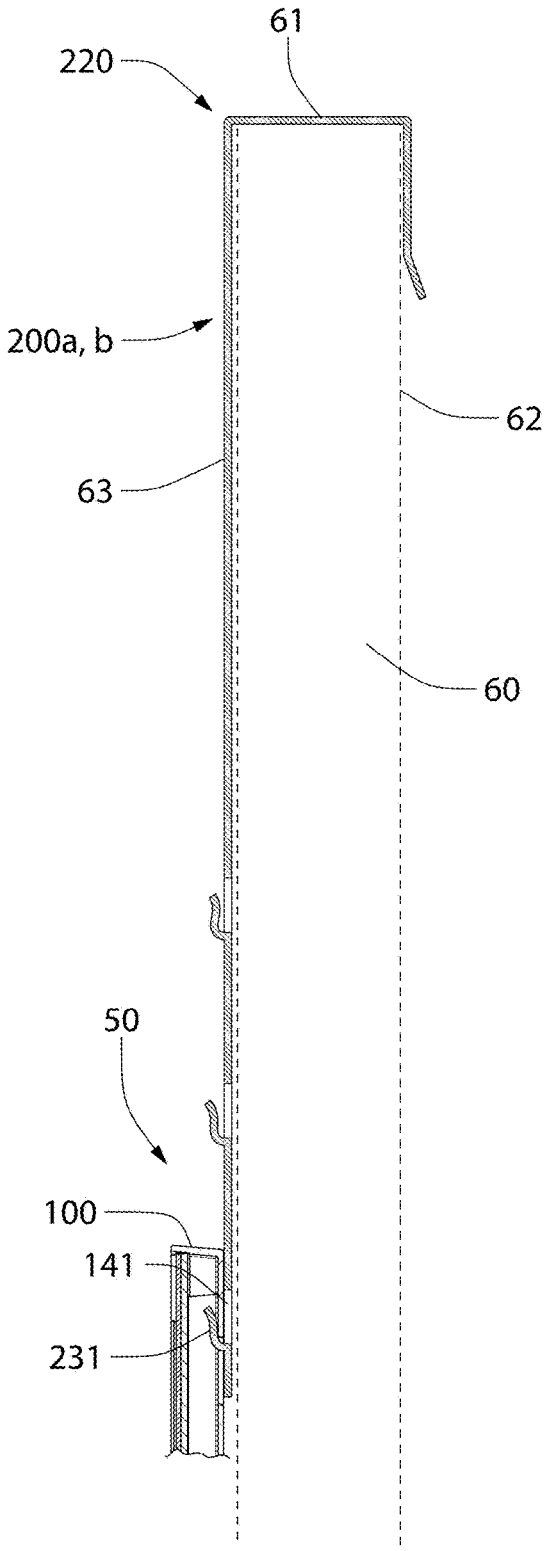
FIG. 10A is the cross-sectional view of FIG. 9E with the frame hanging at an alternative height.
Figure 10B:
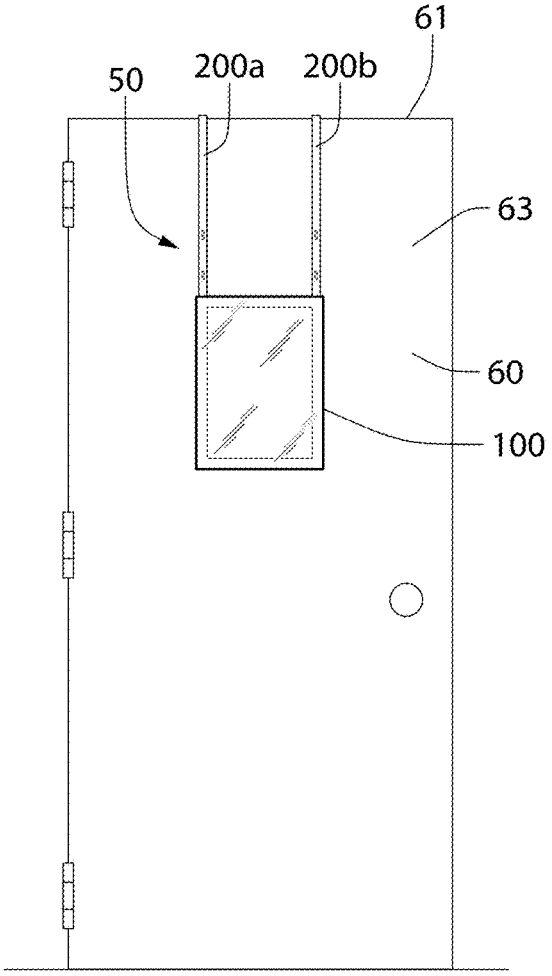
FIG. 10B is a front view illustrating the frame hanging at the alternative height in accordance with FIG. 10A.

FIGS. 10A and 10B illustrate the hanging brackets 200*a*, 200*b* coupled to the frame 100 with the frame 100 at a different height than in FIGS. 9E and 9F. In particular, the pair of apertures 141 of the frame 100 are mated to the two lower protuberances 131 of the hanging brackets 200*a*, 200*b*, which lowers the frame 100 when the frame apparatus 50 is hung from the support structure 60 as previously described.

As noted herein, the number of the mounting elements 230 (or protuberances 231) of the hanging brackets 200 and the number of the mounting elements 140 (or apertures 141) of the frame 100 may be modified from that which is shown in the exemplified embodiment. Thus, in one embodiment the hanging bracket 200 may include just one protuberance 231 that mates with a selected one of the apertures 141 on the frame 140. The protuberance 231 may be a single hook at the first end 211 of the elongated body portion 210 of the hanging bracket 200 or located between the first and second ends 211, 212. In other embodiments, the hanging bracket 200 may include two protuberances 231 that mate with two of the apertures 141 on the frame 140.

In the exemplified embodiment, the frame 100 comprises multiple pairs of the mounting elements 140 (i.e., apertures 141) on each of the linear frame portions 101-104 thereof. Thus, the frame 100 may be coupled to the hanging brackets 200 in many different configurations depending on how the display item is positioned within the frame 100 and therefore the orientation at which it is desired to display the frame 100.

Figure 13:
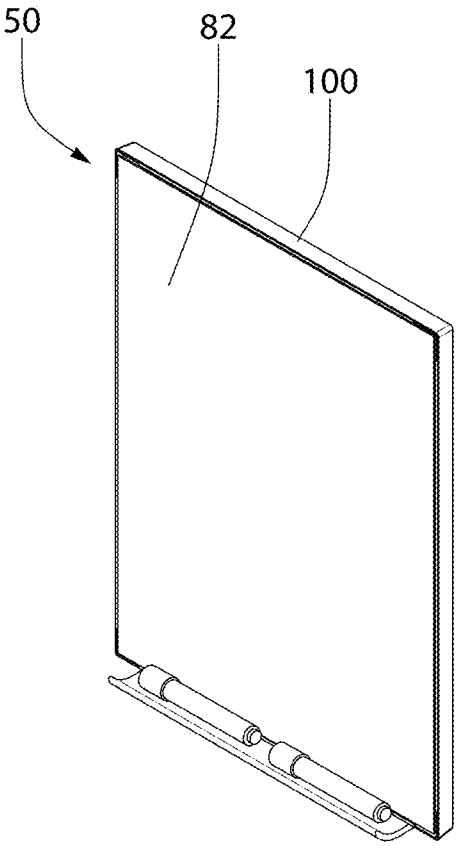
FIG. 13 is a front view of a frame apparatus which includes a frame and a whiteboard.
Figure 12:
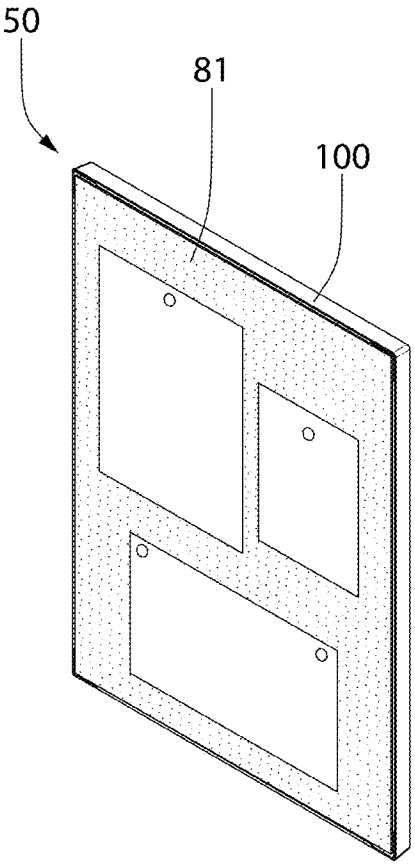
FIG. 12 is a front perspective view of a frame apparatus which includes a frame and a corkboard or pegboard.
Figure 11:
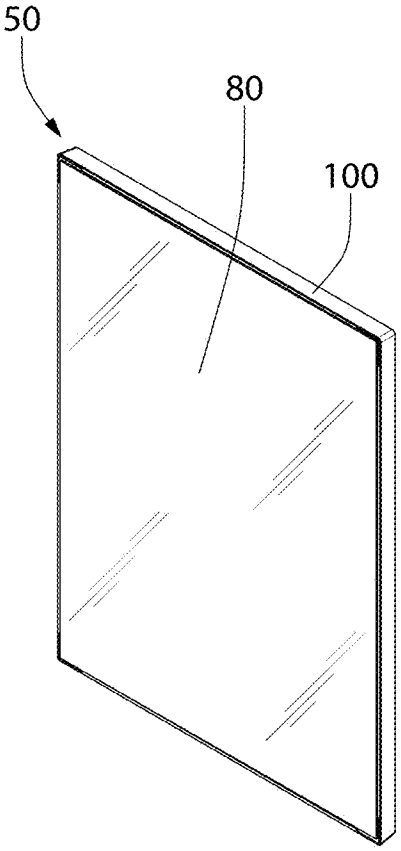
FIG. 11 is a front perspective view of a frame apparatus which includes a frame and a mirror.
Figure 14A:
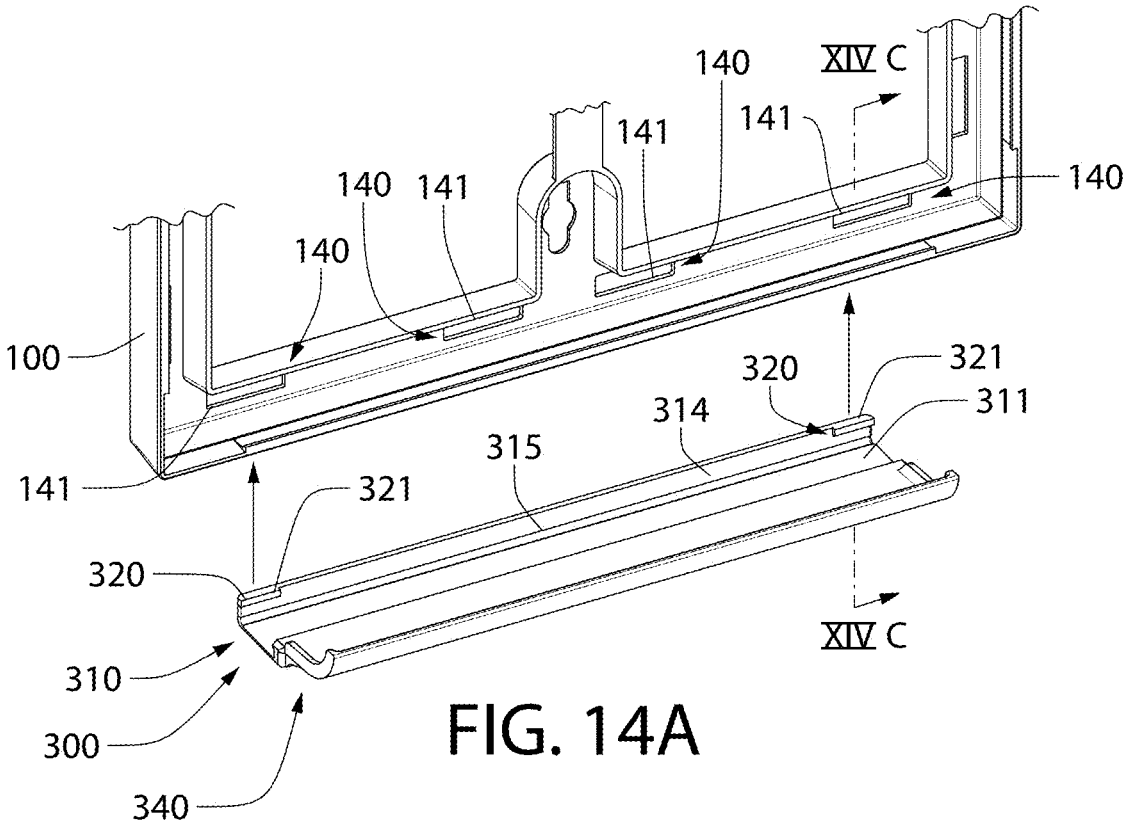
FIGS. 14A and 14B are partial views illustrating the coupling of a tray attachment to the frame.
Figure 14B:
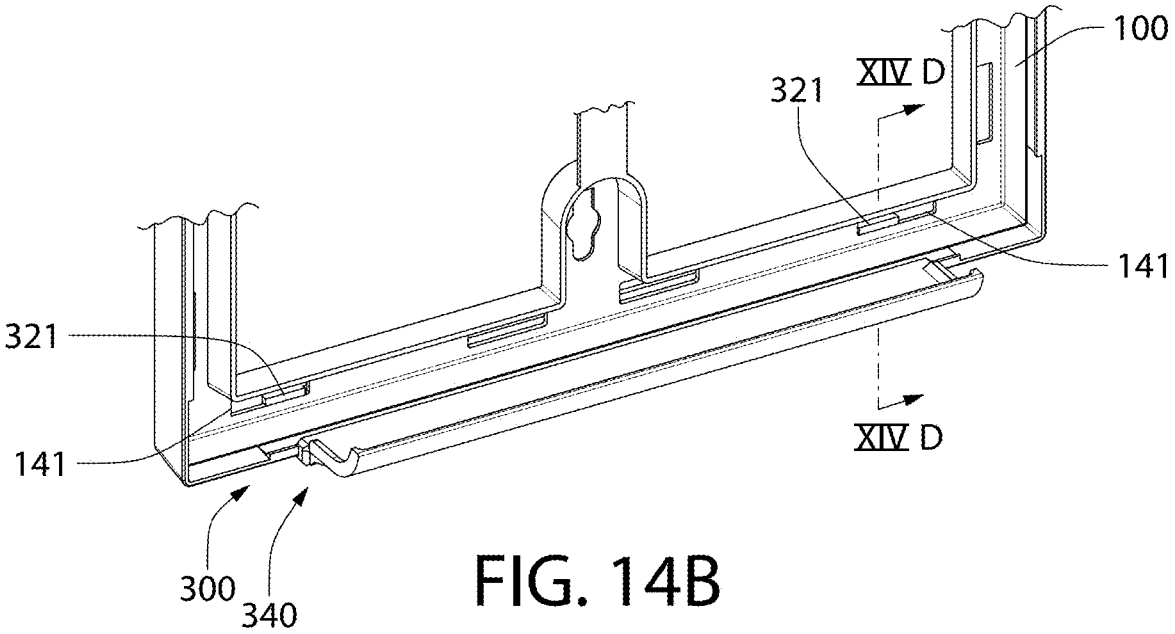
Figure 14D:
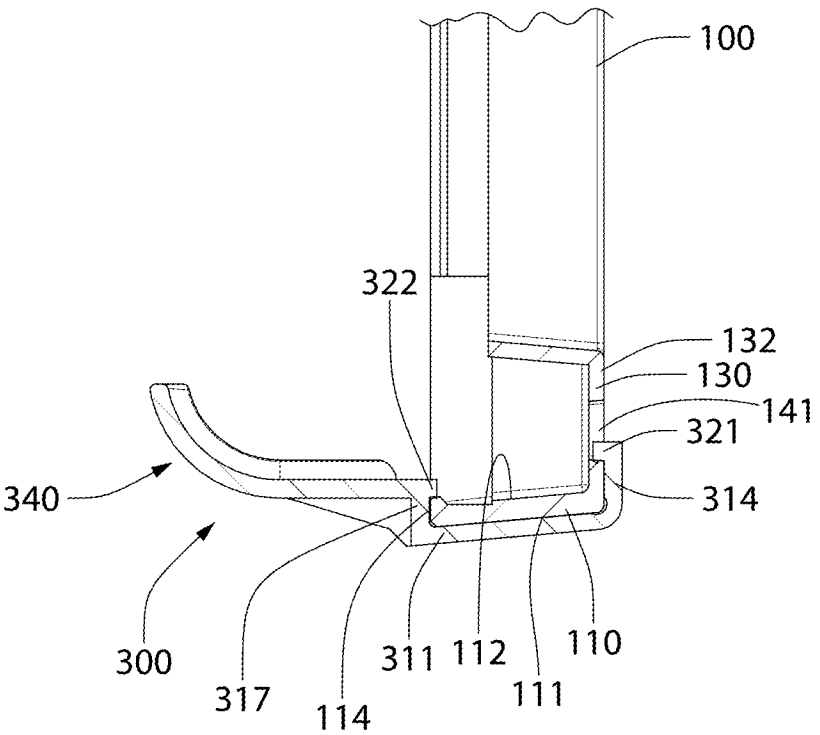
FIG. 14D is a cross-sectional view taken along line XIVD-XIVD of FIG. 14B.
Figure 14C:
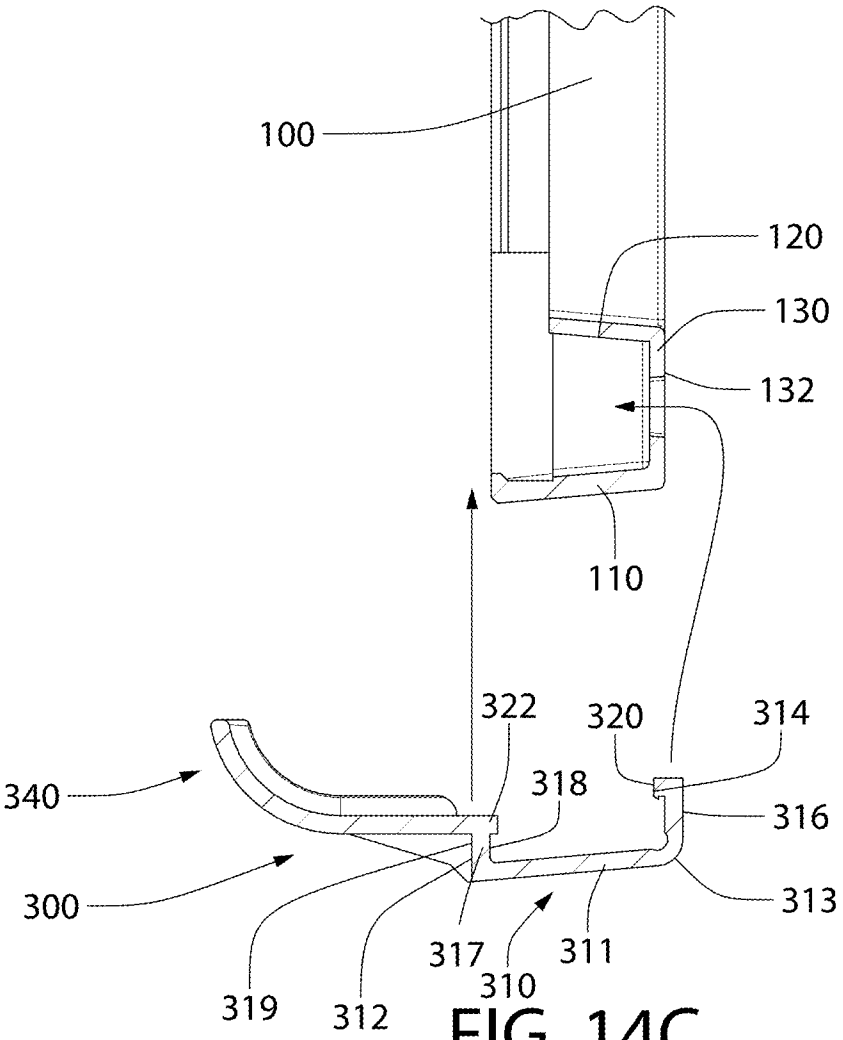
FIG. 14C is a cross-sectional view taken along line XIVC-XIVC of FIG. 14A.

As mentioned above, the frame 100 may be used to support a variety of different types of items or display items. The display item may be a glazing and a backer as described previously. Alternatively, the display item may be a mirror 80 (plastic or glass) as shown in FIG. 11, a corkboard 81 as shown in FIG. 12, or a whiteboard 82 as shown in FIG. 13. The display item may also be a pegboard. Any of the mirror 80, the corkboard 81, and the whiteboard 82 (or other display item) may be sized and configured to be positioned within the display cavity of the frame 100. In these embodiments, the mirror 80, the corkboard 81, and the whiteboard 82 may be permanently attached to the frame 100, such as using permanent adhesives like glue or epoxy. Because the frame 100 includes the mounting elements as described previously, the framed apparatus 50 which includes the frame 100 and any one of the mirror 80, the corkboard 81, and the whiteboard 82 may be configured to be hung from a support surface such as a top edge of a door or a cubicle or other similar structure.

In embodiments that use the whiteboard 82, the whiteboard may be blank as shown, or may include indicia permanently affixed thereto. For example, the whiteboard 82 could comprise indicia that transforms the whiteboard 82 into a calendar, a crossword, a game such as dots or tic-tac-toc. The possibilities go far beyond these examples and allow the frame apparatus 50 to be utilized for a variety of different purposes. In some embodiments, the display item may include a glazing and a game sheet which can be placed behind the glazing and replaced as desired. The glazing may be capable of being written on with a dry erase marker to markup regions aligned with the game sheet for game play. In such embodiments, the glazing may be detached from the frame to allow a user to change out the game sheet or may be permanently affixed to the frame.

In FIG. 13, in addition to the whiteboard 82 being the display item which is held within the display cavity of the frame 100, there is also a tray attachment 300 that is coupled to the frame 100. In this embodiment, the frame 100, the whiteboard 82 (or any other display item which may be used in place of the whiteboard 82), and the tray attachment 300 collectively form the frame apparatus 50. As noted previously, the hanger brackets 200 may also form part of the frame apparatus 50 along with any of one or more of the components noted here.

Referring to FIGS. 14A-14D, the tray attachment 300 and the manner of attaching the tray attachment 300 to the frame 100 will be described. The tray attachment 300 comprises a mounting portion 310 that facilitates the coupling of the tray attachment 300 to the frame 100 and a tray portion 340 which may be used to support items such as markers, pins, erasers, writing instruments, or the like to enhance the functionality of the frame apparatus 50.

The mounting portion 310 of the tray attachment 300 may comprise a horizontal wall 311 having a front end 312 and a rear end 313 and a vertical wall 314 that extends upwardly from the rear end 313 of the horizontal wall 311. The vertical wall 314 may comprise a front surface 315 that faces the horizontal wall 311 and a rear surface 316 opposite the front surface 315. There may be at least one mounting element 320 located on the front surface 315 of the vertical wall 314. In the exemplified embodiment, the at least one mounting element 320 is a locking tab (or protuberance) 321 that protrudes from the front surface 315 of the vertical wall 314. More specifically, in the exemplified embodiment there are two of the locking tabs 321 protruding from the front surface 315 of the vertical wall 314 in a spaced apart manner.

There may be an intermediate vertical wall 317 extending upwardly from the front end 312 of the horizontal wall 311. The intermediate vertical wall 317 may comprise an inner surface 318 that faces the vertical wall 314 and an outer surface 319 opposite the inner surface 318. There may be a lip 322 protruding from the inner surface 318 of the intermediate vertical wall 317 at a location adjacent to a distal end of the intermediate vertical wall 317.

The tray portion 340 of the tray attachment 300 may extend from the outer surface 319 of the intermediate vertical wall 317. The tray portion 340 may comprise a concave upper surface 341 and a convex lower surface 342. Alternatively, the tray portion 340 may be flat or planar with a vertically oriented stopper wall located at a distal end thereof to help retain any items placed thereon.

The tray attachment 300 may be coupled to the frame 100 via mating between the at least one mounting element 320 or locking tab 321 of the mounting portion 310 of the tray attachment 300 and one or more of the mounting elements 140 or apertures 141 of the frame 100. In particular, the tray attachment 300 may be positioned with the lip 322 in engagement with the inner surface 112 of the outer annular wall 110 of the frame 100 and the intermediate vertical wall 317 abutting against the front edge 114 of the outer annular wall 110. The tray attachment 300 may then be pivoted or rotated until the horizontal wall 311 abuts against the outer surface 111 of the outer annular wall 110 of the frame 100 and the vertical wall 314 abuts the rear surface 132 of the floor 130 of the frame 100. When so positioned, the mounting elements 320 (i.e., the locking tabs 321) mate with corresponding ones of the apertures 141 in the floor 130 of the frame 100 to couple the tray attachment 300 to the frame 100. While in the exemplified embodiment the mounting elements 320 are tabs that mate with the apertures 141 in the frame 100, in other embodiments the frame 100 may comprise protuberances (male features) which mate with apertures or slots (female features) of the tray attachment 300 to facilitate the coupling of the tray attachment 300 to the frame 100. In either case, the mounting elements 320 of the tray attachment 300 may be configured to mate with the mounting elements 140 of the frame 100 to facilitate the attachment of the tray attachment 300 to the frame 100.

Thus, the same mounting elements 140 (i.e., the apertures 141) of the frame 100 which may be used for attaching the hanging brackets 200 to the frame 100 may also be used for attaching the tray attachment 300 to the frame 100. Other types of accessories may be attached to the frame in similar ways using the same mounting elements 140 of the frame 100. In an embodiment, the hanging brackets 200 and the tray attachment 300 (or other accessory) may be coupled to the frame 100 at the same time. For example, the hanging brackets 200 may be coupled to the frame 100 via mating between the mounting elements 230 of the hanging brackets 200 and the mounting elements 140 located along the first and second linear frame portions 101, 102 of the frame 100. This leaves the mounting elements 140 located along the third and fourth linear frame portions 103, 104 of the frame 100 available for mating with mounting elements of the accessories such as the tray attachment 300. Thus, the tray attachment 300 may be mounted to the frame 100 via mating between the mounting elements 320 of the tray attachment 300 and the mounting elements 140 located along one of the third and fourth linear frame portions 103, 104 of the frame 100 without disturbing the attachment of the hanging brackets 200 to the frame 100. Additional accessories may be attached to the frame 100 as space and the availability of mounting elements 140 on the frame 100 which are not being used by other accessories or otherwise covered by the other accessories.

Moreover, while in the exemplified embodiment the frame 100 comprises apertures 141 (or female attachment elements) and the accessories like the hanging brackets 200 and the tray attachment 300 have protuberances or male attachment elements, the reverse may be true in alternative embodiments. For example, instead of the apertures 141, the frame 100 may comprise protuberances such as posts or hooks or the like protruding from the rear surface 132 of the floor 130. Such protuberances such as posts or hooks or the like may mate with apertures or slots or the like formed into the hanging brackets 200, the tray attachment 300, or other accessories that may be coupled to the frame 100. The mounting elements of the different components may be capable of being connected mechanically regardless of their specific structure.

Furthermore, the tray attachment 300 is merely one type of accessory that can be coupled to the frame 100 using the mounting elements described herein. Other types of accessories may be used. For example, a writing instrument holder may be configured to be coupled to the frame 100 perhaps along one of the sides of the frame 100 rather than along the bottom of the frame as with the tray attachment 300. These different accessories may be snap-fit connected or otherwise attached to the frame 100 using the mounting elements 140, the connector holes 150-153, or various other structures located along the frame 100.

Referring to FIG. 15, a connector bracket 400 is illustrated in accordance with an embodiment of the present invention. The connector bracket 400 comprises an elongated body portion 410 having a front surface 411 and a rear surface 412 opposite the front surface 411. The elongated body portion 410 extends from a bottom end 413 to a top end 414 along a longitudinal axis Z-Z. The connector bracket 400 further comprises a plurality of mounting elements 420. In the exemplified embodiment, the mounting elements 420 comprise first and second protrusions 421*a*, 421*b* such as hooks or posts that protrude from the front surface 411 of the elongated body portion 410. However, the invention is not to be so limited in all embodiments. As previously described, the mounting elements 420 may comprise apertures or slots or holes instead of protruding features depending on the structure of any mounting elements on the frame 100 with which the mounting elements 420 of the connector bracket 400 are configured to mate.

In the exemplified embodiment, there are two of the first protrusions 421*a* and two of the second protrusions 421*b*.

Each of the first protrusions 421*a* protrudes from the front surface 411 of the elongated body portion 410 outwardly and then downwardly towards the bottom end 413 of the elongated body portion 410. Each of the second protrusions 421*b* protrudes from the front surface 411 of the elongated body portion 410 outwardly and then upwardly towards the top end 414 of the elongated body portion 410. The protrusions 421*a* may be located closer to the top end 414 than to the bottom end 413 and the protrusions 421*b* may be located closer to the bottom end 414 than to the top end 414. The two first protrusions 421*a* are located adjacent to one another without any of the second protrusions 421*b* located therebetween, and the two second protrusions 421*b* are located adjacent to one another without any of the first protrusions 421*a* located therebetween. The two first protrusions 421*a* and the two second protrusions 421*b* may be spaced apart by the same distance.

The connector bracket 400 may be used to connect two frames together. That is, a first frame may be hung from a support surface as previously described, and a second frame may be hung from the first frame via the connector bracket 400. This will be described in some detail below with reference to FIGS. 16A-17B.

FIG. 16A illustrates the connector bracket 400 being coupled to a frame, which will be referred to here as a second frame 100*b*. The second frame 100*a* is identical to the frame 100 described above. The connector bracket 400 may be coupled to the second frame 100*b* via mating between one of the second protrusions 421*b* of the connector bracket 400 and one of the connector holes 150-153 of the second frame 100*b*. In the embodiment shown, the connector hole 152 is used, but any of the connector holes 152 may be used depending on the orientation at which the second frame 100*b* is desired to be hung from a first frame. Moreover, in other embodiments the connector bracket 400 may be coupled to the frame 100 via engagement between the protrusions 421*a*, 421*b* of the connector bracket 400 and the mounting elements 140 or apertures 141 previously described. This may require a modification to the structure of the protrusions 421*a*, 421*b*. In other embodiments, the connector holes 150-153 are used for attaching the connector bracket 400 to the frame 100 which leaves the mounting elements 140 available for attaching the hanger brackets 200*a*, 200*b*, attachment tray 300, and other accessories to the frame 100.

In the exemplified embodiment, one of the protrusions 421*b* of the connector bracket 400 is inserted into one of the connector holes 150-153 of the second frame 100*b* to mate the protrusion 421*b* to the connector hole 152 and thereby couple the connector bracket 400 to the second frame 100*b*. Of course, as has been described several times herein, the second frame 100*b* may comprise protrusions instead of holes and the connector bracket 400 may comprise holes instead of protrusions. In some embodiments, one of the second frame 100*b* and the connector bracket 400 has male connector features and the other one of the second frame 100*b* and the connector bracket 400 has female connector features that mates with the male connector features to couple the second frame 100*b* to the connector bracket 400.

FIG. 16B illustrates the connector bracket 400 coupled to the second frame 100*b* and in position to also be coupled to a first frame 100*a*. Specifically, the connector bracket 400 may be coupled to the first frame 100*a* via mating between one of the first protrusions 421*a* of the connector bracket 400 and one of the connector holes 150-153 of the first frame 100*a*, which in the exemplified embodiment is the connector hole 153. Because the first protrusions 421*a* extend outwardly and downwardly from the elongated body portion 410 of the connector bracket 400, the connector bracket 400 is able to hang, via gravity, from the first frame 100*a*, with the second frame 100*b* then hanging from the connector bracket 400.

It should be noted that because the connector bracket 400 is coupled to the frame at the connector holes 150-153 in the exemplified embodiment, it does not interfere with the ability of accessories such as the hanger brackets 200*a*, 200*b* and the tray attachment 300 to be coupled to the frame 100. As an example, in FIG. 16B there are two hanger brackets 200*a*, 200*b* coupled to the first frame 100*a* using the mounting elements 140 (i.e., the apertures 141) located along the first and second linear frame portions 101, 102 of the first frame 100*a*. The connector bracket 400 is still able to be engaged with the connector hole 153 located along the third linear frame portion 104 of the first frame 100*a* as shown. Furthermore, in the exemplified embodiment the connector bracket 400 does not mate with any of the mounting elements 140 or apertures 141 located along the fourth linear frame portion 104 of the first frame 100*a*. Thus, it may still be possible to couple a tray attachment 300 (or other accessory, such as a hook accessory, a mesh accessory, or the like) to the first frame 100*a* using the mounting elements 140 located along the fourth linear frame portion 104 of the first frame 100*a* even when the connector bracket 400 is being used as shown.

FIG. 16C illustrates the final assembly with the connector bracket 400 coupled to each of the first and second frames 100*a*, 100*b* while the hanger brackets 200*a*, 200*b* remain coupled to the first frame 100*a* using the techniques and mating of mounting elements of the components as described herein. The combination of the first and second frames 100*a*, 100*b*, the hanger brackets 200*a*, 200*b*, and the connector bracket 400 may form the frame apparatus 50 in accordance with embodiments of the present invention.

FIG. 17A is a cross-sectional view which better illustrates the mating of the protrusions 421*a*, 421*b* of the connector bracket 400 with the apertures 421 of the first and second frames 100*a*, 100*b*. In other embodiments, the connector bracket 400 may comprise apertures that mate with protrusions that protrude from the rear of the frames 100*a*, 100*b*. In still other embodiments, the frames 100*a*, 100*b* may comprise protrusions that mate with protrusions on the connector bracket 400. That is, instead of a protrusion fitting into a hole, both of the components (the connector bracket 400 and the frame 100) may have protrusion that interlock with one another to form the mating which couples the components together.

FIG. 17B illustrates the frame apparatus 50 hanging from the support structure 60, which may be a door as shown or another structure with an exposed top edge such as a cubicle, a wall which terminates short of the ceiling, or the like. As seen, the hanging brackets 200*a*, 200*b* engage the top edge of the support structure 60. The hanging brackets 200*a*, 2060 are coupled directly to the first frame 100*a* via the mating between the mounting elements of the hanging brackets 200*a*, 200*b* and the mounting elements of the first frame 100*a*, as described previously. The second frame 100*b* is then coupled to the first frame 100*a* indirectly via the connection bracket 400. Thus, the second frame 100*b* hangs from the first frame 100*a* via the connection bracket 400 which extends between the first and second frames 100*a*, 100*b*.

In FIG. 17B, there are two of the frame apparatuses 50 shown, each including two frames 100*a*, 100*b*, two hanging brackets 200*a*, 200*b*, and a connector bracket 400. However, in the image on the right the second frame 100*b* is hanging higher than in the image on the left due to the different ones of the mounting elements 420 of the connector bracket 400 being mated with the connection elements 150-153 of the frames 100*a*, 100*b*. However, in each variation there is a portion of the connector bracket 400 extending between the first and second frames 100*a*, 100*b*.

FIG. 17C illustrates a plurality of the frames 100*a*, 100*b* coupled to the top edge of the door 60 in accordance with another embodiment. In particular, in this embodiment there is one hanging bracket 200*a* coupled to one of the top frames 100*a* and another hanging bracket 200*b* coupled to another one of the top frames 100*a*. Thus, there are not two hanger brackets 200*a*, 200*b* used for each of the top frames 100*a*, but instead one for each. In alternative embodiments, there may still be two hanger brackets 200*a*, 200*b* used for each frame 100*a* which is hanging directly from the top edge of the door 60. The top frames 100*a*, 100*a* may then be coupled together using one or more connector brackets 400*a* with the connector brackets 400*a* being oriented horizontally. The connector brackets 400*a* may be identical to the connector brackets 400 described previously, or may be modified slightly. In particular, the length of the connector brackets 400*a* may be modified and/or the structure and/or configuration of the mounting elements of the connector brackets 400*a* may be modified to facilitate engagement with the top frames 100*a*.

In the embodiment shown, three of the connector brackets 400*a* are illustrated connecting the frames 100*a*, 100*a* together. However, in other embodiments there may be only one of the connector brackets 400*a* connecting the top frames 100*a* together, or there may be two of the connector brackets 400*a*. Furthermore, the connector brackets 400*a* may be configured to be coupled to the frames 100*a* via the mounting elements 140 (for example, the apertures 141). Alternatively, or additionally, the connector brackets 400*a* may be configured to be coupled to the frames 100*a* via the connector holes 150-153. The connector brackets 400*a* may include mounting elements, which may be male or female depending on the structure of the frame 100*a* to which they are attached.

Referring to FIGS. 18A-18C, a frame 500 is illustrated in accordance with an embodiment of the present invention. The frame 500 is very similar to the frame 100 in that it includes an outer annular wall 510, an inner annular wall 520, and a floor 530 extending between the inner and outer annular walls 510, 520. The frame 500 also includes mounting elements 540 formed into the floor 530. The mounting elements 540 comprise apertures 541 as with the prior described embodiments, but could be protrusions or hooks or posts or the like in other embodiments. The frame 500 also comprises struts 550, 551.

The main difference between the frame 500 and the frame 100 which was previously described is the inclusion of an easel member 560 which is integrally formed with the rest of the frame 500. The struts 550, 551 may also comprise connection features 552, 553 that define slots 554, 555 to which the easel member 560 is configured to be coupled when separated from the rest of the frame 500 as described herein below.

With reference to FIGS. 19A and 19B, the easel member 560 may be detached from the rest of the frame 500 by the user gripping and twisting the easel member 560 relative to the remainder of the frame 500. Once the easel member 560 is separated from the frame 100, the easel member 560 may be attached to one of the connection features 552, 553 as shown in FIG. 19B. Depending on the orientation (portrait or landscape) at which it is desired to maintain the frame 500, the easel member 560 may be coupled to the appropriate one of the connection features 552, 554. This may be used to support the frame 500 on a tabletop rather than hanging the frame 500 from a support surface such as a wall or a door.

Referring to FIGS. 20A-20O, a product line of frames 600A-600O is illustrated in accordance with an embodiment of the present invention. The product line may include any of two or more of the frames 600A-600O shown in these figures. The frames 600A-600O all includes the connection features and mounting elements as described herein, although there may be some variation in the number of connection features and mounting elements as dictated by the dimensions or size of the frame.

FIG. 20A illustrates the frame 600A. The frame 600A has a first length L1 and a first width W1. Furthermore, the frame 600A comprises exactly two of the apertures 641A located along each of the linear frame portions thereof. That is, along each of the linear frame portions of the frame 600A, there is a first aperture 642A and a second aperture 643A. Furthermore, along each of the linear frame portions of the frame 600A, the first aperture 642A is spaced from the second aperture 643A by a distance $D_A$. That is, the first and second apertures 642A, 642B along each of the linear frame portions of the frame 600A is spaced from one another by the same distance. The frame 600A may be a 4×4 inch frame such that the first length L1 and the first width W1 are both four inches.

FIG. 20B illustrates the frame 600B. The frame 600B has a second length L2 and a second width W2. The second length L2 of the frame 600B may be larger than the first length L1 of the frame 600A. The second width W2 of the frame 600B may be the same as or larger than the first width W1 of the frame 600A. Like the prior embodiment, the frame 600B comprises exactly two of the apertures 641B located along each of the linear frame portions thereof. That is, along each of the linear frame portions of the frame 600B, there is a first aperture 642B and a second aperture 643B. Furthermore, along each of the linear frame portions of the frame 600B, the first aperture 642B is spaced from the second aperture 643B by the distance $D_A$. Thus, despite the fact that the frame 600B has different dimensions than the frame 600A, the apertures 642B, 643B along each linear frame portion of the frame 600B are spaced apart by the same distance as they are in the frame 600A. The frame may be a 4×6 inch frame such that the second width W2 is four inches and the second length L2 is six inches.

FIG. 20C illustrates the frame 600C. The frame 600C has a third length L3 and a third width W3. The third length L3 and the third width W3 may be larger than the first and second lengths and widths of the frames 600A, 600B. The frame 600C comprises two of the apertures 641C located along the third and fourth linear frame sections and three of the apertures 641C located along the first and second linear frame sections. Furthermore, along each of the linear frame portions of the frame 600B, the adjacently positioned apertures 641C are spaced apart from one another by the distance $D_A$. Thus, despite the fact that the frame 600C has different dimensions than the frames 600A and 600B, the apertures 641C along each linear frame portion of the frame 600C are spaced apart by the same distance as they are in the frames 600A and 600B. The frame 600C may be a 5×7 inch frame such that the third width W3 is five inches and the third length L3 is seven inches.

FIG. 20D illustrates the frame 600D. The frame 600D has a fourth length L4 and a fourth width W4. The fourth length L4 and/or the fourth width W4 may be larger than the lengths and widths of the frames 600A, 600B, 600C. The frame 600D comprises two of the apertures 641D located along the third and fourth linear frame sections and four of the apertures 641D located along the first and second linear frame sections. The two apertures 641D which are adjacent to one another along each linear frame section are considered herein as a pair of the apertures 641D. Along each of the linear frame portions of the frame 600D, apertures 641D of each pair of the apertures 641D are spaced apart from one another by the distance $D_A$. Thus, despite the fact that the frame 600D has different dimensions than the frames 600A, 600B, 600C, the apertures 641D along each linear frame portion of the frame 600D are spaced apart by the same distance as they are in the frames 600A, 600B, 600C. The frame 600D may be a 6×8 inch frame such that the fourth width W4 is six inches and the fourth length L4 is eight inches.

FIG. 20E illustrates the frame 600E. The frame 600E has a fifth length L5 and a fifth width W5. The fifth length L5 and/or the fifth width W5 may be larger than the lengths and widths of the frames 600A, 600B, 600C, 600D. The frame 600E comprises four of the apertures 641E located along each of the first, second, third, and fourth linear frame sections. The two apertures 641E which are adjacent to one another along each linear frame section are considered herein as a pair of the apertures 641E so that there are two pairs of the apertures 641E located along each linear frame section. Along each of the linear frame portions of the frame 600E, apertures 641E of each pair of the apertures 641E are spaced apart from one another by the distance $D_A$. Thus, despite the fact that the frame 600E has different dimensions than the frames 600A-D, the apertures 641E along each linear frame portion of the frame 600E are spaced apart by the same distance as they are in the frames 600A-D. The frame may be an 8×8 inch frame such that the fifth width W5 is eight inches and the fifth length L5 is eight inches.

FIG. 20F illustrates the frame 600F. The frame 600F has a sixth length L6 and a sixth width W6. The sixth length L6 and/or the sixth width W6 may be larger than the lengths and widths of the frames 600A-E. The frame 600F comprises four of the apertures 641F located along each of the first, second, third, and fourth linear frame sections. The two apertures 641F which are adjacent to one another along each linear frame section are considered herein as a pair of the apertures 641F so that there are two pairs of the apertures 641F located along each linear frame section. Along each of the linear frame sections of the frame 600F, apertures 641F of each pair of the apertures 641F are spaced apart from one another by the distance $D_A$. Thus, despite the fact that the frame 600F has different dimensions than the frames 600A-E, the apertures 641F along each linear frame portion of the frame 600F are spaced apart by the same distance as they are in the frames 600A-E. The frame may be an 8×10 inch frame such that the sixth width W6 is eight inches and the sixth length L6 is ten inches.

FIG. 20G illustrates the frame 600G. The frame 600G has a seventh length L7 and a seventh width W7. The seventh length L7 and/or the seventh width W7 may be larger than the lengths and widths of the frames 600A-F. The frame 600G comprises four of the apertures 641G located along each of the first, second, third, and fourth linear frame sections. The two apertures 641G which are adjacent to one another along each linear frame section are considered herein as a pair of the apertures 641G so that there are two pairs of the apertures 641G located along each linear frame section. Along each of the linear frame section of the frame 600G, apertures 641G of each pair of the apertures 641G are spaced apart from one another by the distance $D_A$. Thus, despite the fact that the frame 600G has different dimensions than the frames 600A-F, the apertures 641G along each linear frame portion of the frame 600G are spaced apart by the same distance as they are in the frames 600A-F. The frame may be an 8.5×11 inch frame such that the seventh width W7 is eight and a half inches and the seventh length L7 is eleven inches.

FIG. 20H illustrates the frame 600H. The frame 600H has an eighth length L8 and an eighth width W8. The eighth length L8 and/or the eighth width W8 may be larger than the lengths and widths of the frames 600A-G. The frame 600H comprises four of the apertures 641H located along each of the first, second, third, and fourth linear frame sections. The two apertures 641H which are adjacent to one another along each linear frame section are considered herein as a pair of the apertures 641H so that there are two pairs of the apertures 641H located along each linear frame section. Along each of the linear frame section of the frame 600H, apertures 641H of each pair of the apertures 641H are spaced apart from one another by the distance $D_A$. Thus, despite the fact that the frame 600H has different dimensions than the frames 600A-G, the apertures 641H along each linear frame portion of the frame 600H are spaced apart by the same distance as they are in the frames 600A-G. The frame may be an 10×13 inch frame such that the eighth width W8 is ten inches and the eighth length L8 is thirteen inches.

FIG. 20I illustrates the frame 600I. The frame 600I has a ninth length L9 and a ninth width W9. The ninth length L9 and/or the ninth width W9 may be larger than the lengths and widths of the frames 600A-H. The frame 600I comprises four of the apertures 641I located along each of the first, second, third, and fourth linear frame sections. The two apertures 641I which are adjacent to one another along each linear frame section are considered herein as a pair of the apertures 641I so that there are two pairs of the apertures 641I located along each linear frame section. Along each of the linear frame section of the frame 600I, the apertures 641I of each pair of the apertures 641I are spaced apart from one another by the distance $D_A$. Thus, despite the fact that the frame 600I has different dimensions than the frames 600A-H, the apertures 641I along each linear frame portion of the frame 600I are spaced apart by the same distance as they are in the frames 600A-H. The frame may be an 11×14 inch frame such that the ninth width W9 is eleven inches and the ninth length L9 is fourteen inches.

FIG. 20J illustrates the frame 600J. The frame 600J has a tenth length L10 and a tenth width W10. The tenth length L10 and/or the tenth width W10 may be larger than the lengths and widths of the frames 600A-I. The frame 600J comprises four of the apertures 641J located along each of the first, second, third, and fourth linear frame sections. The two apertures 641J which are adjacent to one another along each linear frame section are considered herein as a pair of the apertures 641J so that there are two pairs of the apertures 641J located along each linear frame section. Along each of the linear frame section of the frame 600J, the apertures 641J of each pair of the apertures 641J are spaced apart from one another by the distance $D_A$. Thus, despite the fact that the frame 600J has different dimensions than the frames 600A-I, the apertures 641J along each linear frame portion of the frame 600J are spaced apart by the same distance as they are in the frames 600A-I. The frame may be an 11×17 inch frame such that the tenth width W10 is eleven inches and the tenth length L10 is seventeen inches.

FIG. 20K illustrates the frame 600K. The frame 600K has an eleventh length L11 and an eleventh width W11. The eleventh length L11 and/or the eleventh width W11 may be larger than the lengths and widths of the frames 600A-J. The frame 600K comprises four of the apertures 641K located along each of the first, second, third, and fourth linear frame sections. The two apertures 641K which are adjacent to one another along each linear frame section are considered herein as a pair of the apertures 641K so that there are two pairs of the apertures 641K located along each linear frame section. Along each of the linear frame section of the frame 600K, the apertures 641K of each pair of the apertures 641K are spaced apart from one another by the distance $D_A$. Thus, despite the fact that the frame 600K has different dimensions than the frames 600A-J, the apertures 641K along each linear frame portion of the frame 600K are spaced apart by the same distance as they are in the frames 600A-J. The frame may be an 12×12 inch frame such that the eleventh width W11 is twelve inches and the eleventh length L11 is twelve inches.

FIG. 20L illustrates the frame 600L. The frame 600L has a twelfth length L12 and a twelfth width W12. The twelfth length L12 and/or the twelfth width W12 may be larger than the lengths and widths of the frames 600A-K. The frame 600L comprises four of the apertures 641L located along each of the first, second, third, and fourth linear frame sections. The two apertures 641L which are adjacent to one another along each linear frame section are considered herein as a pair of the apertures 641L so that there are two pairs of the apertures 641L located along each linear frame section. Along each of the linear frame section of the frame 600L, the apertures 641L of each pair of the apertures 641L are spaced apart from one another by the distance $D_A$. Thus, despite the fact that the frame 600L has different dimensions than the frames 600A-K, the apertures 641L along each linear frame portion of the frame 600L are spaced apart by the same distance as they are in the frames 600A-K. The frame may be an 12×16 inch frame such that the twelfth width W12 is twelve inches and the twelfth length L12 is sixteen inches.

FIG. 20M illustrates the frame 600M. The frame 600M has a thirteenth length L13 and a thirteenth width W13. The thirteenth length L13 and/or the thirteenth width W13 may be larger than the lengths and widths of the frames 600A-L. The frame 600M comprises four of the apertures 641M located along each of the first, second, third, and fourth linear frame sections. The two apertures 641M which are adjacent to one another along each linear frame section are considered herein as a pair of the apertures 641M so that there are two pairs of the apertures 641M located along each linear frame section. Along each of the linear frame section of the frame 600M, the apertures 641M of each pair of the apertures 641M are spaced apart from one another by the distance $D_A$. Thus, despite the fact that the frame 600M has different dimensions than the frames 600A-L, the apertures 641M along each linear frame portion of the frame 600M are spaced apart by the same distance as they are in the frames 600A-L. The frame may be an 12×18 inch frame such that the thirteenth width W13 is twelve inches and the thirteenth length L13 is eighteen inches.

FIG. 20N illustrates the frame 600N. The frame 600N has a fourteenth length L14 and a fourteenth width W14. The fourteenth length L14 and/or the fourteenth width W14 may be larger than the lengths and widths of the frames 600A-M. The frame 600N comprises four of the apertures 641N located along each of the first, second, third, and fourth linear frame sections. The two apertures 641N which are adjacent to one another along each linear frame section are considered herein as a pair of the apertures 641N so that there are two pairs of the apertures 641N located along each linear frame section. Along each of the linear frame section of the frame 600N, the apertures 641N of each pair of the apertures 641N are spaced apart from one another by the distance $D_A$. Thus, despite the fact that the frame 600N has different dimensions than the frames 600A-M, the apertures 641N along each linear frame portion of the frame 600N are spaced apart by the same distance as they are in the frames 600A-M. The frame may be an 13×19 inch frame such that the fourteenth width W14 is thirteen inches and the fourteenth length L14 is nineteen inches.

FIG. 20O illustrates the frame 600O. The frame 600O has a fifteenth length L15 and a fifteenth width W15. The fifteenth length L15 and/or the fifteenth width W15 may be larger than the lengths and widths of the frames 600A-N. The frame 600O comprises four of the apertures 641O located along each of the first, second, third, and fourth linear frame sections. The two apertures 641O which are adjacent to one another along each linear frame section are considered herein as a pair of the apertures 641O so that there are two pairs of the apertures 641O located along each linear frame section. Along each of the linear frame section of the frame 600O, the apertures 641O of each pair of the apertures 641O are spaced apart from one another by the distance $D_A$. Thus, despite the fact that the frame 600O has different dimensions than the frames 600A-N, the apertures 641O along each linear frame portion of the frame 600O are spaced apart by the same distance as they are in the frames 600A-N. The frame may be an 16×20 inch frame such that the fifteenth width W15 is sixteen inches and the fifteenth length L15 is twenty inches. Other lengths and widths may be possible for other frames including 9×12, 11×15, 3.5×5, and the like while still fitting within the pattern of the product line as described and illustrated herein.

By spacing the apertures of each pair of apertures the same regardless of the dimensions of the frame, all of the frames in the product line are capable of being used along with any of the accessories, including the hanging brackets 200, the connector brackets 400, the tray attachments 300.

In embodiments of the invention described herein, the invention may be directed to a kit of parts which may include various combinations of the components described herein.

Referring to FIG. 22, in one embodiment, the invention may be directed to a kit of parts 500 comprising a first frame 100*a*, a second frame 100*b*, and a connector bracket 400. The kit of parts 500 may comprise a package 501 containing each of the first and second frames 100*a*, 100*b* and the connector bracket 400. In some embodiments, the first and second frames 100*a*, 100*b* and the connector bracket 400 may be sold separately rather than packaged together for sale, although they may be intended for use together.

Referring to FIG. 23, in one embodiment the invention may be directed to a kit of parts 600 comprising a frame 100, a first hanging bracket 200*a*, and a second hanging bracket 200*b*. The kit of parts may comprise a package 601 containing each of the frame 100 and the first and second hanging brackets 200*a*, 200*b*. In some embodiments, the frame 100 and the hanging brackets 200*a*, 200*b* may be sold separately rather than packaged together for sale, although they may be intended for use together.

In another embodiment, the kit of parts may comprise one or more of the frames 100, one or more of the connector brackets 400, and at least one pair of the hanging brackets 200. Any package described herein may be plastic, cardboard, paper, box, sleeve, clamshell, rigid plastic container type packaging, flexible plastic wrap type packaging, or the like.

FIGS. 24A-35C illustrate different potential uses for the frames described herein, including various accessory items that may be coupled to the frames. In FIGS. 23A-35C, the frame 100 is used and therefore the description of the frame 100 is entirely applicable, including any description of potential alternative features or modifications. Thus, the frame 100 has mounting elements 140, each of which is an aperture 141 in the exemplified embodiment but could take on other forms in other embodiments. The frame also has the connector holes 150-153.

Referring in particular to FIGS. 24A and 24B, a frame apparatus is illustrated which comprises the frame 100 and an easel 700. The easel 700 may comprise mounting elements 701, 702. The mounting elements 701, 702 may be hooks, posts, male mounting elements, or the like as shown, but could take on other forms in other embodiments. The mounting elements 701, 702 may engage the first and second connector holes 150, 151, respectively, to facilitate the coupling of the easel 700 to the frame 100. In other embodiments, the mounting elements 701, 702 may engage the third and fourth connector holes 152, 153, respectively, to facilitate the coupling of the easel 700 to the frame 100.

The easel 700 may have some inherent flexibility so that the easel 700 can be flexed inwardly when attaching the mounting elements 701, 702 to the connector holes 150, 151 of the frame, and then when the easel 700 is released it may bias back to its natural state which results in the mounting elements 701, 702 forcibly engaging the frame 100 for attachment thereto. Other techniques for attaching the easel 700 to the frame 100 may be used, including modifying the style or structure of the mounting elements 701, 702 to more tightly engage the connector holes 150-153. Moreover, in other embodiments the mounting elements 701, 702 may be positioned and configured to engage the mounting elements 140 of the frame 100 rather than or in addition to the connector holes 150-153. The frame 100 may function as a picture frame, a whiteboard, a corkboard, or any other type of functional device as described herein with the easel 700 being useful to support the frame 100 in a desired position on a horizontal surface.

FIGS. 25A and 25B illustrate the frame 100 with an accessory pad 710 coupled to the frame 100 along one of the side portions of the frame 100. The accessory pad 710 could be coupled to the frame 100 along any of the linear frame sections of the frame 100 as described herein. The accessory pad 710 may be a cork pad, a whiteboard pad, a metal or magnetic pad or the like. Thus, a user may write on the accessory pad 710 or may adhered items to it using thumb tacks, magnets, or the like. The accessory pad 710 may also be modified to be a marker clip or a writing utensil holder.

The accessory pad 710 may comprise a plurality of mounting elements 711 that are configured to engage with a plurality of the mounting elements 140 of the frame 100. The plurality of mounting elements 711 may be aligned along one side of the accessory pad 710 so that the mounting elements 711 are positioned to engage multiple of the mounting elements 140 of the frame 100 simultaneously. While there are four of the mounting elements 711 in the exemplified embodiment, the accessory pad 710 may comprise just one of the mounting elements 711, or two of the mounting elements 711, or three of the mounting elements 711 in alternative embodiments. The accessory pad 710 is illustrated as rectangular and extending along a full length of the side of the frame 100 to which the accessory pad 710 is adjacent in the exemplified embodiment, but could take on other shapes and sizes in alternative embodiments.

The mounting elements 711 of the accessory pad 710 may be male mounting elements such as hooks, posts, or the like which are configured to engage with the apertures 141 of the mounting elements 140 of the frame 100. In other embodiments, the mounting elements 711 of the accessory pad 710 could be female mounting elements (such as apertures, recesses, slots, or the like) and the mounting elements 140 of the frame 100 could be male mounting elements (such as posts, hooks, protrusions, etc.). While the mounting elements 711 are illustrated as engaging with the mounting elements 140, in other embodiments the mounting elements 711 (or other mounting elements) may engage with the connector hole 150.

FIG. 26 illustrates a plurality of containers 720 that are detachably coupled to the frame 100. Each of the containers 720 comprises a body portion 721 defining a cavity 722 for storing items such as writing utensils, flowers, decorative items, or any other type of item which may fit inside of the cavity. The body portion 721 may be round/cylindrical with an open top end as shown, or may take on any other desired shape and/or size. The containers 720 further comprise a connector 723 protruding from the body portion 721. The connector 723 may comprise a mounting element 724 that is configured to engage either one of the mounting elements 140 or one of the connector holes 150-153 of the frame 100. In the exemplified embodiment, the connector 723 comprises an arm 725 protruding upwardly from a top end of the container 720 and the mounting element 724 which is a hook-like feature protruding from a distal end of the arm 725. Other configurations may be possible, including the arm 725 of the connector 723 protruding from a side of the body portion 721 of the container 720, which may facilitate attachment of the container 720 along a side of the frame 100 rather than along a bottom of the frame 100 as shown in the exemplified embodiment.

The containers 720 may be coupled to the frame 100 via engagement between the mounting element 724 of the connector 723 and one of the mounting elements 140 or one of the connector holes 150-153 of the frame 100. Thus, in the exemplified embodiment the mounting elements 724 of the containers 720 may comprise male mounting elements such as hooks, posts, protrusions or the like which are configured to engage apertures or holes int eh frame 100. In other embodiments, the frame 100 may comprise the male mounting elements and the containers 720 may comprise the female mounting elements.

FIG. 27 illustrates a frame apparatus or assembly which comprises the frame 100 and a plurality of hanger hooks 730. The hanger hooks 730 may comprise an elongated arm portion 731 extending from a first end to a second end, a mounting element 732 coupled to the first end of the elongated arm portion 731, and a hanging element 733 extending from the second end of the elongated arm portion 731. The mounting element 732 may be a hook, a post, a protrusion, or other male mounting element that is configured to engage the apertures 141 of the mounting elements 140 or the connector holes 150-153 of the frame 100 to facilitate the coupling of the hanger hook 730 to the frame 100. In other embodiments, the mounting element 732 may be a female element such as a recess, aperture, or the like and the mounting elements 140 of the frame a 100 may comprise male elements such as posts, hooks, protrusions, or the like. The hanging element 733 may be a hook-like element that is configured for holding various items such as coats, hats, scarves, umbrellas, bags, backpacks, or the like. The elongated arm portions 731 may be sufficiently long to ensure that the hanging elements 732 are spaced from an edge of the frame 100 so that there is sufficient space to hang items thereon.

FIG. 28 illustrates a frame apparatus or assembly which comprises the frame 100 and yet another type of container 740 which is detachably coupled to the frame 100. The container 740 comprises a container body 741 and a pair of attachment members 742 extending from a top of the container body 741. The attachment members 742 may comprise mounting elements 743 that are configured to engage the mounting elements 140 or the connector holes 150-153 of the frame 100. The mounting elements 743 may be hooks or male elements in the exemplified embodiment, but the mounting elements 743 could be apertures or female elements in other embodiments depending on the structure and configuration of the mounting elements 140 of the frame 100.

FIG. 29 illustrates a frame apparatus or assembly which comprises the frame 100 and a decorative accessory item 750 detachably coupled thereto. The decorative accessory item 750 comprises a decorative feature 751 and a plurality of mounting elements 752. In the exemplified embodiment, the decorative accessory item 750 comprises a plate portion 753 with the decorative feature 751 extending from a top of the plate portion 753 and the mounting elements 752 extending from a bottom of the plate portion 753. However, the plate portion 753 could be omitted in other embodiments and the mounting element(s) 752 could be coupled directly to the decorative feature 751. The mounting elements 752 may comprise male elements like hooks, posts, protrusions or the like which are configured to engage the mounting elements 140 (e.g., the apertures 141) to facilitate the coupling of the decorative accessory item 750 to the frame 100. In other embodiments, the mounting elements 752 may be female elements and the mounting elements 140 may be male elements.

FIGS. 30A and 30B illustrate two of the frames 100*a*, 100*b* coupled to a support surface such as a wall 799. The frame 100*a* may be mounted directly to the support surface 799 using screws or mounting brackets or the like as described herein. The frame 100*b* may be mounted to the support surface 799 via one or more standoffs 760. The standoffs 760 may be coupled directly to the support surface 799 and may comprise mounting elements such as hooks, posts, protrusions, or other male features which are configured to engage the mounting elements 140 or apertures 141 of the frame 100*b* to mount the frame 100*b* on the support surface 799. Thus, the mounting elements of the standoffs 760 may engage the mounting elements 140 of the frame 100*b* (or the connector holes 150-153 of the frame 100) to facilitate attaching or mounting the frame 100*b* to the support surface 799. The standoffs 760 mount the frame 100*b* to the support surface 799 in a spaced apart manner such that the frame 100*b* is spaced from the support surface 799 as best shown in FIG. 30B.

FIG. 31 illustrates a frame assembly or apparatus which comprises a plurality of frames 100 hanging from a support rod or bar 770 by a plurality of hanging members 771. The support rod 770 may be mounted to a support surface such as a wall or a cabinet or a door or the like and the hanging members 771 may be configured to be coupled to the support rod 770 so as to hang therefrom. The hanging members 771 may comprise mounting elements that are configured to engage the mounting elements 140 or the connector holes 150-153 of the frames 100 to facilitate the hanging of the frames 100 from the support rod 770. The mounting elements of the hanging members 771 may be as described above (male elements or female elements depending on the structure of the mounting elements of the frame 100).

FIG. 32 illustrates a frame assembly or apparatus which comprises the frame 100 and one or more suction cups 780 coupled to the frame 100. The suction cups 780 comprise a cup portion 781 which is configured to achieve the function of adhering to a surface such as a wall or a table or a desk or a cabinet or a window or the like and a mounting portion 782 which is configured to facilitate the attachment of the suction cups 780 to the frame 100. In the exemplified embodiment, the mounting portion 782 is a post-like feature which can be forcibly inserted into the apertures 141 of the mounting elements 140 of the frame 100 (or into the connector holes 150-153). However, the structure, shape, and/or configuration of the mounting portion 782 may be modified to ensure it is capable of mating with or otherwise engaging the mounting elements 140 of the frame 100. Any desired number of the suction cups 780 (up to the number of the mounting elements 140 located on the frame 100) may be used in various embodiments depending on the amount of weight needed to be supported by the suction cups 780, the size of the frame 100, and the like. The mounting portions 782 of the suction cups 780 may be press fit into the apertures 141 of the mounting elements 140 of the frame 100 and may fit tightly therein. The suction cups 780 may be detachable and reinsertable by a user as desired or needed.

FIG. 33 illustrates a frame 790 having mounting elements 791 that are similar to the mounting elements 140 of the frame 100 except with regard to the shape thereof. The mounting elements 791 have a circular center portion 792 and two linear end portions 793, 794 extending from opposite sides of the circular center portion. 792 The shape of the mounting elements 791 may be preferable for use to couple the suction cups 780 to the frame 790. The mounting elements 791 may include some shaped as shown and some which are rectangular or other shapes. As noted herein, the mounting elements 140 of the frames 100 may have a variety of different shapes and the invention is not limited to rectangular shaped mounting elements 140/apertures 141 in all embodiments.

FIG. 34A illustrates a container 800 which is configured to be detachably coupled to the frame 100 using the mounting elements 140 or the connector holes 150-153 of the frame 100. The container 800 comprises a plurality of sides 801*a-d*, each of which comprises at least one, or a plurality, of mounting elements 802 thereon. The mounting elements 802 may be hooks, posts, or protrusions (male mounting elements) to facilitate engagement with the apertures 141 *o* the connector holes 150-153 of the frame 100. Alternatively, when the mounting elements 140 of the frame 100 are male mounting elements, the mounting elements 802 of the container 800 may be female mounting elements such as apertures, recesses, slots, grooves, channels, or the like. In the exemplified embodiment, there are four of the mounting elements 802 located on each face of the container 800, although more or less mounting elements 802 may be included in other embodiments.

As shown in FIG. 34B, the frame 100 may be coupled or mounted to the container 800 via engagement between the mounting elements 802 of the container 800 and the mounting elements 140 of the frame 100. That is, the male member (hooks) of the container 800 may engage the female members (apertures 141) of the frame 100 to facilitate coupling the frame 100 to the container 800. Of course, the frame 100 may comprise the male members and the container 800 the female members in other embodiments. The mounting elements 140 of the frame 100 may be used for attaching the frame 100 to an accessory such as the container 800.

FIG. 35A illustrates a hinge strip 810 that may be used to attach two of the frames 100 together via engagement between the hinge strip 810 and the mounting elements 140 of the two frames 100. The hinge strip 810 may comprise a first strip portion 820 and a second strip portion 830 that are connected together by a living hinge 840. In other embodiments, the first and second strip portions 820, 830 may be connected together by a separate hinge member, such as a more conventional hinge like those used on doors and the like. The hinge strip 810 may comprise a first set of mounting elements 821 located on the first strip portion 820 and a second set of mounting elements 831 located on the second strip portion 830. The first and second sets of mounting elements 821, 831 comprise four mounting elements each in the exemplified embodiment, but any number of the mounting elements 821, 831 may be used in other embodiments. In the exemplified embodiment, each of the mounting elements 821, 831 is a hook, a post, a protrusion, or other male type mounting element that is configured to engage one of the apertures 141 of the mounting elements 140 of the frame 100. Of course, depending on the structure and configuration of the mounting elements 140 of the frame 100, modifications may be made to the mounting elements 821, 831. That is, if the mounting elements 140 of the frame 100 are male elements, then the mounting elements 821, 831 of the hinge strip 810 may be female elements.

Referring to FIG. 35B, the hinge strip 810 is depicted coupled to a first frame 100*a* and a second frame 100*b*. The mounting elements 821 of the hinge strip 810 are engaged with the mounting elements 140 of the frame 100*a* and the mounting elements 831 of the hinge strip 810 are engaged with the mounting elements 140 of the frame 100*b*. When the hinge strip 810 is connected to each of the first and second frames 100*a*, 100*b*, the first and second frames 100*a*, 100*b* are coupled to one another via the hinge strip 810. Furthermore, the first and second frames 100*a*, 100*b* are capable of pivoting relative to one another about the hinge portion 840.

FIG. 35C illustrates three frames 100*a*, 100*b*, 100*c* connected together with two hinge strips 810*a*, 810*b*. The first hinge strip 810*a* connects the first and second frames 100*a*, 100*b* together and the second hinge strip 810*b* connects the second and third frames 100*b*, 100*c* together. The frames 100*a*, 100*b*, 100*c* may be pivoted relative to one another about the living hinges 840*a*, 840*b* of the first and second hinge strips 810*a*, 810*b*. By allowing the frames 100*a*, 100*b*, 100*c* to be oriented at angles relative to one another, the hinge strips 810 may facilitate resting the frames 100*a-c* on a horizontal surface such as a tabletop without the need for an easel or other supporting member.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A kit of parts for interconnecting a plurality of frames, the kit of parts comprising:

a first frame comprising an outer annular wall defining a display cavity configured to retain a first display item, an inner annular wall that is spaced apart from the outer annular wall, and a floor extending between the outer and inner annular walls, at least one first connector element located along the floor of the first frame;

a second frame comprising an outer annular wall defining a display cavity configured to receive a second display item, an inner annular wall that is spaced apart from the outer annular wall, and a floor extending between the outer and inner annular walls, at least one second connector element located along the floor of the second frame; and a connector bracket comprising an elongated body portion having a plurality of mounting elements, wherein a first one of the plurality of mounting elements of the connector bracket is configured to mate with the at least one first connector element of the first frame and a second one of the plurality of mounting elements of the connector bracket is configured to mate with the at least one second connector element of the second frame to couple the first and second frames to one another so that upon hanging the first frame from a support surface, the second frame hangs from the first frame by the connector bracket.

2. The kit of parts according to claim 1 wherein the at least one first connector element of the first frame is a first connector hole formed through the floor of the first frame, wherein the at least one second connector element of the second frame is a second connector hole formed through the floor of the second frame, and wherein the plurality of mounting elements of the connector bracket are mounting protrusions that protrude from a front surface of the elongated body portion of the connector bracket.

3. The kit of parts according to claim 1 wherein the elongated body portion of the connector bracket is elongated along a longitudinal axis, and wherein the plurality of mounting elements of the connector bracket are axially spaced apart along the elongated body portion.

4. The kit of parts according to claim 1 wherein the first frame comprises a first longitudinal axis and a first transverse axis, the at least one first connector element being located on one of the first longitudinal axis and the first transverse axis, and wherein the second frame comprises a second longitudinal axis and a second transverse axis, the at least one second connector element being located on one of the second longitudinal axis and the second transverse axis.

5. The kit of parts according to claim 4 wherein the first frame comprises a first linear frame section, a second linear frame section that is parallel to the first linear frame section, a third linear frame section, and a fourth linear frame section that is parallel to the third linear frame section, the at least one first connector element comprising a plurality of the first connector elements each positioned adjacent to one of the first, second, third, and fourth linear frame sections of the first frame and being intersected by one of the first longitudinal axis and the first transverse axis; and wherein the second frame comprises a first linear frame section, a second linear frame section that is parallel to the first linear frame section, a third linear frame section, and a fourth linear frame section that is parallel to the third linear frame section, the at least one second connector element comprising a plurality of the second connector elements each positioned adjacent to one of the first, second, third, and fourth linear frame sections of the second frame and being intersected by one of the second longitudinal axis and the second transverse axis.

6. The kit of parts according to claim 1 wherein when the first and second frames are coupled to one another via the connector bracket, a portion of the elongated body of the connector bracket extends between the first and second frames such that the first and second frames are spaced apart from one another when coupled together.

7. The kit of parts according to claim 1 wherein the plurality of mounting elements of the connector bracket comprises at least three of the mounting elements such that a distance measured between the first and second frames is adjustable by modifying which of the at least three of the mounting elements of the connector bracket is mated to each of the first and second connector elements of the first and second frames.

8. The kit of parts according to claim 1 wherein the elongated body of the connector bracket is a flat plate having planar front and rear surfaces.

9. The kit of parts according to claim 1 wherein each of the first and second frames comprises a first linear frame section, a second linear frame section that is parallel to the first linear frame section, a third linear frame section, and a fourth linear frame section that is parallel to the third linear frame section, and wherein along each of the first, second, third, and fourth linear frame sections of each of the first and second frames the inner annular wall comprises first and second linear portions and an arcuate portion located between the first and second linear portions, and wherein for the first frame each of the first connector elements is located along a portion of the floor that is surrounded by one of the arcuate portions of the inner annular wall and for the second frame each of the second connector elements is located along a portion of the floor that is surrounded by one of the arcuate portions of the inner annular wall.

10. The kit of parts according to claim 9 wherein the first and second frames each comprise a longitudinal axis and a transverse axis, and wherein the first and second connectors and the arcuate portions of the inner annular wall are intersected by one of the longitudinal and transverse axes.

11. The kit of parts according to claim 1 further comprising a package, wherein the first frame, the second frame, and the connector bracket are positioned within the package.

12. A kit of parts for interconnecting a plurality of frames, the kit of parts comprising:

a first frame comprising a display cavity configured to retain a first display item and at least one first connector element;

a second frame comprising a display cavity configured to receive a second display item and at least one second connector element; and a connector bracket comprising an elongated body portion having a plurality of mounting elements, wherein a first one of the plurality of mounting elements of the connector bracket is configured to mate with the at least one first connector element of the first frame and a second one of the plurality of mounting elements of the connector bracket is configured to mate with the at least one second connector element of the second frame to couple the first and second frames to one another so that upon hanging the first frame from a support surface, the second frame hangs from the first frame.

13. The kit of parts according to claim 12 wherein the at least one first connector element of the first frame is a first connector hole formed through the first frame, wherein the at least one second connector element of the second frame is a second connector hole formed through the second frame, and wherein the plurality of mounting elements of the connector bracket are mounting protrusions that protrude from the elongated body portion of the connector bracket.

14. The kit of parts according to claim 12 wherein the plurality of mounting elements of the connector bracket comprises at least three of the mounting elements such that a distance measured between the first and second frames is adjustable by modifying which of the at least three of the mounting elements of the connector bracket is mated to each of the first and second connector elements of the first and second frames.

15. A method of interconnecting a plurality of frames and hanging the plurality of frames from a support surface, the method comprising:

mating a first mounting element of a connector bracket to a first connector element of a first frame to attach the connector bracket to the first frame;

mating a second mounting element of the connector bracket to a connector element of a second frame to attach the connector bracket to the second frame; and hanging the first frame from the support surface, the second frame hanging from the first frame via the connector bracket.

16. The method according to claim 15 wherein the first connector element is a first connector hole extending through a floor of the first frame and the second connector element is a second connector hole extending through a floor of the second frame, and wherein the first and second mounting elements of the connector bracket are first and second mounting protrusions that extend into the first and second connector holes, respectively, to attach the connector bracket to the first and second frames.

17. The method according to claim 16 wherein the connector bracket comprises an elongated body having a front surface and a rear surface, and wherein the first and second mounting protrusions protrude from the front surface of the elongated body.

18. The method according to claim 15 wherein the first frame comprises an outer annular wall, an inner annular wall, and a floor extending between the outer and inner annular walls, the floor comprising at least one first aperture located along a first linear section of the first frame and at least one second aperture located along a second linear section of the first frame.

19. The method according to claim 18 further comprising:

attaching a first hanging bracket to the first frame via mating between one or more first mounting elements of the first hanging bracket and the at least one first aperture formed into the floor of the first linear section of the first frame, the first hanging bracket comprising a first bracket portion;

attaching a second hanging bracket to the first frame via mating between one or more second mounting elements of the second hanging bracket and the at least one second aperture formed into the floor of the second linear section of the first frame, the second hanging bracket comprising a second bracket portion; and hanging the first frame from the support structure by engagement between the first and second bracket portions of the first and second hanging brackets and a top edge of the support structure.

* * * * *